US009268262B2

(12) United States Patent
Shoji et al.

(10) Patent No.: US 9,268,262 B2
(45) Date of Patent: Feb. 23, 2016

(54) ELECTROPHOTOGRAPHIC IMAGE-FORMING DEVICE PROVIDED WITH END SEAL MEMBER

(76) Inventors: Susumu Shoji, Kobe (JP); Kazuro Fukui, Kobe (JP)

( * ) Notice: Subject to any disclaimer, the term of this patent is extended or adjusted under 35 U.S.C. 154(b) by 0 days.

(21) Appl. No.: 14/398,023

(22) PCT Filed: Apr. 30, 2012

(86) PCT No.: PCT/JP2012/061498

§ 371 (c)(1),
(2), (4) Date: Feb. 24, 2015

(87) PCT Pub. No.: WO2013/164872

PCT Pub. Date: Nov. 7, 2013

(65) Prior Publication Data

US 2015/0177650 A1 Jun. 25, 2015

(51) Int. Cl.
*G03G 15/08* (2006.01)

(52) U.S. Cl.
CPC ..... *G03G 15/0898* (2013.01); *G03G 15/0817* (2013.01)

(58) Field of Classification Search
CPC ..... G03G 15/0817; G03G 15/0898
USPC ..... 399/102, 103, 105
See application file for complete search history.

(56) References Cited

U.S. PATENT DOCUMENTS

| | | | | |
|---|---|---|---|---|
| 6,553,195 | B2 * | 4/2003 | Korfhage et al. | 399/102 |
| 2002/0141777 | A1 | 10/2002 | Kamimura et al. | |
| 2006/0245783 | A1 * | 11/2006 | Kamimura et al. | 399/103 |

FOREIGN PATENT DOCUMENTS

| | | | |
|---|---|---|---|
| JP | 60-88346 | U | 6/1985 |
| JP | 60-191056 | U | 12/1985 |
| JP | 01-235984 | A | 9/1989 |
| JP | 02-210476 | A | 8/1990 |
| JP | 03-051454 | A | 3/1991 |
| JP | 04-174885 | A | 6/1992 |
| JP | 07-140786 | A | 6/1995 |
| JP | 07-219343 | A | 8/1995 |
| JP | 09-274380 | A | 10/1997 |
| JP | 11-194612 | A | 7/1999 |
| JP | 2000-170919 | A | 6/2000 |
| JP | 2003-076235 | A | 3/2003 |
| JP | 2003-107902 | A | 4/2003 |
| JP | 2003-149939 | A | 5/2003 |
| JP | 2004-219741 | A | 8/2004 |
| JP | 2006-243722 | A | 9/2006 |

(Continued)

*Primary Examiner* — Sophia S Chen
(74) *Attorney, Agent, or Firm* — Westerman, Hattori, Daniels & Adrian, LLP

(57) ABSTRACT

An electrophotographic image-forming device which permits reduction in the size of the device to be made possible, and which permits prevention of toner leakage through use of a sealing member having projections and recesses, said sealing member serving as an end seal member. The image-forming device has a sealing member which serves as an end seal member for a toner carrier. The end seal member for preventing leakage of toner from the toner carrier is formed from the sealing member which has step(s) comprising band(s) formed by recessed region(s) and projecting region(s) as indicated in FIG. 1. The end seal member is capable of bending such that recessed region(s) come in contact with the toner carrier, inhibiting entry of toner thereinto, and the end seal member also has a toner scraping action and a toner movement action.

23 Claims, 23 Drawing Sheets

(56) References Cited

FOREIGN PATENT DOCUMENTS

| | | | |
|---|---|---|---|
| JP | 2007-179080 | A | 7/2007 |
| JP | 2008-299030 | A | 12/2008 |
| JP | 2009-047981 | A | 3/2009 |
| JP | 2009-93079 | A | 4/2009 |
| JP | 2009-110023 | A | 5/2009 |
| JP | 2009-145705 | A | 7/2009 |
| JP | 2012-82554 | A | 4/2012 |
| JP | 4912509 | B1 | 4/2012 |
| WO | 2011-138822 | A1 | 11/2011 |

* cited by examiner

Enlarged view of region A

ELECTROPHOTOGRAPHIC IMAGE-FORMING DEVICE PROVIDED WITH END SEAL MEMBER

TECHNICAL FIELD

The present invention relates to an electrophotographic image-forming device having end seal member(s), and in particular, toner seal structure(s) employing sealing member(s) comprising woven fabric(s), and to processing unit(s) and component unit(s) in which such constituent part(s) are present in cartridge or module form.

BACKGROUND ART

Electrophotographic image-forming devices have conventionally had end seal members at photosensitive bodies and end seal members at develop apparatuses, and have had end seal members at intermediate transfer bodies and/or intermediate transfer belts in color image-forming devices, preventing leakage of toner at the interior of the image-forming device, and preventing contamination of the interior of the image-forming device and image defects which would otherwise occur due to leakage of toner. Furthermore, end seal members used in electrophotographic image-forming devices include sealing members comprising foamed synthetic resin bodies, sealing members comprising nonwoven fabrics, sealing members comprising implanted fibers, sealing members comprising piled woven fabrics, sealing members comprising woven fabric, sealing members comprising knit fabrics, and so forth. Such sealing members are frequently used in electrophotographic image-forming devices as end seal members at toner carriers to seal ends where surfaces of toner carriers which carry toner are partially exposed or as end seal members at toner carriers to seal ends where surfaces of toner carriers which are rotating bodies are partially exposed.

As indicated below, there are variety of conventional technologies related to material, structure, and so forth of sealing members used in image-forming devices. One thereamong discloses a develop apparatus in which an end face at one end of a seal member is made into a toner guide rake face comprising a rake angle (e.g., see Patent Reference No. 1). The develop apparatus in accordance with this disclosure has a guide comprising a single-step guide which is provided at one location for returning toner at a sheet, and because this single-step guide has a structure which is sheet-like and which engages in surface contact, the area over which it contacts the sleeve is large. Because the conventional device is thus a single-step guide, and because of rubbing of the sleeve due to sheet-like surface contact and slight leakage of toner, there is a large torque load on the sleeve, as a result of which there has been the problem that torque is high at the develop apparatus.

A develop apparatus has been disclosed in which a foamed body is employed as developer leakage prevention member, an inclined groove being provided such that the direction of movement of developer is made to be in a forward direction (e.g., see Patent Reference No. 2). However, the end seal member at the develop apparatus which is disclosed at this reference comprises a sealing member having a structure in which a groove is provided at a foamed body. But because this sealing member comprising a foamed body is an elastic body, the fact that the elastic body deforms as a result of rubbing due to contact with the develop roller has caused the effect whereby toner is controlled and returned to be lessened, so it can hardly be said that this possesses adequate seal functionality as an end seal member for a develop apparatus, and develop apparatuses have therefore been inadequate despite provision of such sealing members.

A cleaning apparatus has been disclosed as solution means to address deleterious effects of accumulation of toner below a side seal in the context of a cleaning apparatus for an image-forming device, the means being such that a slide member is attached at a location upstream from a sealing member to prevent accumulation of toner on the sealing member (e.g., see Patent Reference No. 3). However, the cleaning apparatus which is disclosed at this reference is such that toner constituting powder is diverted therebelow a little at a time and whenever necessary so that in practice there is no problem whatsoever with regard to deleterious effects from accumulated toner. But as the fact that toner is diverted therebelow a little at a time itself constitutes a problem, it cannot be said that this apparatus is an adequate cleaning apparatus.

A develop apparatus has been disclosed which is provided with a guide for causing toner which has entered the space between a sealing member and a rotating body to be made to return, as a result of rotation of the rotating body, to a region that comes in compressive contact with a control member (see, for example, Patent Reference No. 4). Here, the structure of the end seal member at the rotating body serving as the develop apparatus is a develop apparatus comprising a structure in which there is a sheet over which an inclined sheet is affixed, the step formed from these sheets being employed as toner guide so as to control leakage of toner. This apparatus has the same problem as at the aforementioned Patent Reference No. 1, which is that because of rubbing of the sleeve at the plane of the sheet and slight leakage of toner, there is a large torque load on the sleeve, and so there has been the problem that torque is high at the develop apparatus.

A sealing mechanism for a develop apparatus is disclosed which employs a sealing member in which implanted fibers are woven thereinto, the sealing mechanism for the develop apparatus being formed such that an angle of collapse of implanted fibers in an axial direction and an angle in which they are woven thereinto are defined (e.g., see Patent Reference No. 5). However, although the implanted fibers are woven thereinto it is nonetheless the case that the fibers are implanted, as a result of which there is the phenomenon of shedding of fibers, and so as a result of rubbing over long periods of time due to compressive contact with the develop roller there has been occurrence of fiber shedding, and it has been the case that a phenomenon whereby shed fibers enter the interior of the develop apparatus and are trapped by the toner control blade has caused appearance of bands on the developed surface or has caused occurrence of decrease in seal characteristics due to fiber shedding, and so it can hardly be said that these possess adequate seal characteristics, and there have also been problems with regard to ability to function as a develop apparatus.

A cleaning apparatus for an image-forming device has been disclosed, the cleaning apparatus being such that an end seal member is constituted from synthetic leather which contacts an image carrier and an elastic member which is made to adhere in integral fashion to this synthetic leather (see, for example, Patent Reference No. 6). Prior to recent years, because pulverized toner had been the favored approach, this cleaning apparatus had been used without any problem. However, in recent years, conglobated toner has come into frequent use. In this regard, in the Benefits of the Invention section of this Patent Reference No. 6, it is described that while the toner may have small particle diameter, it can be limited to a minimum that will permit passage through synthetic leather. But because the conglobated toner of recent years has a particle diameter that is even smaller than the toner of small particle diameter prior to recent years which is described at this reference, this makes it difficult to control or block leakage of toner through mere presence of a fine-structure-type configuration at the surface of a sealing member. For this reason, the back-skin-type sealing member comprising synthetic leather and an elastic member which is made to adhere in integral fashion to this synthetic leather as indicated at this Patent Reference No. 6 is inadequate as an end seal for a cleaning apparatus.

Moreover, in the context of a device comprising a processing cartridge capable of being installed in and removed from the main body of an image-forming device, a processing cartridge has been disclosed which is formed such that a magnetic sealing member is arranged with a prescribed gap between it and an outside circumferential surface of a developer carrier, an elastic body being provided so as to cause the developer carrier to be contacted thereby over the entire circumference at a portion corresponding to the magnetic sealing member and adjacent to the develop region side of the magnetic sealing member (e.g., see Patent Reference No. 7). It should be noted that this processing cartridge is effective as to the sealing effect of a magnetic seal formed with respect to magnetic toner and two-component developer. However, with respect to nonmagnetic toner, there being no magnetic constraining force, sealing is not possible. Furthermore, because this processing cartridge employs a magnetic body, it cannot be said to be advantageous from the standpoint of cost.

Furthermore, as a sealing member for preventing leakage of toner, a sealing member has also been disclosed which is a sealing member comprising a high-resistance electrically conductive member, and in which a voltage is applied to this sealing member to cause accumulation of charge at developer, a groove being formed such as will allow motion toward a central region facing an axial direction of a develop roller (e.g., see Patent Reference No. 8). Moreover, while this reference describes the sealing member as being formed flexible cloth, felt, urethane rubber, or other such elastic member, it is described that this alone will not permit prevention of scattering due to generation of a developer cloud or leakage of developer. That is, this is a develop apparatus that has been made capable of preventing leakage of toner as a result of application of voltage to a sealing member comprising a high-resistance electrically conductive member to cause accumulation of charge at developer, the sealing member being a rubber-type elastic body in which fine electrically conductive particles have been mixed, the surface of which has been coated with a friction-reducing polyamide-type (trade name Nylon), styrene-type, or fluoro-type coating agent, which are expensive components, making the develop apparatus expensive.

Moreover, with respect to sealing members comprising woven fabric, a sealing member comprising woven fabric is disclosed which is such that yarn is raised in wavelike fashion, yarn at peaks and valleys being arranged differently (e.g., see Patent Reference No. 9). With such woven fabric, the fact that yarn diameter is large and the fact that it is made up of multiple weaving patterns makes it possible that there will be spaces at the valleys between peaks, or that the yarn which forms peak regions will collapse to the side due to compression of the fiber, and will in addition collapse into valley regions, as a result of which blockage of toner may become unstable.

Moreover, sealing structures for rotating bodies formed by printing have been disclosed (e.g., see Patent Reference No. 10). Because such sealing structures that are stepped guides which are produced by printing, it is difficult to sharply form the corner which will serve as guide.

Furthermore, a develop apparatus has been disclosed which employs a sealing member in which projecting interstices of the woven mesh arranged so that overlapping portions of surfaces are progressively staggered are arrayed in such fashion as to be inclined at a prescribed angle which is less than or equal to 45° relative to the direction of motion of the developer carrier (e.g., see Patent Reference No. 11 or Patent Reference No. 12). However, at a woven fabric having such a woven pattern, the structure is such that the overlapping portions which control toner block toner from entering the interior of the sealing member, the warp yarns being in the forward direction relative to the direction of motion of the developer carrier, and the projecting interstices of the woven mesh being at an angle relative to the direction of motion. Accordingly, where toner has entered from the axial direction of the sealing member, since, so long as the warp yarns are in the forward direction, movement will be toward the interior or toward the exterior in the axial direction, this cannot be said to be adequate effect with respect to return of toner. For this reason, grease-like fluorinated lubricants have therefore been applied, this being nothing more than augmentation of the occluding effect of the warp yarns toward the interior of the sealing member. Furthermore, with regard to develop apparatuses, such application of grease-like substances to end seal members tends to cause toner to clump as if the toner had aggregated, and increases the likelihood of occurrence of image defects, and so it can be said that such an apparatus is inadequate as a develop apparatus, in addition to which there is nothing distinctive about the constitution in terms of recessed regions.

PRIOR ART REFERENCES

Patent References

Patent Reference No. 1: Japanese Utility Model Application Publication Kokai No. S60[1985]-88346
Patent Reference No. 2: Japanese Utility Model Application Publication Kokai No. S60[1985]-191056
Patent Reference No. 3: Japanese Patent Application Publication Kokai No. H1[1989]-235984
Patent Reference No. 4: Japanese Patent Application Publication Kokai No. H2[1990]-210476
Patent Reference No. 5: Japanese Utility Model Application Publication Kokai No. H3[1991]-51454
Patent Reference No. 6: Japanese Patent Application Publication Kokai No. H4[1992]-174885
Patent Reference No. 7: Japanese Patent Application Publication Kokai No. H7[1995]-219343
Patent Reference No. 8: Japanese Patent Application Publication Kokai No. H9[1997]-274380
Patent Reference No. 9: Japanese Patent Application Publication Kokai No. H11[1999]-194612
Patent Reference No. 10: Japanese Patent Application Publication Kokai No. 2000-170919
Patent Reference No. 11: Japanese Patent Application Publication Kokai No. 2003-107902
Patent Reference No. 12: Japanese Patent Application Publication Kokai No. 2007-179080
Patent Reference No. 13: Japanese Patent Application Publication Kokai No. 2009-47981
Patent Reference No. 14: Japanese Patent Application Publication Kokai No. H7[1995]-140786
Patent Reference No. 15: Japanese Patent Application Publication Kokai No. 2004-219741
Patent Reference No. 16: Japanese Patent Application Publication Kokai No. 2008-299030

Patent Reference No. 17: Japanese Patent Application Publication Kokai No. 2009-145705

Patent Reference No. 18: Japanese Patent Application Publication Kokai No. 2009-110023

Patent Reference No. 19: Japanese Patent Application Publication Kokai No. 2006-343722

Patent Reference No. 20: Japanese Patent Application Publication Kokai No. 2003-76235

SUMMARY OF INVENTION

Problem to be Solved by Invention

Electrophotographic image-forming devices are such that, to achieve the energy conservation and resource conservation of recent years, and reduced size of installation space being necessary, reduction in size of the device is desirable. Moreover, because a tandem-type device has four processing units, the need to for reduction in size is especially great. Furthermore, because toner which has resin as primary component is such that the glass transition temperature and melting point of the resin are low, there is the problem that it is affected by heat of friction due to rubbing. Accordingly, it is required that the material(s) employed at sealing members be of low coefficient of friction and be capable of providing seal functionality at low load in terms of contact pressure.

A problem to be solved by this invention, in the context of an electrophotographic image-forming device, a toner carrier unit capable of being employed in an image-forming device, an integral processing unit capable of being employed in an image-forming device, an integral processing cartridge capable of being employed in an image-forming device, or a cleaning apparatus or cleaning unit capable of being employed in an image-forming device, is the provision of an electrophotographic image-forming device, a toner carrier unit capable of being employed in an image-forming device, an integral cartridge-type unit capable of being employed in an image-forming device, an integral processing cartridge capable of being employed in an image-forming device, or a cleaning apparatus or cleaning unit capable of being employed in an image-forming device having end seal member(s) comprising sealing member(s) comprising material(s) of low coefficient(s) of friction, which do not cause toner comprising resin component(s) to be affected by heat from friction, in a processing cartridge, unit, high-speed apparatus, apparatus, or the like which is of small size in terms of space as described above, permitting sealing at low load(s), and where when sealing member(s) comprise fiber(s), there is no shedding of fiber(s), and accordingly there is no occurrence of band-like toner voids on developed surfaces, and which comprise sealing member(s) that do not cause occurrence of density nonuniformities or band-like nonuniformities or transverse voids constituting image defects, and which comprise sealing member(s) permitting reduction in torque load, and which permit reduction in size(s) of member(s).

Means for Solving Problem

Of the means in accordance with the present invention for solving the foregoing problems, a means in accordance with some embodiments is a device in the context of an electrophotographic image-forming device employing toner. This device comprises a toner carrier having toner, and a rectangular sealing member having a step comprising a projecting region and a recessed region forming a stripe in the form of a band of linear configuration, this sealing member constituting an end seal member which prevents leakage of toner from an end of a toner carrier. It is an electrophotographic image-forming device having an end seal member characterized in that said sealing member has a toner scraping angle and a contact surface which contacts a surface of a toner carrier and a projecting region and a recessed region, said recessed region being made to bend in a direction of a toner carrier due to bending load from contact pressure between an end seal member and a toner carrier, and has action whereby entry of toner into a sealing member is controlled and action whereby toner is scraped and action whereby toner is transferred, a control angle being formed in a linear direction from a projecting region and a recessed region at a stripe in the form of a band at a surface of a sealing member for return of toner to a toner storage container or a temporary toner storage container and for prevention of leakage of toner to an exterior from a toner carrier due to surface velocity of a toner carrier, an end seal member being provided with a recessed region and an edge of a projecting region for preventing leakage of toner from a toner carrier, said sealing member being employed at an end seal member of a toner carrier in an image-forming device.

A means in accordance with some embodiments is an electrophotographic image-forming device having an end seal member according to some embodiments characterized in that a rectangular sealing member having a step comprising a projecting region and a recessed region forming a stripe in the form of a band of linear configuration is woven fabric having a step comprising a projecting region and a recessed region at a stripe in the form of a band comprising combination of weaving patterns made in satin weave and plain weave or combination of weaving patterns made in satin weave and twill weave, and a control angle in a linear direction at a stripe in the form of a band comprising a projecting region and a recessed region provided at a surface of a sealing member for return of toner to a toner carrier and for preventing leakage of toner to an exterior from a toner carrier due to surface velocity of a toner carrier or rotation of a toner carrier is an angle in a direction causing return of toner to a storage container that temporarily stores or a container that stores toner, and a region on a surface of a sealing member at a step between a projecting region and a recessed region of a stripe is formed from a warp yarn, a recessed region having a structure which allows it to bend easily.

A means in accordance with some embodiments is an electrophotographic image-forming device having an end seal member according to the means of some embodiments characterized in that woven fabric having a step comprising a projecting region and a recessed region at a stripe in the form of a band comprising combination of weaving patterns made in satin weave and plain weave or combination of weaving patterns made in satin weave and twill weave has at a back surface thereof an elastic body providing reactive force upon compression, wherein formed at an angle, i.e., corner, of a step comprising a projecting region and a recessed region and a toner carrier formed by contact between a recessed region and a toner carrier there is a gap which at a desired vibration does not cause leakage of, or between a recessed region and a toner carrier there is a gap which at a desired vibration does not cause leakage of, toner scraped by toner scraping action, due to reactive-force-providing elasticity of a reactive-force-providing elastic body, reduction in width of an electrophotographic image-forming device being achieved as a result of causing said sealing member to be an end seal member which is of small width and which is of small thickness when compressed in a thickness direction.

A means in accordance with some embodiments is an electrophotographic image-forming device having an end seal member according to the means of some embodiments characterized in that a toner carrier is a developer carrier that carries toner and carries out development or is an image carrier that carries a toner image which has been made visible, wherein a sealing member is arranged as an end seal member for preventing leakage of toner from at least one of an image carrier and a developer carrier.

A means in accordance with some embodiments is an electrophotographic image-forming device having an end seal member according to the means of some embodiments characterized in that, being a toner dispersal apparatus or a cleaning apparatus at an electrophotographic image-forming device, an image carrier that carries a toner image at an electrophotographic image-forming device has at least one of a dispersal apparatus that disperses toner and a cleaning apparatus that cleans a surface thereof, and in that there is a develop unit having a developer carrier that carries toner, wherein the foregoing sealing member is arranged as an end seal member for preventing leakage of toner at at least one of these apparatuses.

A means in accordance with some embodiments, in the context of device having a toner carrier at an electrophotographic image-forming device which employs toner, is such that a toner carrier present at this device has a surface (this surface hereinafter being referred to as a "contact surface") that contacts an end seal member arranged at an end of a toner carrier comprising a rectangular sealing member having a step comprising a projecting region and a recessed region at a stripe in the form of a band of linear configuration for preventing leakage of toner from an end of a toner carrier, contact being made with an end seal member at this contact surface. It is a unit having a toner carrier removably installed in an electrophotographic image-forming device main body having an end seal member characterized in that contact pressure produced by contact between this toner carrier and end seal member causes a recessed region at said sealing member to bend and deform in a direction of a toner carrier, and deformation due to bending of a recessed region at said sealing member has action whereby entry of toner into a sealing member is controlled and action whereby toner is scraped and action whereby toner is transferred, wherein provided therein are a recessed region and an edge of a projecting region, and a control angle in a linear direction from a projecting region and a recessed region at a stripe in the form of a band at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device.

A means in accordance with some embodiments is a unit having a toner carrier removably installed in an electrophotographic image-forming device main body having an end seal member according to the means of some embodiments characterized in that an end seal member arranged at an end of a toner carrier comprising a rectangular sealing member is a sealing member comprising woven fabric comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member having a step between a projecting region and a recessed region in this banded pattern being used to form an end seal member having a projecting region and a recessed region in a linear configuration at a surface, and having action whereby entry of toner into a sealing member is controlled by reduction of a gap produced when a recessed region is bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and bending and deformation of a recessed region toward a toner carrier due to contact load between a sealing member and a toner carrier or a gap due to a step comprising a projecting region and a recessed region and surface velocity at a toner carrier, prevention of leakage of toner and cleaning of a surface at an end of a toner carrier being provided by an angle of orientation of a projecting region and a recessed region of linear configuration at a sealing member surface, a projecting region at an edge comprising warp yarn in a woven fabric, and a recessed region having an easily deformable structure.

A means in accordance with some embodiments is a unit having a toner carrier removably installed in an electrophotographic image-forming device main body having an end seal member according to the means of some embodiments characterized in that action whereby entry of toner into a sealing member is controlled, action whereby toner is scraped at a recessed region, and action whereby toner is transferred as a result of a toner transfer gap and rubbing contact with a toner carrier and bending and deformation of a recessed region toward a toner carrier due to contact load between a sealing member and a toner carrier or a gap due to a step comprising a projecting region and a recessed region and surface velocity at a toner carrier, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, action whereby toner is scraped, and action whereby toner is transferred making it possible to reduce width of an end seal member and reduce thickness of an end seal member when compressed, and to reduce width of a unit having a toner carrier.

A means in accordance with some embodiments is a device in the context of an electrophotographic image-forming device which employs toner, this device being a develop unit constituting a developer carrier that uses toner to carry out development at a toner carrier removably installed in an electrophotographic image-forming device main body or a photosensitive body unit constituting an image carrier that carries a toner image removably installed in an electrophotographic image-forming device main body having an end seal member characterized in that there is a unit which is constituted in integral fashion such that a toner carrier constituting a developer carrier which carries toner and which carries out development or an image carrier carrying a toner image which has been made visible is removably installed in a device main body, wherein a toner carrier constituting this unit has a contact surface that contacts an end seal member arranged at an end of a toner carrier comprising a rectangular sealing member having a step comprising a projecting region and a recessed region at a stripe in the form of a band of linear configuration for preventing leakage of toner from an end of a toner carrier, contact being made with an end seal member at this contact surface, contact pressure produced by contact between this toner carrier and end seal member causing a recessed region at said sealing member to bend and deform in a direction of a toner carrier, and deformation due to bending of a recessed region at said sealing member having action whereby entry of toner into a sealing member is controlled and action whereby toner is scraped and action whereby toner is transferred, wherein provided therein are a recessed region and an edge of a projecting region, and a control angle in a linear direction from a projecting region and a recessed region at a stripe in the form of a band at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device.

A means in accordance with some embodiments is a develop unit constituting a developer carrier that uses toner to carry out development at a toner carrier removably installed in an electrophotographic image-forming device main body or a photosensitive body unit constituting an image carrier that carries a toner image removably installed in an electrophotographic image-forming device main body having an end seal member according to the means of some embodiments characterized in that a unit which is constituted in integral fashion such that a toner carrier constituting a developer carrier which carries toner and which carries out development or an image carrier carrying a toner image which has been made visible is removably installed in a device main body has at least one of a dispersal means that disperses toner and a cleaning means that cleans a surface of an image carrier carrying a toner image, or has a developer carrier having a toner carrier, wherein a sealing member is employed as an end seal member for preventing leakage of toner at at least these apparatuses.

A means in accordance with some embodiments, in the context of a processing unit which is constituted in integral fashion such that a develop unit and a unit having an image carrier removably installed and employed in an electrophotographic image-forming device, is a processing unit which is constituted in integral fashion so as to be removably installed in an electrophotographic image-forming device main body having an end seal member characterized in that a toner carrier having toner is constituted so as to contact an end seal member that prevents leakage of toner from an end of a toner carrier, an end seal member is present at an end of a toner carrier, an end seal member comprises a rectangular sealing member having a step comprising a projecting region and a recessed region at a stripe in the form of a band of linear configuration, a contact surface being present at which contact is made between a surface at a toner carrier and an end seal member, constitution being such that contact pressure between an end seal member and a toner carrier causes the foregoing recessed region to bend and deform toward a toner carrier, and having action whereby entry of toner into a sealing member making up an end seal member is controlled and action whereby toner is scraped and action whereby toner is transferred, wherein an end seal member for preventing leakage of toner from a toner carrier is constituted so as to be provided with a recessed region and an edge of a projecting region, and an angle of orientation of a projecting region and a recessed region in linear configuration at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device.

A means in accordance with some embodiments is a processing unit which is constituted in integral fashion so as to be removably installed in an electrophotographic image-forming device main body having an end seal member according to the means of some embodiments characterized in that an end seal member present at an end of a toner carrier comprises a sealing member comprising woven fabric having a step comprising a projecting region and a recessed region at a stripe in the form of a band comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member comprising woven fabric having a step comprising a projecting region and a recessed region at a stripe in the form of a band being used to form an end seal member having a projecting region and a recessed region in a linear configuration at a surface, and having action whereby entry of toner into a sealing member is controlled by reduction of a gap due to the fact that a recessed region is bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and deformation of a recessed region toward a toner carrier due to contact load between a sealing member and a toner carrier or a gap due to a step comprising a projecting region and a recessed region and surface velocity at a toner carrier, prevention of leakage of toner and cleaning of a toner carrier being provided by an angle of orientation of a projecting region and a recessed region of linear configuration at a sealing member surface, a projecting region at an edge comprising warp yarn in a woven fabric, and a recessed region having an easily deformable structure.

A means in accordance with some embodiments is a processing unit which is constituted in integral fashion so as to be removably installed in an electrophotographic image-forming device main body having an end seal member according to the means of some embodiments characterized in that action whereby entry of toner into a sealing member is controlled, action whereby toner is scraped at a recessed region, and action whereby toner is transferred, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, scraping action, and transfer action making it possible to reduce width of an end seal member, reduce thickness of an end seal member when compressed, and constitute a cartridge-type unit in integral fashion which is of reduced width.

A means in accordance with some embodiments is a processing unit which is constituted in integral fashion so as to be removably installed in an electrophotographic image-forming device main body having an end seal member according to the means of some embodiments characterized in that a toner carrier is a developer carrier that carries toner and carries out development or is an image carrier that carries a toner image which has been made visible, a unit having a toner carrier having been made integral therewith so as to be present in the form of a develop unit which is constituted in integral fashion so as to be removably installed in an image-forming device main body, wherein a sealing member is employed as an end seal member for preventing leakage of toner from a toner carrier at least at one of the foregoing image carrier that carries a toner image and developer carrier.

A means in accordance with some embodiments is a processing unit which is constituted in integral fashion so as to be removably installed in an electrophotographic image-forming device main body having an end seal member according to the means of some embodiments characterized in that a processing unit which is constituted in integral fashion such that a toner carrier is removably installed in an image-forming device main body has at least one of a dispersal means that disperses toner and a cleaning means that cleans a surface of an image carrier that carries a toner image, and has a develop means having a developer carrier constituting a toner carrier, wherein a sealing member is employed as an end seal member for preventing leakage of toner at at least one of the means.

A means in accordance with some embodiments, in the context of a processing cartridge which is constituted in integral fashion so as to have develop means having a developer carrier and at least one of dispersal means, cleaning means, an image carrier, and a charging apparatus, and which is a processing cartridge that is removably installed and employed in an electrophotographic image-forming device, is an integral processing cartridge removably installed in an electrophotographic image-forming device main body having an end seal member characterized in that a toner carrier which is present at this processing cartridge is constituted so as to come in contact with an end seal member that prevents leakage of toner from an end of a toner carrier, an end seal member is present at an end of a toner carrier, an end seal member comprises a rectangular sealing member having a step comprising a projecting region and a recessed region at a stripe in the form of a band of linear configuration, a contact surface being present at which contact is made between a surface at a toner carrier and said end seal member, constitution being such that contact pressure between an end seal member and a toner carrier causes said recessed region to bend and deform toward a toner carrier, and having action whereby entry of toner into a sealing member making up an end seal member is controlled and action whereby toner is scraped and action whereby toner is transferred, wherein an end seal member for preventing leakage of toner from a toner carrier is constituted so as to be provided with a recessed region and an edge of a projecting region, and an angle of orientation of a projecting region and a recessed region in linear configuration at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device.

A means in accordance with some embodiments is an integral processing cartridge removably installed in an electrophotographic image-forming device main body having an end seal member according to the means of some embodiments characterized in that an end seal member present at an end of a toner carrier comprises a sealing member comprising woven fabric having a step comprising a projecting region and a recessed region at a stripe in the form of a band comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member comprising woven fabric having a step comprising a projecting region and a recessed region at a stripe in the form of this band being used to form an end seal member having a projecting region and a recessed region in a linear configuration at a surface, and having action whereby entry of toner into a sealing member is controlled by reduction of a gap due to the fact that a recessed region is bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and deformation of a recessed region toward a toner carrier due to contact load between a sealing member and a toner carrier or a gap due to a step comprising a projecting region and a recessed region and surface velocity at a toner carrier, prevention of leakage of toner and cleaning of a toner carrier being provided by an angle of orientation of a projecting region and a recessed region of linear configuration at a sealing member surface, a projecting region at an edge comprising warp yarn in a woven fabric, and a recessed region having an easily deformable structure.

A means in accordance with some embodiments is an integral processing cartridge removably installed in an electrophotographic image-forming device main body having an end seal member according to the means of some embodiments characterized in that action whereby entry of toner into a sealing member is controlled, action whereby toner is scraped at a recessed region, and action whereby toner is transferred, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, scraping action, and transfer action making it possible to reduce width of an end seal member, reduce thickness of an end seal member when compressed, and constitute a cartridge-type unit in integral fashion which is of reduced width.

A means in accordance with some embodiments is an integral processing cartridge removably installed in an electrophotographic image-forming device main body having an end seal member according to the means of some embodiments characterized in that a toner carrier is present in the form of a processing cartridge which is constituted in integral fashion such that a toner carrier comprising a developer carrier that carries toner and carries out development or an image carrier that carries a toner image which has been made visible is removably installed in a device main body, wherein a sealing member is employed as an end seal member for preventing leakage of toner from a toner carrier having toner at at least one of a developer carrier and an image carrier that carries a toner image.

A means in accordance with some embodiments, in the context of a unit having at least one of a dispersal apparatus and a cleaning apparatus removably installed in an electrophotographic image-forming device, is a unit having a dispersal apparatus or a cleaning apparatus removably installed in an electrophotographic image-forming device main body having an end seal member characterized in that an end seal member that prevents leakage of toner from an end of a dispersal apparatus or a cleaning apparatus and a toner carrier is present which contacts a toner carrier at an end of a toner carrier, this end seal member comprises a rectangular sealing member having a step comprising a projecting region and a recessed region at a stripe in the form of a band of linear configuration, a contact surface being present at which contact is made at a surface between a toner carrier and this end seal member, constitution being such that contact pressure between an end seal member and a toner carrier causes said recessed region to bend and deform toward a toner carrier, and having action whereby entry of toner into a sealing member making up an end seal member is controlled and action whereby toner is scraped and action whereby toner is transferred, wherein an end seal member for preventing leakage of toner from a toner carrier is constituted so as to be provided with a recessed region and an edge of a projecting region, and an angle of orientation of a projecting region and a recessed region in linear configuration at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device.

A means in accordance with some embodiments is a unit having a dispersal apparatus or a cleaning apparatus removably installed in an electrophotographic image-forming device main body having an end seal member according to the means of some embodiments characterized in that an end seal member present at an end of a toner carrier comprises a sealing member constituting woven fabric comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member having a step between a projecting region and a recessed region in this banded pattern being used to form an end seal member having a projecting region and a recessed region in a linear configuration at a surface, and having action whereby entry of toner into a sealing member is controlled by reduction of a gap caused by a recessed region being bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and deformation of a recessed region toward a toner carrier due to contact load between a sealing member and a toner carrier or a gap due to a step comprising a projecting region and a recessed region and surface velocity at a toner carrier, prevention of leakage of toner and cleaning of a toner carrier being provided by an angle of orientation of a projecting region and a recessed region of linear configuration at a sealing member surface, a projecting region at an edge comprising warp yarn in a woven fabric, and a recessed region having an easily deformable structure.

A means in accordance with some embodiments is a unit having a dispersal apparatus or a cleaning apparatus removably installed in an electrophotographic image-forming device main body having an end seal member according to the means of some embodiments characterized in that action whereby entry of toner into a sealing member is controlled, action whereby toner is scraped at a recessed region, and action whereby toner is transferred as a result of a toner transfer gap and rubbing contact with a toner carrier and deformation of a recessed region toward a toner carrier, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, scraping action, and transfer action making it possible to reduce width of an end seal member, reduce thickness of an end seal member when compressed, and constitute a unit having a dispersal apparatus or a cleaning apparatus so as to be of reduced width.

A means in accordance with some embodiments is a unit having a dispersal apparatus or a cleaning apparatus removably installed in an electrophotographic image-forming device main body having an end seal member according to the means of some embodiments characterized in that a toner carrier is a transfer belt or a transfer body onto which a toner image is transferred or an image carrier that carries a toner image which has been made visible, wherein a sealing member is employed as an end seal member for preventing leakage of toner from a toner carrier at at least one of a transfer belt or a transfer body onto which a toner image is transferred and an image carrier that carries a toner image.

Benefit of Invention

In unit(s) comprising cleaning apparatus(es) or cleaning apparatus(es) capable of being removed from or removably installed in main body or bodies, integral processing cartridge(s) having toner carrier(s), integral processing unit(s) having toner carrier(s), unit(s) having toner carrier(s) removably installed in image-forming device main body or bodies, and/or electrophotographic image-forming device(s) having toner carriers) in accordance with the present invention, because step(s) at projecting region(s) and recessed region(s) of more or less linear configuration are provided at sealing member(s), sealing member(s) are present which make it possible to easily form space(s) permitting movement of toner due to the foregoing step(s) at projecting region(s) and recessed region(s) of more or less linear configuration, and scraping of toner from toner carrier(s) which carry toner, and combination therewith of reactive-force-providing elastic body or bodies at back surface(s) of such sealing member(s) makes it possible, when such sealing member(s) are installed as end seal member(s) at installation seat(s) of sealing member(s), for compression by toner carrier(s) acting in combination therewith to cause the foregoing recessed region(s) to bend and be deformed, such that space(s) are formed which can withstand vibration due to transfer or the like and/or vibration of the device itself such that leakage does not occur, and makes it possible for force(s) in direction(s) of movement of toner carrier(s) and scraping action by sealing member(s) to cause toner adhering to surface(s) of toner carrier(s) to be returned to interior(s) of toner container(s), improving cleaning performance at sealing member location(s) corresponding to toner carrier surface(s) and prevention of leakage of toner to exterior(s) from toner container(s).

Moreover, in electrophotographic image-forming device(s) in accordance with the present invention, because contact is made with sealing member(s) comprising stripe(s) having step(s) comprising projecting region(s) and recessed region(s), if the fractional percentage of recessed region(s) versus projecting region(s) therein is 50% each, contact area will be less than would be the case with a conventional sealing member, which is good from the standpoint of torque load. Moreover, as it is possible to use any desired fiber diameter(s) at yarn(s) used in the woven fabric forming stripe(s) having step(s) comprising projecting region(s) and recessed region(s), if diameter(s) of fiber(s) forming yarn(s) are increased at stripe(s) used in a device where longevity is required, since yarn strength is proportional to the square of yarn fiber radius, this will make long life possible. Moreover, whereas conventionally the width of the sealing member in the direction of the rotational axis of the toner carrier to which the sealing member is attached was narrowest in the width direction for situations in which a magnetic sealing member was employed, because the sealing member of the present invention has toner entry control action, i.e., action whereby entry of toner is prevented, and action whereby toner is made to return at a high speed of movement, this makes it possible to reduce the width of the sealing member in the rotational axis direction, making it possible to respectively reduce widths in rotational axis directions of unit(s) and processing unit(s) having toner carrier(s), and device main body or bodies in which such unit(s) or processing unit(s) are removably installed, and image-forming device(s) carrying toner carrier(s). In other words, a decrease in the width of the sealing member permits decrease not only in the width of the sealing member but also in the width of the overall device. As a result, the device is made more economical, and it becomes possible to achieve reductions in size and decreases in cost. Moreover, thickness for a sheet-like sealing member is less than or equal to 0.5 mm, use in combination with a reactive-force-providing elastic body at the rear surface of the sealing member making it possible to reduce still further the space between the toner carrier and the sealing member installation seat, making further reduction in size possible.

Piled woven fabrics have been the mainstay for conventional woven fabric sealing members, but as these have required pile density and length, the amount of yarn required to be used has been large; furthermore, because spreading of fibers has been carried out, spreading which extends from the base to the pile tip has been present, increasing the width required for sealing. As a result, this has caused increase in the width required at the toner carrier. In contradistinction hereto, the sealing member employed in the present invention has as basic constitution a structure in which step(s) are provided at woven fabric, the constitution being that of banded stripe(s). Accordingly, by setting the angle constituting orientation of stripe(s) having step(s) comprising such projecting region(s) and recessed region(s) as desired, it is possible to obtain a speed of movement that will cause return of toner to the interior of the toner container; and by causing recessed region(s) to become deformed as a result of bending, it is also possible to carry out control such that entry of toner into the space between fibers is controlled. Particularly at end(s) of sealing member(s), as it is possible to increase length(s) of recessed region(s) with respect to direction(s) of movement of toner carrier(s) by means of angle(s) of projecting region(s) and recessed region(s), this makes it possible to prevent entry thereinto by toner, and makes it possible to decrease seal width. Accordingly, because width(s) of unit(s), processing cartridge(s), and/or main body or bodies can be decreased, it is possible to make the unit(s), processing cartridge(s), and/or main body or bodies more economical. Moreover, if thickness for a sheet-like sealing member is made to be less than or equal to 0.5 mm, use in combination with a reactive-force-providing elastic body at the rear surface thereof will make it possible to reduce the space between the toner carrier and the sealing member installation seat, making it possible to achieve still greater compactness and improved economy.

Furthermore, in accordance with the present invention, use of sealing member(s) formed from stripe(s) having step(s) comprising projecting region(s) and recessed region(s) makes it possible to eliminate problems due to image defects and image deterioration. That is, because the constitution is such that there is an effect in which there is scraping by sealing member(s) at location(s) at end seal(s) of toner carrier(s), and scraped toner is made to move through prescribed space(s), and there is a cleaning effect, adherence of toner at unwanted location(s) on toner carrier(s) is suppressed, permitting suppression of image defects. Moreover, because fractional percentage of recessed region(s) versus projecting region(s) at stripe(s) of sealing member(s) which come in contact with toner carrier(s) is 50% for each, contact area at region(s) where such contact occurs is less than would be the case with a conventional sealing member, such constitution permitting reduction in torque load. Moreover, because it is possible to use any desired fiber diameter(s) at yarn(s) used in the woven fabric forming sealing member(s), when employed in a device where longevity is required, since yarn strength is proportional to the square of the radius, increasing diameter(s) of fiber(s) forming yarn(s) will make long life possible. By thus employing sealing member(s) made up of material(s) having excellent characteristics, an image-forming device in accordance with the present invention is made to be of high quality and high reliability; furthermore, a removably installed unit or processing unit at an image-forming device will likewise be of high quality and high reliability. Note that as it is of course possible to freely vary the fractional percentage of recessed region(s) versus projecting region(s), all such variations are included within the scope of the present invention.

Thus, use of a sealing member associated with the present invention makes it possible to easily achieve improved economy at electrophotographic image-forming device(s), and at processing cartridge(s) and unit(s) removably installed in such image-forming device(s) and so forth, as a result of which it is possible to easily achieve reductions in cost.

EMBODIMENTS FOR CARRYING OUT INVENTION

Embodiments for carrying out the present invention are described below with reference to the tables and the drawings.

Figure 1:
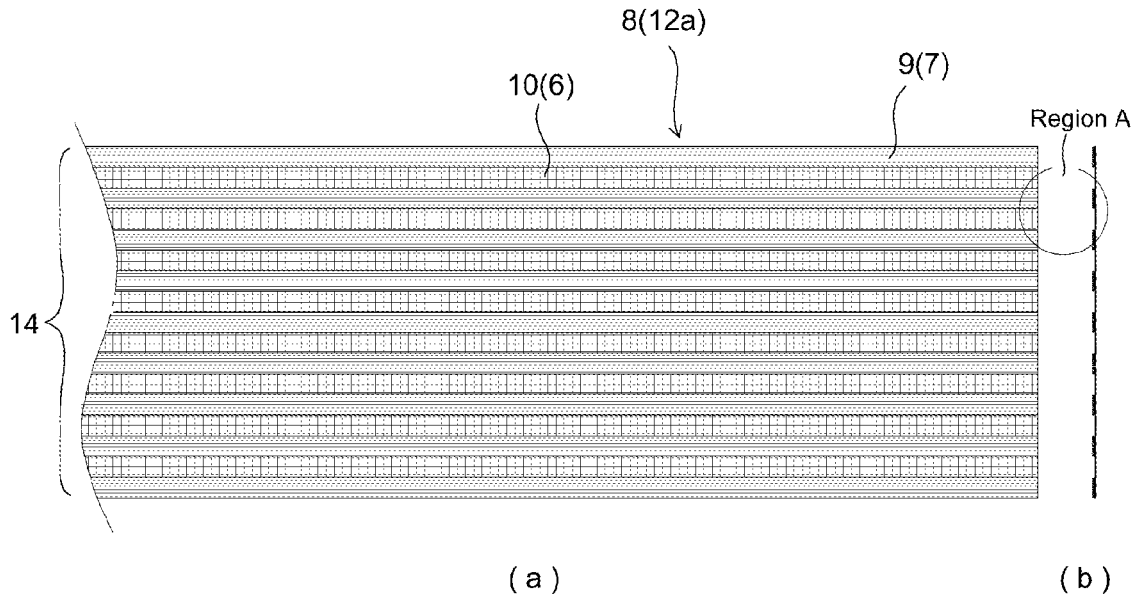
FIG. 1 Sheet stock material for sealing member comprising satin weave and plain weave (or twill weave), in which (a) is a plan view, and (b) is a side view.
Figure 2:
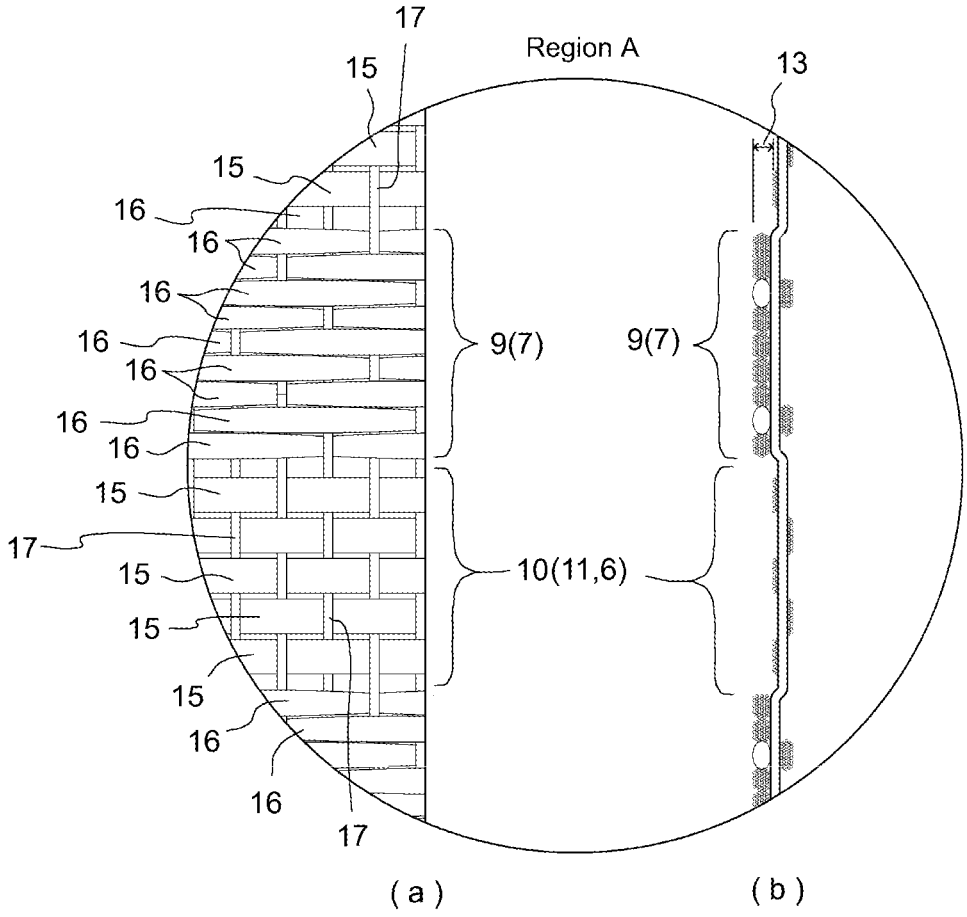
FIG. 2 Drawing showing region A of FIG. 1, being a drawing showing constitution of the woven pattern, in which (a) is a plan view, and (b) is a drawing showing structure at the end as viewed from the right side of the drawing at (a).

Sheet stock material for sealing member 8 having recessed region 6 and projecting region 7 used in end seal member 5 of toner carrier 2 of image-forming device 1, or of toner carrier 2 of removably installed imaging unit 3 or processing unit 4 incorporated as mechanism(s) in image-forming device 1, is shown at region A in the plan view at (a) and the side view at (b) of FIG. 1, and is shown in the enlarged view of region A at FIG. 1 comprising the plan view at (a) and the side view at (b) of FIG. 2. As shown in FIG. 1 and FIG. 2, sealing member 8 used in image-forming device 1 is a sealing member 8 comprising woven fabric 12*a* woven in satin weave 9 and plain weave 10 or is a sealing member 8 comprising woven fabric 12*a* woven in satin weave 9 and twill weave 11, these being two weaving methods. Recessed region 6 are formed in portions corresponding to this plain weave 10 or twill weave 11, and projecting regions 7 are formed in portions corresponding to satin weave 9, to constitute stripes comprising bands 14 having steps 13 shown in FIG. 2. Means for forming these steps 13 include a means for forming steps 13 through use of two types of weaving in which satin weave 9 is formed with control of flattening of multifilament yarn at warp yarn 16 constituting soft-twist warp yarn, and plain weave 10 (or twill weave 11) is formed without control of flattening of multifilament yarn at warp yarn 15 constituting soft-twist warp yarn b, i.e., in which a difference in flattening is formed by providing a difference in the degree to which the respective multifilament yarns at warp yarn 15 and warp yarn 16 are made to spread out over weft yarn 17; and a means for forming steps 13 whereby a difference in flatness comprises use of yarns of different diameter at the warp yarn 16 used for satin weave 9 and at the warp yarn 15 used for plain weave 10. Such means permit woven fabric 12*a* to be formed with bands 14, i.e., stripes, comprising recessed regions 6 and projecting regions 7 of more or less linear configuration having steps 13, such woven fabric 12*a* being used to make sealing member 8.

Figure 3:
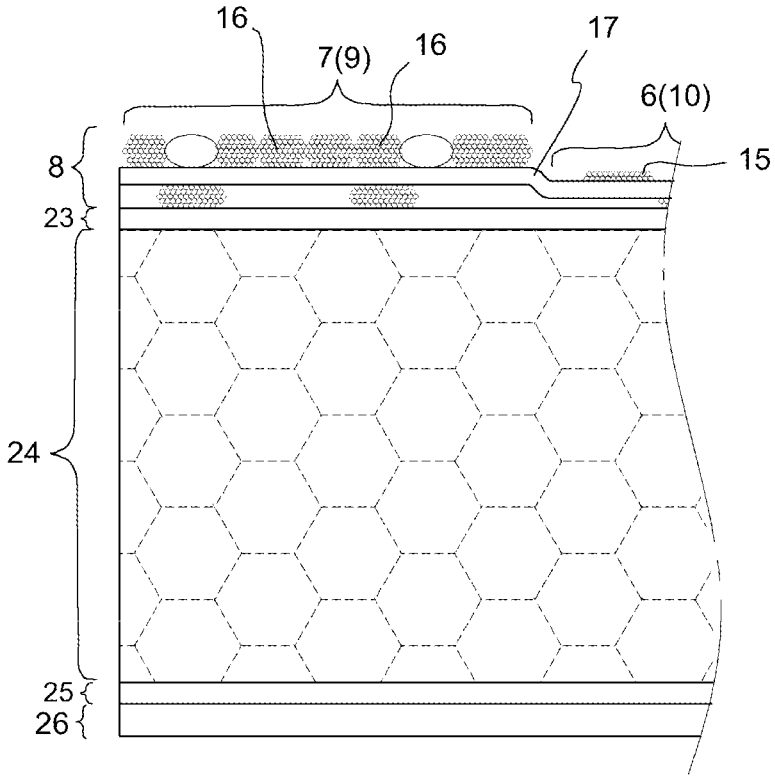
FIG. 3 Drawing showing exemplary constitution of an end seal member.
Figure 4:
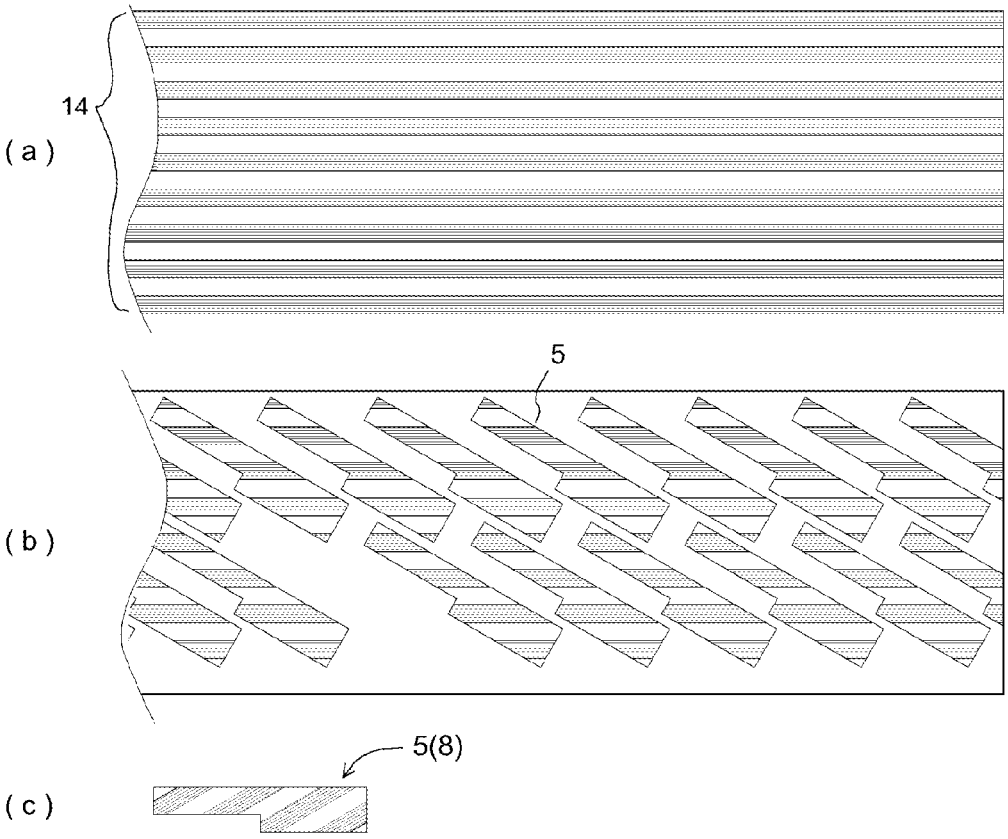
FIG. 4 Drawing showing sealing member sheet stock material and a seal fabricated from this raw material.

Moreover, reactive-force-providing elastic body 24 is affixed as shown in FIG. 3 with adhesive 23 or two-sided adhesive tape 25 to and is made integral with the back surface of sealing member 8 comprising this woven fabric 12*a*, this is kiss-cut or punched so as to cause orientation of the stripes constituting bands 14 shown at (a) in FIG. 4 to be at an angle that will cause toner 18 to be returned to the toner container constituting toner carrier 2, and is formed into end seal member 5 of desired shape as shown at (b) in FIG. 4, and this end seal member 5 is used as end seal member 5 of toner carrier 2 which is used in image-forming device 1. With respect to flattening of warp yarn, the yarn at warp yarn 16 which is multifilament is made to be soft-twist, monofilament is used at weft yarn 17, and warp yarn 15 is provided in such fashion as to cause the pitch to be such that warp yarns 15 at portions in plain weave 10 do not mutually approach, being formed such that warp yarn 15 at portions in plain weave 10 shown in FIG. 3, being soft-twist yarn, is made to spread out over the monofilament of weft yarn 17. On the other hand, warp yarn 16 at portions in satin weave 9 is woven in such fashion as to cause warp yarns 16 to be mutually contiguous, spreading of the yarn being impeded such that there is little flattening; and accordingly, weaving is such as to cause formation of steps 13 between plain weave 10 and satin weave 9, and the fact that it is made to be soft-twist causes the filaments, i.e., fibers, of warp yarn 16 which is multifilament to be of more linear configuration.

Figure 10:
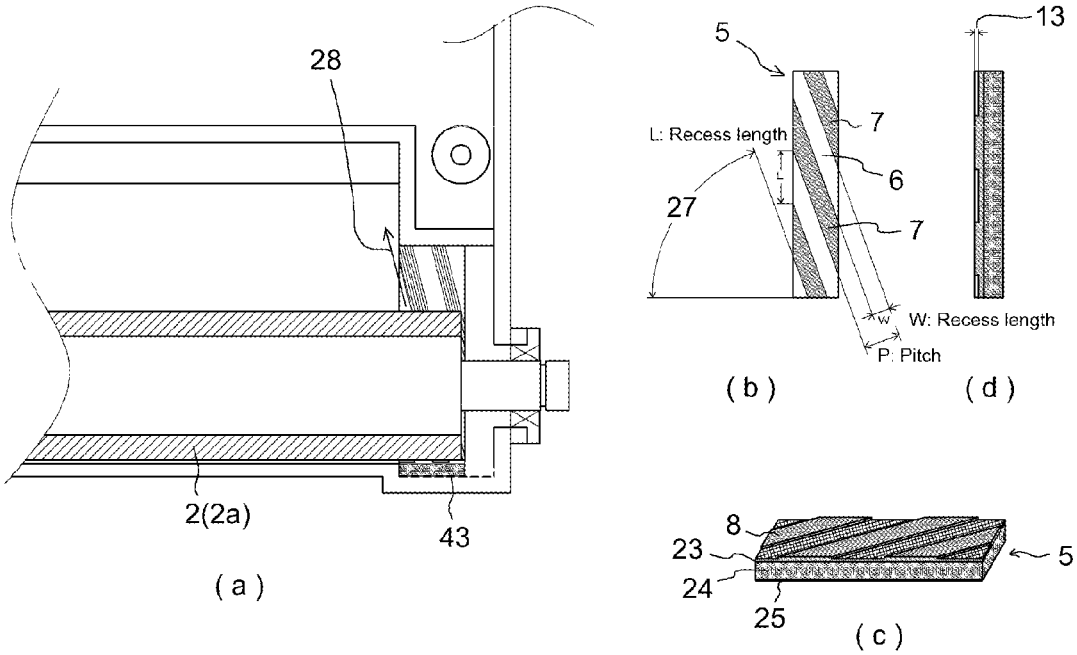
FIG. 10 Side view, as viewed from the left side of the drawing in FIG. 8, of a develop roller, i.e., toner carrier, and a sealing member provided at an end thereof.
Figure 17:
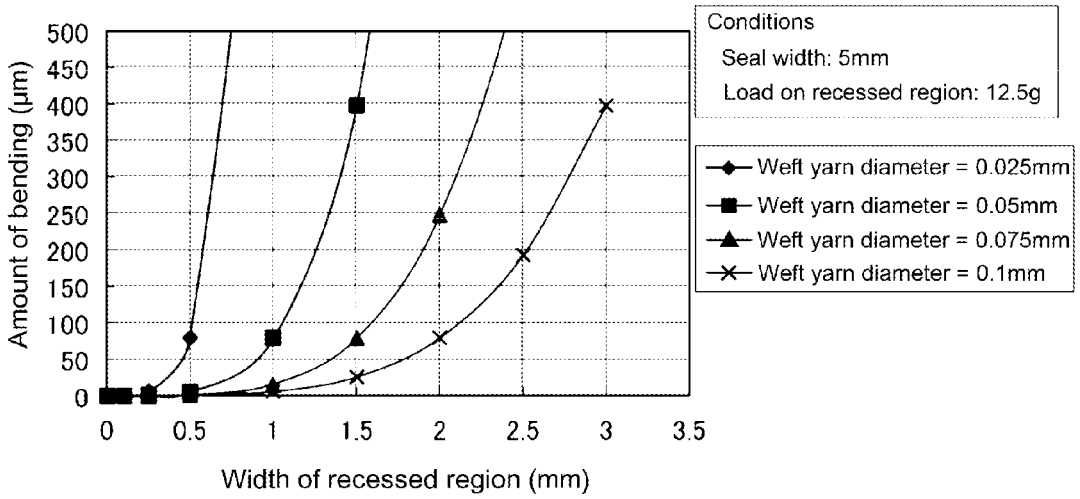
FIG. 17 Graph showing theoretical calculations of relationship between width of recessed region at sealing member and amount of bending thereat.

Moreover, because sealing member 8 comprising woven fabric 12*a* is such that mutually adjacent weft yarns 17 are woven with prescribed gap 32 therebetween so as to prevent them from mutually approaching, portions made in twill weave 11 or plain weave 10 which constitute recessed regions 6 as shown in FIG. 2 tend to bend easily under low load. The graph at FIG. 17 shows calculated relationship between width of the recessed region and the amount of bending, it being desired based on these results that width of the recessed region 6 be set so to be greater than or equal to 0.25 mm. Furthermore, exploring the ramifications of these values at woven fabric 12*a*, because an ordinary woven fabric 12*a* is woven in such fashion that yarns mutually approach, recesses and projections will be present at front and back at locations where warp yarns and weft yarns intersect. These recesses and projections are different from the recessed regions 6 and projecting regions 7 present at sealing member 8 used in image-forming device 1 of the present invention. Accordingly, descriptions of the effects of recess width which are produced by mutual approach of yarns will not be found in connection with ordinary woven fabrics 12*a*. Moreover, end seal member 5 comprising recessed region 6 and projecting region 7 which is used in image-forming device 1 of the present invention is such that reactive-force-providing elastic body 24 comprising a foamed body or the like is affixed with adhesive 23 or two-sided adhesive tape 25, and to the back surface of this reactive-force-providing elastic body 24 comprising a foamed body or the like, mold release paper is in addition furthermore provided by affixing it to two-sided adhesive tape 25 present at the back surface, and this is thereafter cut or kiss-cut, the constitution being such that the angle of orientation of the recesses and projections is directed so as to cause toner 18 to be returned to the interior of the toner container constituting toner carrier 2. As shown in FIG. 10, when end seal member 5 which is constituted in such fashion is installed at installation seat 43, control angle 27 for the orientation of the recesses and projections is set so as to be in a toner flow direction 28 causing toner 18 to be returned to the toner container constituting toner carrier 2. Accordingly, recessed region 6 at the end in the axial direction of end seal member 5 is such that, support by projecting region 7 being single-point support, recessed region 6 at the end in the axial direction of end seal member 5 will tend to bend more easily than would be the case in the central region in the axial direction thereof, permitting prevention of entry of toner 18 into the space between where the step 13 comprising recessed region 6 and projecting region 7 contacts develop roller 2*a*. Furthermore, with respect to recessed region 6, while it is possible where end seal member 5 has been made to comprise a resin sheet to cause this to bend more easily by reducing sheet thickness at recessed region 6, where end seal member 5 is made to comprise woven fabric 12*a* it may be constituted so as to bend more easily by means of the diameter of weft yarn 17 and the pitch comprised by recessed region 6 and projecting region 7. In FIG. 10, L and W represent a recess length of recessed region 6, and P represents a pitch of recessed region 6 and projecting region 7.

Also, as means for causing toner carrier 2 and sealing member 8 to come in contact, while reactive-force-providing elastic body 24 provided at the back surface of sealing member 8 is shown at (c) in FIG. 10, sealing member 8 may be stretched and this tensile force together with the elasticity of reactive-force-providing elastic body 24 provided at the back surface of sealing member 8 may also be employed as means for causing toner carrier 2 and sealing member 8 to come in contact. Step 13 between recessed region 6 and projecting region 7 is shown at (d) in FIG. 10.

Figure 37:
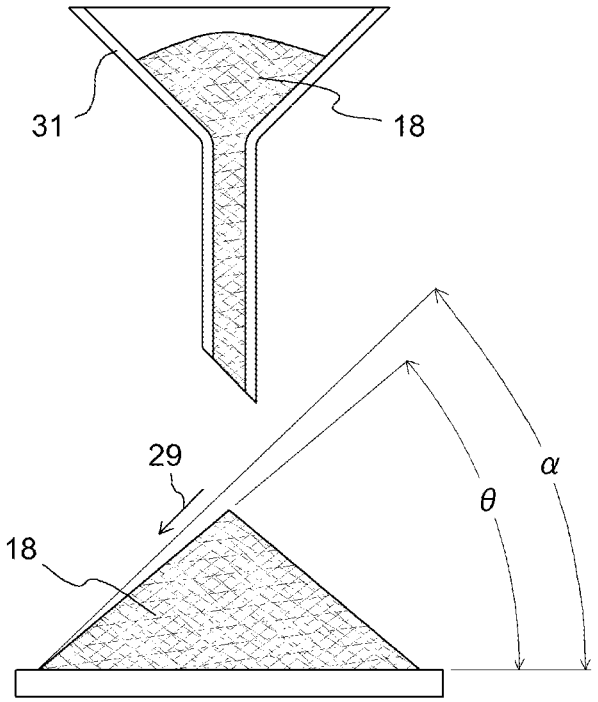
FIG. 37 Drawing showing method for measuring angle of repose.

Action by which toner 18 is scraped, this being an effect of sealing member 8 which has recessed regions 6 and projecting regions 7 at end seal member 5 of toner carrier 2, will next be described. Basic action by which toner 18 is scraped in accordance with the present invention is determined by toner scraping angle $\alpha$ and toner angle $\theta$ of repose which is a measure of the flow characteristics of toner 18. FIG. 37 is a drawing showing toner 18 deposited on a horizontal board after that toner 18 has been made to fall from a funnel 31, and as shown in FIG. 37, the action by which toner 18 is scraped is produced by causing toner scraping angle $\alpha$ at end seal member 5 to be greater than toner angle $\theta$ of repose which is the angle stably formed by the deposited toner 18 on the horizontal board. This toner scraping angle $\alpha$ may be the angle formed by toner carrier 2 and radiused region 7*a* at projecting region 7 of yarn (fiber) 12*b* of woven fabric 12*a* which contacts this toner carrier 2 as shown at (a) in FIG. 5, or the angle formed by radiused region 7*a* at projecting region 7 comprising molded part 12*c* as shown at (b) in FIG. 5, or the angle of the arc between a line drawn perpendicular to chamfered region 7*b* comprising molded part 12*c* and a line drawn perpendicular to toner carrier 2 as shown at (c) in FIG. 5, scraping action being determined by the particle diameter of toner 18 which is in contact with the edge of projecting region 7 and toner carrier 2 and these toner scraping angles $\alpha$. By thus causing toner scraping angle $\alpha$ to be greater than toner angle $\theta$ of repose a constitution is obtained by which toner 18 is scraped, but because of the force which causes toner 18 to adhere electrostatically to toner carrier 2, it is desirable that this toner scraping angle $\alpha$ be made greater than the toner angle $\theta$ of repose. On the other hand, were toner scraping angle $\alpha$ to be made smaller than toner angle $\theta$ of repose, this would cause toner 18 to more easily enter the space between toner carrier 2 and sealing member 8 in wedge-like fashion and to slide therethrough, as a result of which there would be occurrence of leakage of toner 18 and contamination due to toner 18.

Figure 5:
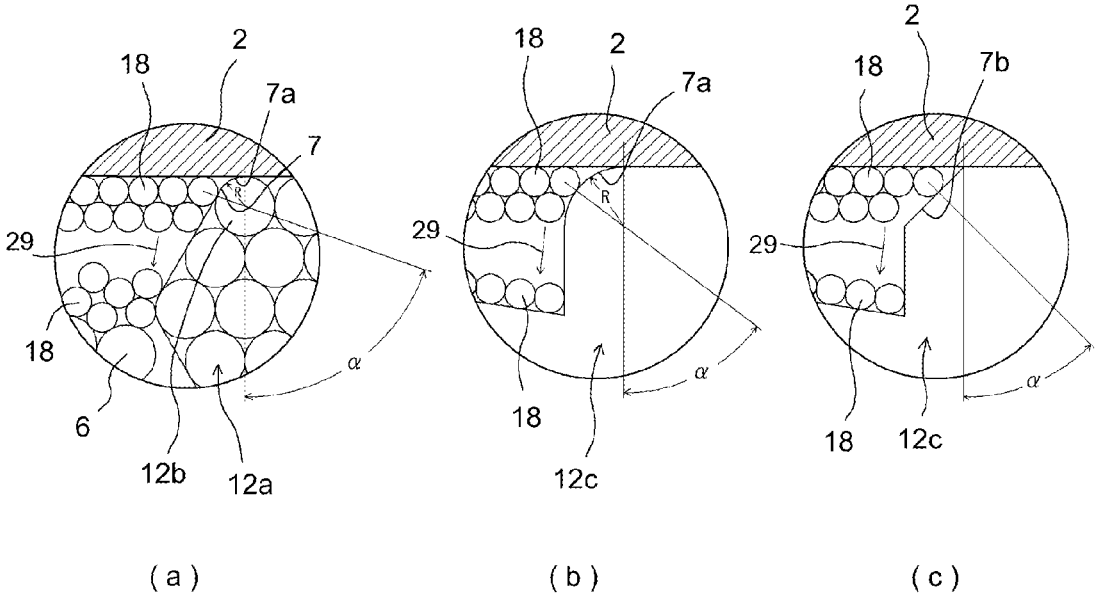
FIG. 5 Drawing for explaining toner scraping, in which (a) shows the situation during use of a sealing member having fibers of woven fabric, (b) shows the situation during use of a sealing member having a radiused region at a molded resin part or laminated film, and (c) shows the situation during use of a sealing member having a chamfered region at a molded resin part or laminated film.
Figure 6:
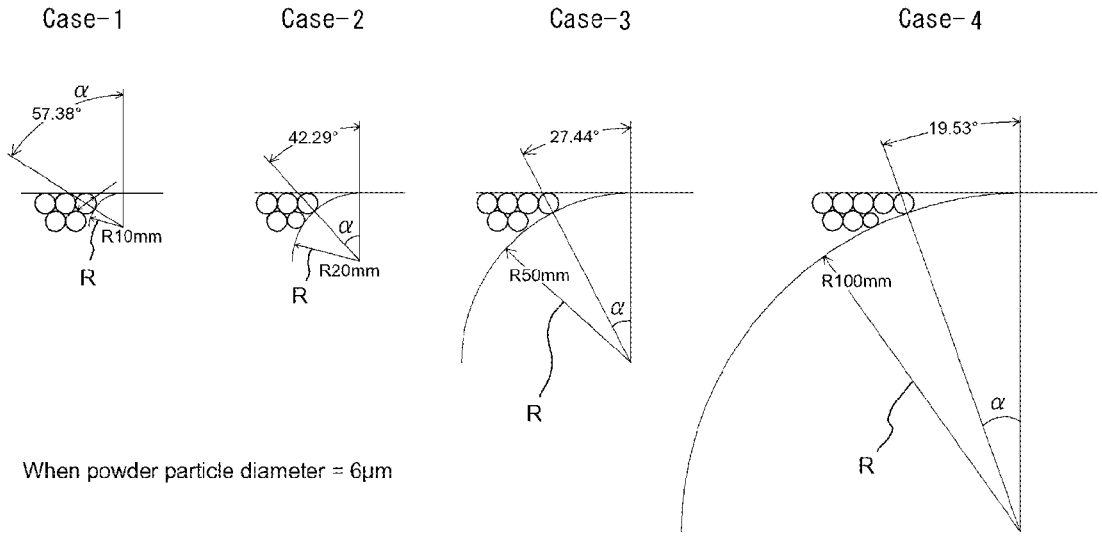
FIG. 6 Conceptual diagram modeling the situation believed to exist when R of a projecting region is varied during use of toner particles of toner particle diameter 6 μm.
Figure 7:
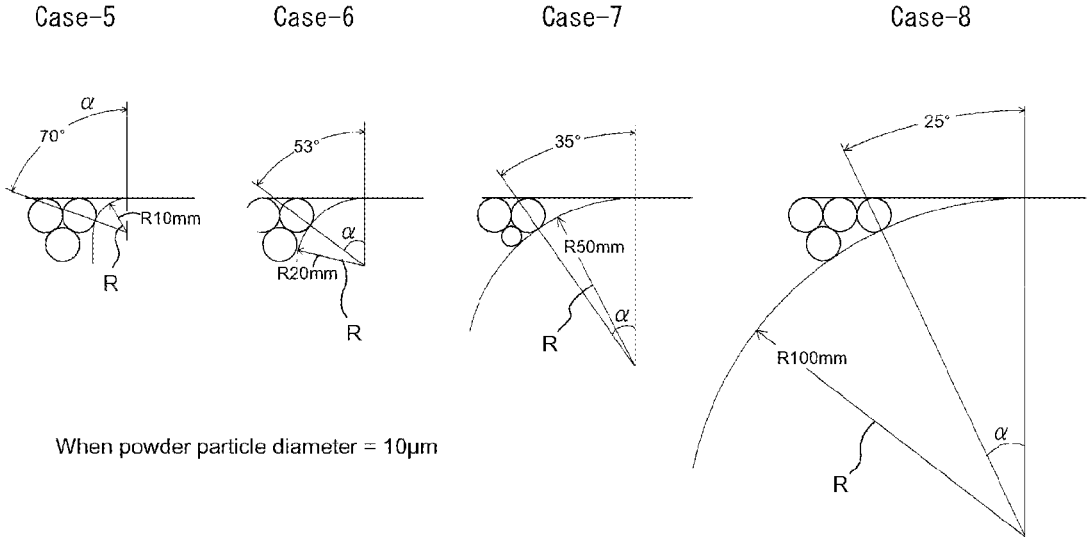
FIG. 7 Conceptual diagram modeling the situation believed to exist when R of a projecting region is varied during use of toner particles of toner particle diameter 10 μm.

As described above, FIG. 5 shows conceptual diagrams modeling how such scraping is believed to work. FIG. 5(*a*) is a diagram illustrating scraping when using yarn (fiber) 12*b* at woven fabric 12*a*, FIG. 5(*b*) is a diagram illustrating scraping when using radiused region 7*a* when molded part 12*c* or film is affixed, and FIG. 5(*c*) is a diagram illustrating scraping when using chamfered region 7*b* when molded part 12*c* or film is similarly affixed. Furthermore, FIG. 6 shows modeling for a situation in which the magnitude of radius R of radiused region 7*a* of projecting region 7 is varied when toner 18 is employed which has a toner 18 particle diameter of 6 μm. Moreover, FIG. 6 shows modeling of scraping for a situation in which the magnitude of radius R of radiused region 7*a* at the corner of projecting region 7 is varied when toner 18 is employed which has a toner 18 particle diameter of 10 μm. From the modeling shown in FIG. 6, it can be understood that when the magnitude of radius R constituting radiused region 7*a* of toner scraping angle α at projecting region 7 is made progressively larger in the order 10 μm, 20 μm, 50 μm, 100 μm, this causes toner scraping angle α to become progressively smaller in the order 57.38°, 42.29°, 27.44°, 19.53°, increasing the likelihood that toner 18 will enter the space between toner carrier 2 and sealing member 8 in wedge-like fashion. Furthermore, from the modeling shown in FIG. 7 it can be understood that even where the magnitude of radius R of radiused region 7*a* at projecting region 7 is the same, increasing particle diameter of toner 18 from 6 μm at FIG. 6 to 10 μm at FIG. 7 makes it possible to increase toner scraping angle α.

Furthermore, in accompaniment to improvement in image quality in recent years, toner 18 used in image-forming devices 1 has become conglobated and the particle diameter thereof been reduced, such that average particle diameter has come to be 5 μm to 10 μm. Accordingly, it is desired that a toner scraping angle α be provided which is even larger. Furthermore, upon using the method for measuring angle of repose shown in FIG. 37 to measure angles θ of repose for various toners, it was found that conglobated spherical toner exhibited improvement in flow characteristics in accompaniment to conglobation such that toner angle θ of repose was around 27°, that toner angle θ of repose for pulverized toner was around 38°, and that toner angle θ of repose for magnetic toner was around 40°. So as to permit scraping of these toners, it is necessary to increase the magnitude of toner scraping angle α in toner scraping direction 29. As indicated by the modeling shown at FIG. 6 and FIG. 7, it is possible by decreasing radius R of radiused region 7*a* at projecting region 7 to increase toner scraping angle α.

Furthermore, means for constituting radiused region 7*a* of projecting region 7 include a method which employs molding from resin, a method which employs affixing of a resin sheet member, a method which employs removal of material from a sheet member, and a method employing sealing member 8 comprising woven fabric 12*a*. Because sealing member 8 comprising woven fabric 12*a* employed at image-forming device 1 in accordance with the present invention allows the width of recessed region 6 and the width of projecting region 7 to be set as desired, it has increased degrees of freedom and permits fiber diameter to be set as desired, as a result of which it is superior when compared with other methods; and furthermore, because it employs technology in connection with woven fabric 12*a* which is mature, it enjoys high stability. Accordingly, as method for forming edge(s) of projecting region(s) 7, it is desirable to employ sealing member 8 comprising woven fabric 12*a* employing fibers. Moreover, ordinary chemical fibers include synthetic fibers such as, there being many varieties, those which representatively include polyamide (trade name Nylon), polyester, acrylic, and so forth, and functional fibers which include carbon fibers, fluorinated fibers, heat-resistant fibers, and so forth. Moreover, there are also electrically conductive fibers, polyurethane fibers, and other such elastic fibers and the like, there being a high degree of freedom with respect to selection thereamong; and with respect to fiber diameter as well, among those which in recent years have come to be referred to as microfibers and which are less than or equal to 1.0 D (1 denier), which have diameters less than or equal to approximately 10 μm, there are also many fibers (filaments), it being possible to make free selection with respect to fiber diameter. Now, among fibers (filaments) there are discontinuous fibers and continuous fibers; with respect to what is to be employed in the present invention, it is desirable that continuous fibers of good linear configuration be employed. Furthermore, where recessed regions 6 and projecting regions 7 are present at woven fabric 12*a*, it is desirable to improve toner scraping action that the means employed to increase toner scraping angle α where contact takes place be the means which utilizes reduction in radius R of radiused region 7*a* at projecting region 7. Fibers produced by fiber spinning technology in recent years have come to include hollow fibers, porous fibers, and other such fibers having pore(s), and split fibers or the like comprising composite fibers or fibers having modified fiber cross-section include those which are not of round shape but are instead shaped so as to have acute angle(s); fibers which are shaped so as to have such acute angle(s) are desirable because they make it possible to attain higher toner scraping effectiveness. Accordingly, the sealing members 8 comprising fibers which may be employed in accordance with the present invention also include these.

Note that advances in manufacturing technology have made it possible, as indicated at Working Example 1 and Working Example 2 in TABLE 3 below, to fabricate resin sheets having recessed regions 6 and projecting regions 7 in the form of a molded product, or resin sheets having recessed regions 6 and projecting regions 7 as produced through use of lamination technology. Where such manufacturing technologies have been established, so long as proper consideration is given to the size of step 13, it will certainly be possible to employ such methods to obtain toner scraping action. Accordingly, such resin sheets are also included among the sealing members 8 having steps 13 comprising recessed regions 6 and projecting regions 7 in accordance with the invention under application.

Figure 8:
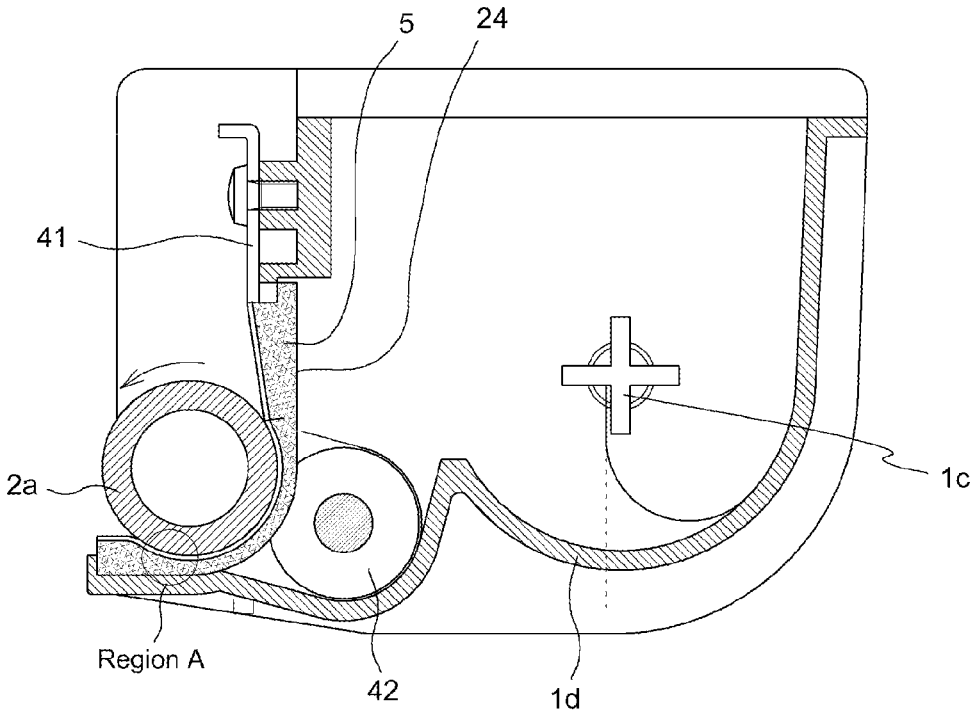
FIG. 8 Sectional view showing a toner agitator, a supply roller, a control blade, and a develop roller, i.e., toner carrier, at an image-forming device.
Figure 9:
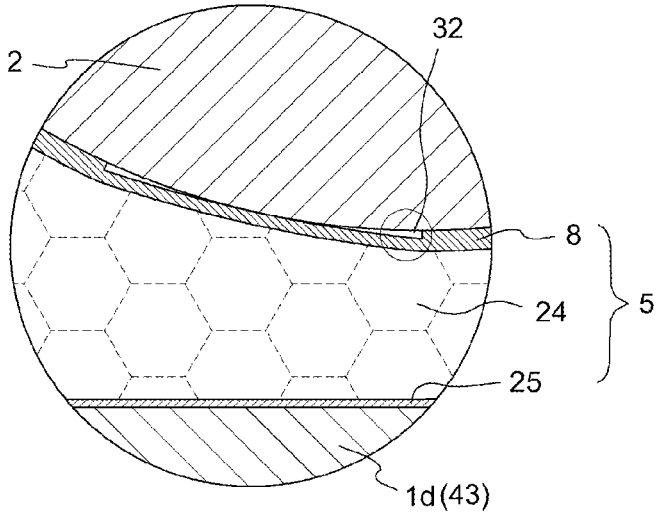
FIG. 9 Enlarged view of region A at FIG. 8.

Moreover, toner 18 scraped by sealing member 8 in accordance with a means of the present invention is by the conveying force of toner carrier 2 made to move toward the direction of stripe(s) constituting band(s) 14, the direction of which is controlled, and/or edge(s) of projecting region 7 at step 13 and/or recessed region 6 at sealing member 8 and toner carrier 2 by means of step(s) 13 present at sealing member 8. Schematic diagrams depicting this are shown in FIG. 8, FIG. 9, and FIG. 10. Note that end seal member 5 at FIG. 9 is affixed by two-sided adhesive tape 25 provided at the back surface of end seal member 5 to device outer shell 1*d* constituting installation seat 43. With respect to leakage of toner due to gap 32 in FIG. 9, vibration testing apparatus 44 shown in FIG. 11 was employed, a setting of 90° was used so as to cause orientation of steps 13 to be parallel to the direction of vibration as shown at (b) in FIG. 11, testing was carried out on sealing member 8 by itself with vibrations being produced by vibration source 44*a* under conditions most likely to cause leakage, and as shown in the graph at FIG. 12, with respect to leakage of toner 18 where steps 13 are present, upon considering the vibrations to be withstood which would correspond to vibrations experienced during ordinary transport, i.e., 3 G (29.3 $m/s^2$), it is clear that for a sealing member 8 having steps 13 that steps 13 less than or equal to 0.1 mm are preferred. Note that as a result of measurement of vibrations within the device it was found that these were less than or equal to 5 $m/s^2$.

Figure 13:
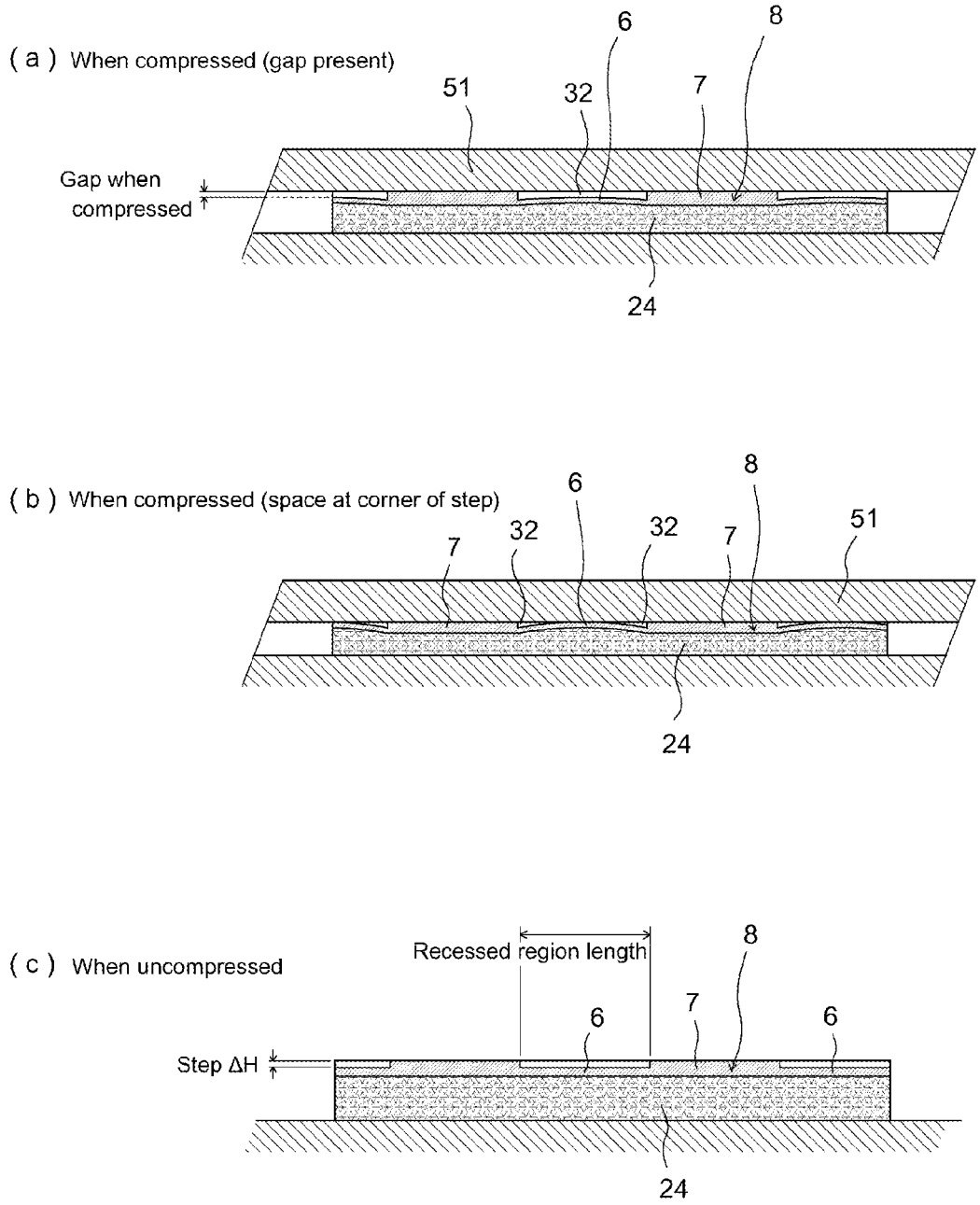
FIG. 13 Diagrams showing relationship between contact load at sealing member and gap.
Figure 14:
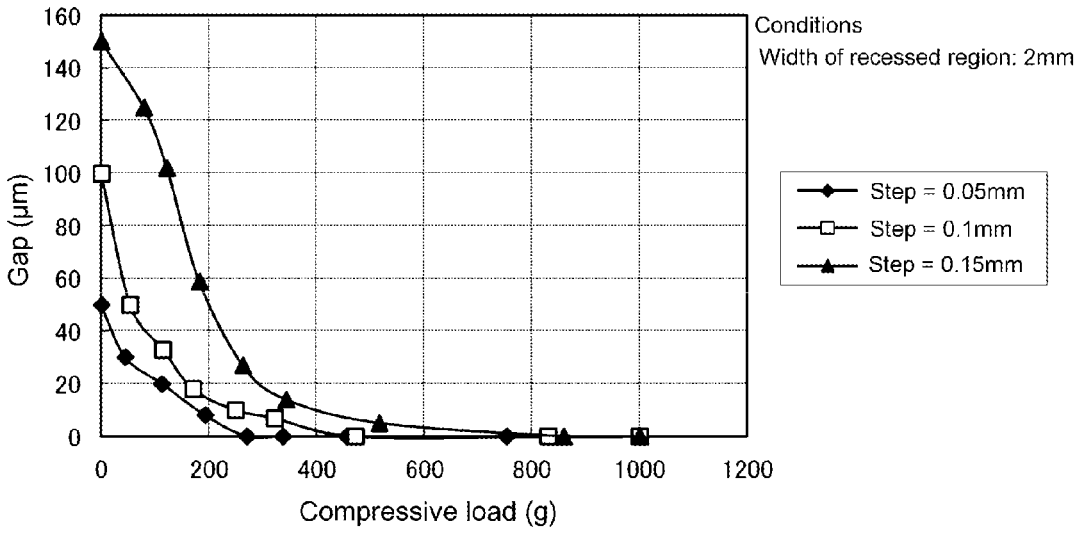
FIG. 14 Graph showing relationship between contact load at sealing member and gap.

Sealing member 8 was such that a foamed body constituting reactive-force-providing elastic body 24 was provided at the back surface of sealing member 8 having steps 13, ΔH, at woven fabric 12*a* to fabricate sealing member 8, this being shown in FIG. 13. FIG. 13 (*a*) shows how gap 32 might exist over the entire width of recessed region 6 of sealing member 8 when compressed under weight 51, FIG. 13 (*b*) is a diagram showing how gap 32 might be such that recessed region 6 exists only near projecting region 7 of sealing member 8 when compressed under weight 51, and FIG. 13 (*c*) is a diagram showing the situation when not under load because uncompressed by weight 51. The graph in FIG. 14 shows results of measurement of the gap 32 produced by bending deformation due to compression of recessed region 6 of sealing member 8 at sealing members 8 having various steps 13 when a compressive load was applied to sealing member 8 by weight 51 as shown at (a) and (b) in FIG. 13. For sealing members 8 having steps 13 which were respectively 0.05 mm, 0.1 mm, and 0.15 mm, application of compressive load by weight 51 caused occurrence of bending and deformation at recessed region 6, the graph at FIG. 14 showing how gap 32 at the point of closest approach to toner carrier 2, which is the contacting member corresponding to weight 51 of FIG. 13, grows progressively smaller.

Figure 11:
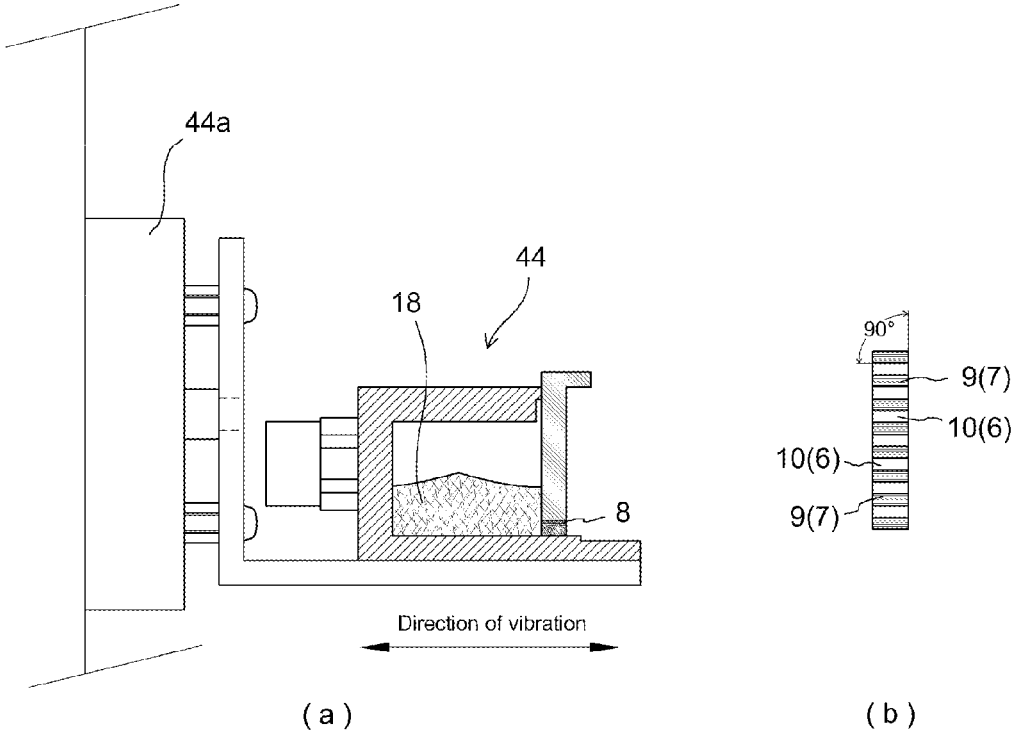
FIG. 11 Drawing showing vibration testing apparatus and sealing member serving as specimen.
Figure 12:
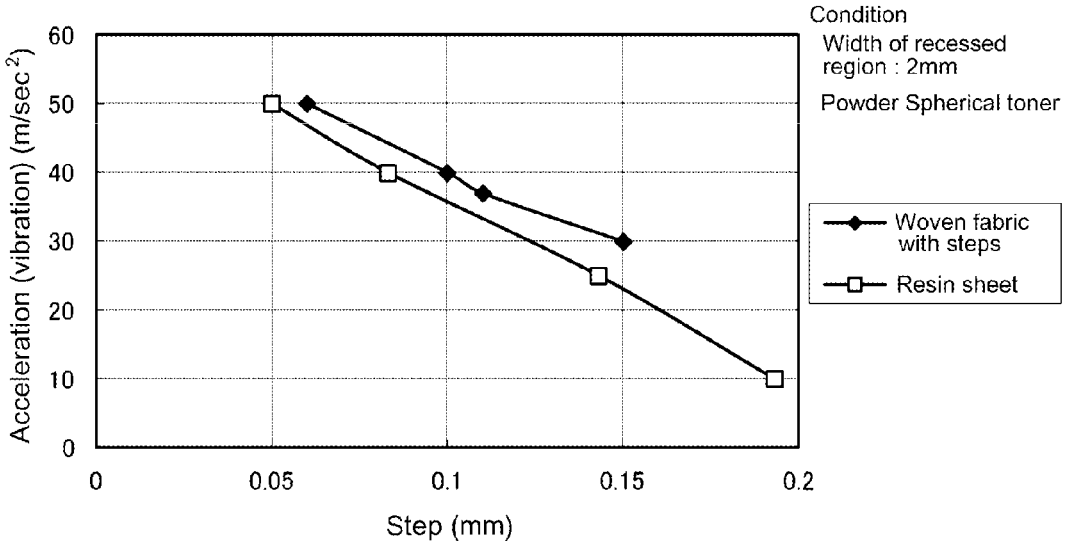
FIG. 12 Graph showing relationship between step and acceleration during toner leakage testing of sealing member by itself.
Figure 15:
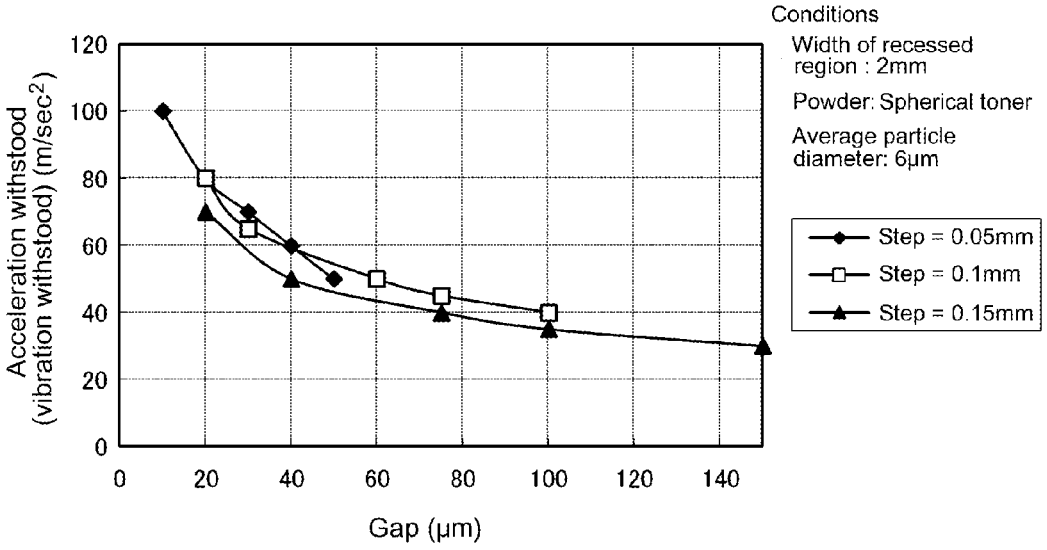
FIG. 15 Graph showing relationship between gap at sealing member and ability to withstand acceleration due to vibration source and gap.

A foamed body serving as reactive-force-providing elastic body 24 was provided at the back surface of sealing member 8 to fabricate sealing member 8, and vibration testing apparatus 44 shown in FIG. 11 was employed to explore leakage of toner 18 from sealing member 8 and gap 32, the results of which are shown at the graph in FIG. 15. With respect to ability of sealing member 8 to seal against leakage of toner 18, as can be seen at FIG. 15, gap 32 at the point of closest approach between recessed region 6 and toner carrier 2 is preferably less than or equal to approximately 0.1 mm, this gap 32 at the point of closest approach becoming better with respect to leakage of toner 18 in curved fashion from a point which is less than or equal to approximately 0.05 mm. Accordingly, it is more preferred that gap 32 at the point of closest approach between recessed region 6 and toner carrier 2 be less than or equal to 0.05 mm.

Figure 16:
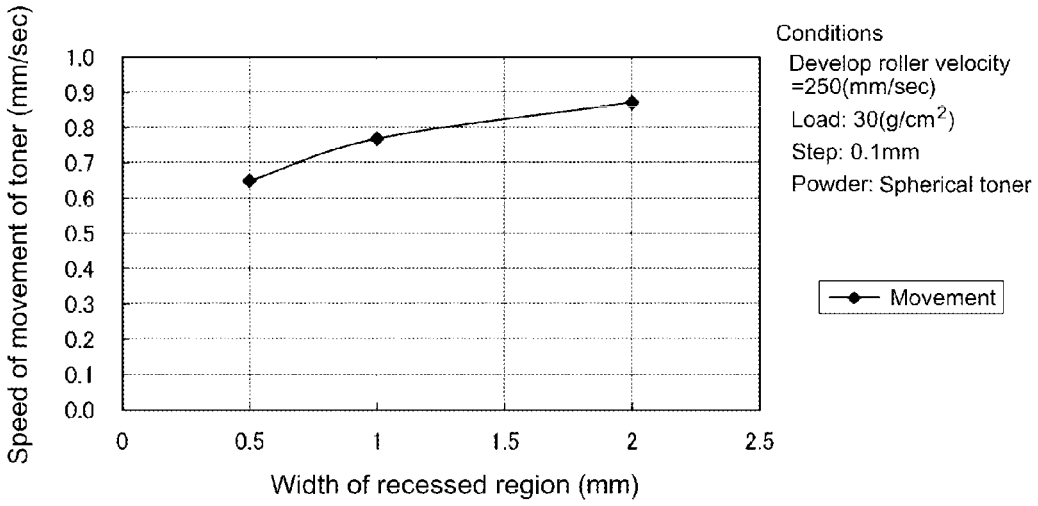
FIG. 16 Graph showing relationship between width of recessed region at sealing member and speed of movement of toner.

Because sealing member 8, with reactive-force-providing elastic body 24 provided at the back surface thereof, is thus such that pressure of contact with toner carrier 2 causes recessed region 6 of sealing member 8 to bend, reducing the size of gap 32 at the point of closest approach between recessed region 6 and toner carrier 2, this makes usage possible where it might otherwise have been thought difficult to employ steps 13 were this in the context of a sealing member 8 by itself, without reactive-force-providing elastic body 24 at the back surface thereof, which makes it possible to enlarge the domain in which used. In addition, as shown at the graph in FIG. 16, with respect to the effect of the width of recessed region 6, speed of movement of toner 18 is higher for a wide recessed region 6 of width 2 mm than for a narrow recessed region 6 of width 0.5 mm. Furthermore, with respect to the width of recessed region 6, it being necessary that the contact load be capable of producing bending, results of calculations performed in this regard are shown at the graph in FIG. 17. Based on the results of these calculations, it is desirable that the width of recessed region 6 be greater than or equal to 0.25 mm for where the diameter of weft yarn 17 is 0.025 to 0.1 mm.

Figure 18:
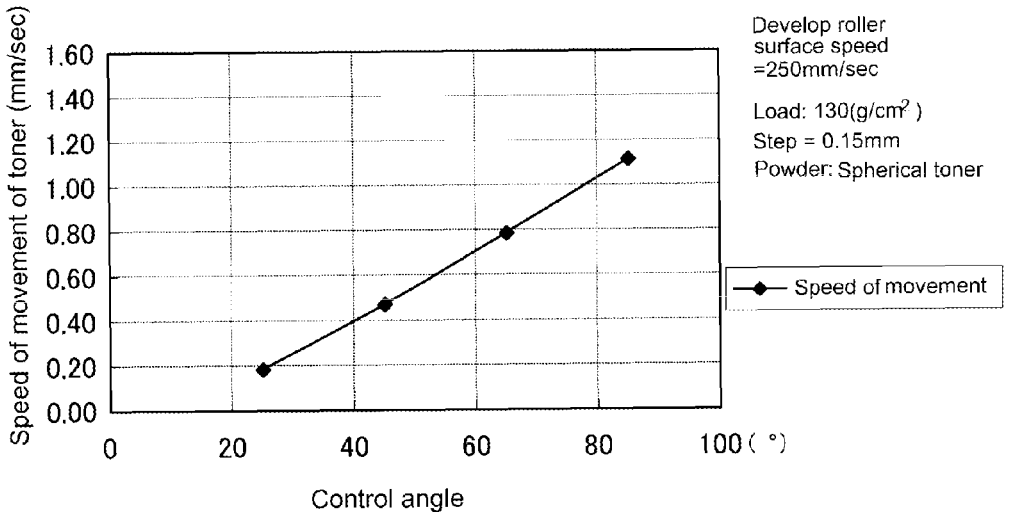
FIG. 18 Graph showing relationship between toner control angle at sealing member and speed of movement of toner.

A foamed body constituting reactive-force-providing elastic body 24 was provided at the back surface of woven fabric 12*a* constituting sealing member 8 comprising stripes in the form of bands 14 having steps 13, two-sided adhesive tape 25 was affixed to the back surface of the foamed body, and angle 27 for control of toner 18 was set to various prescribed angles to fabricate end seal member 5, this was made to contact develop roller 2*a* constituting toner carrier 2, and speed of movement of toner 18 for the various prescribed control angles was measured, results being shown at the graph in FIG. 18. As shown at the graph in FIG. 18, speed of movement of toner 18 increased with increasing control angle 27 for control of toner 18, and speed of movement of toner 18 decreased with decreasing control angle 27 for control of toner 18. Accordingly, speed of movement of toner 18 can be adjusted by means of toner 18 control angle 27. It is possible to set toner 18 control angle 27 in correspondence to the speed of the device, it being possible by causing the speed of movement of toner 18 to be greater than the speed with which toner 18 enters gap 32 between toner carrier 2 and recessed region 6 of sealing member 8 to prevent entry of toner 18 into gap 32. Accordingly, setting in this regard should be carried out appropriately in correspondence to the device.

Figure 19:
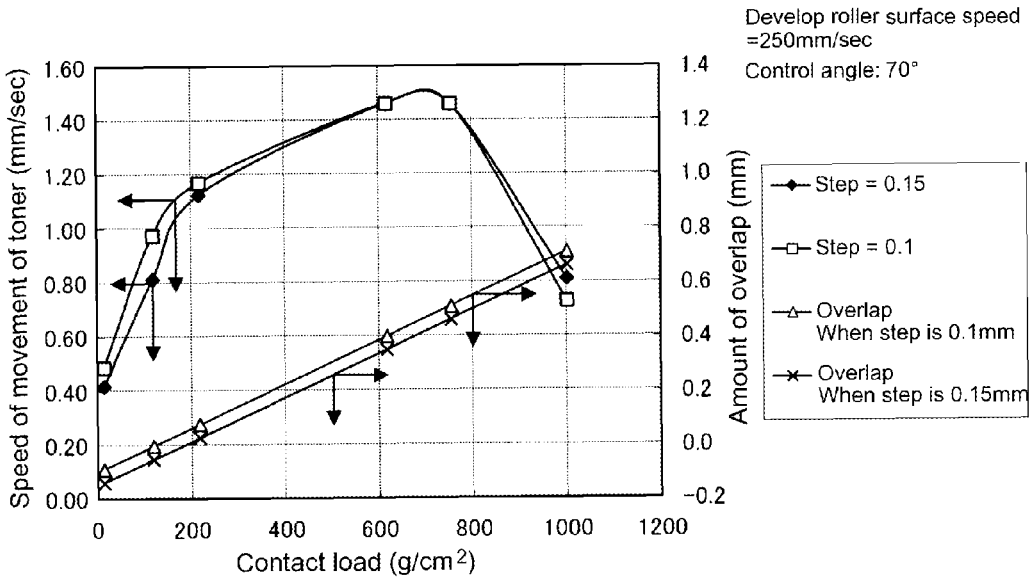
FIG. 19 Graph showing relationship between contact load at sealing member and speed of movement of toner and relationship between load and amount of overlap at toner carrier due to amount of bending of recessed region.

Results of measurement of contact load between develop roller 2*a*, i.e., toner carrier 2, and sealing member 8 and speed of movement of toner 18, and relationship between contact load and amount of overlap at toner carrier 2, i.e., the amount of bending of recessed region 6 at sealing member 8 where step 13 is present less the magnitude of step 13, are shown in the graph at FIG. 19. As shown in FIG. 19, speed of movement of toner 18 exhibits two inflection points due to increase in contact load. The first inflection point is such that speed of movement increases linearly with increasing contact load, speed of movement increasing gradually but linearly after passing through the primary inflection point. The second inflection point is such that a secondary inflection point is reached as a result of continuation of the foregoing gradual but linear speed of movement, as a result of which speed of movement of toner 18 decreases after passing through this secondary inflection point. This phenomenon is such that contact load and the amount of overlap at toner carrier 2 cause the primary inflection point to be the location at which recessed region 6 contacts toner carrier 2, this contact causing the speed of movement of toner 18 to increase. However, as can be seen after passing through the secondary inflection point, speed of movement of toner 18 decreases in contrary fashion for large contact loads. This is due to the fact that because gap 32 at the portion of the width of recessed region 6 which is at the boundary between projecting region 7 and recessed region 6 has become too small, movement of toner 18 is inhibited and speed of movement is made to decrease.

Figure 20:
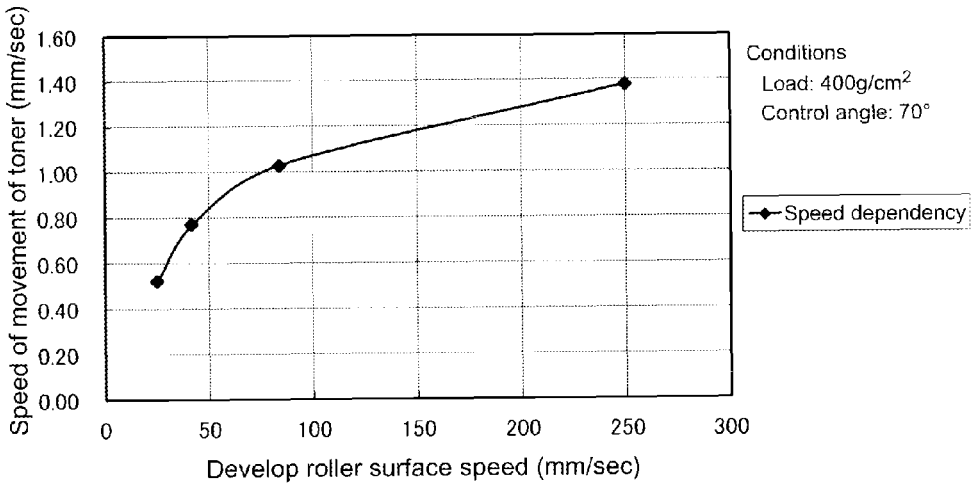
FIG. 20 Graph showing relationship between surface velocity of develop roller and speed of movement of toner at seal member.

Speed of movement of toner 18 when the surface velocity of develop roller 2*a* which is a toner carrier 2 is varied is shown at the graph in FIG. 20. As shown in FIG. 20, speed of movement of toner 18 increases with increasing surface velocity of develop roller 2*a*.

Figure 21:
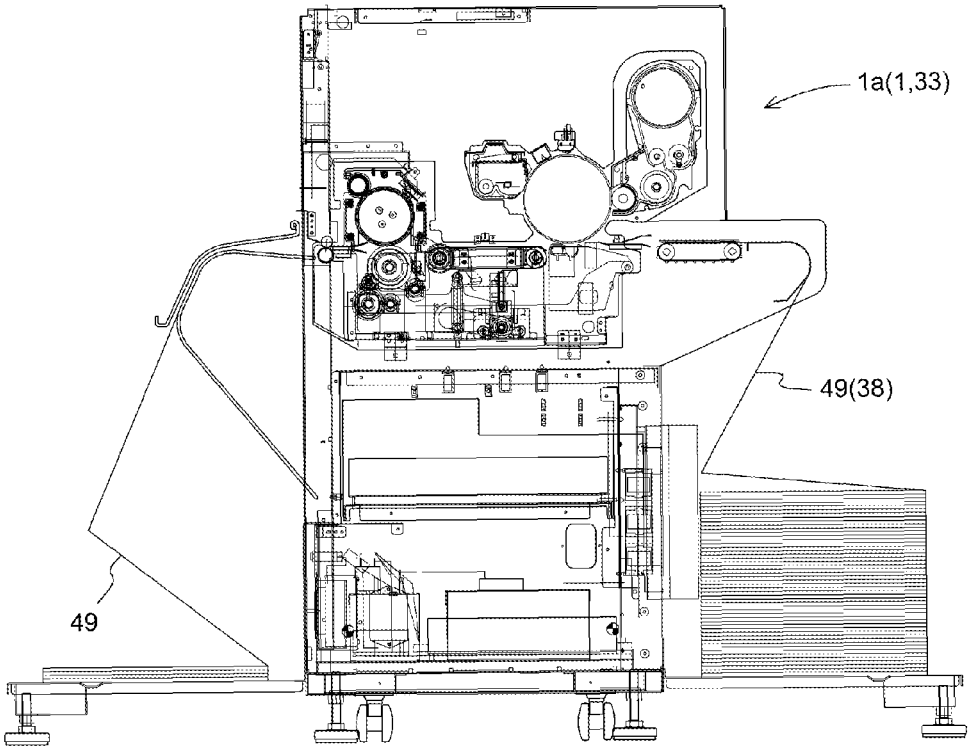
FIG. 21 Schematic side view showing entirety of internal structure of image-forming device.
Figure 22:
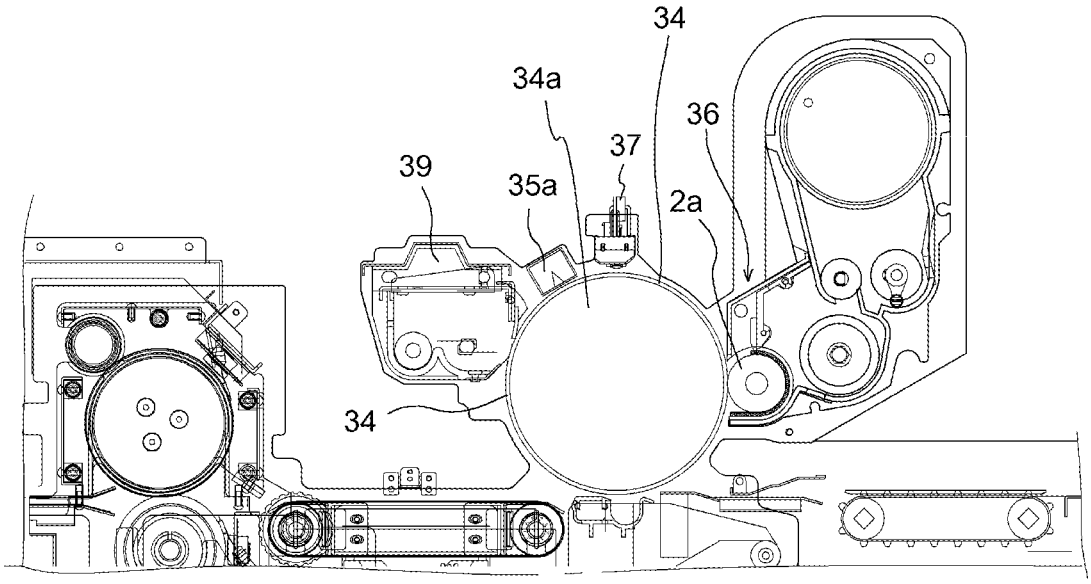
FIG. 22 Schematic side view showing primary components of internal structure of image-forming device of FIG. 21.
Figure 23:
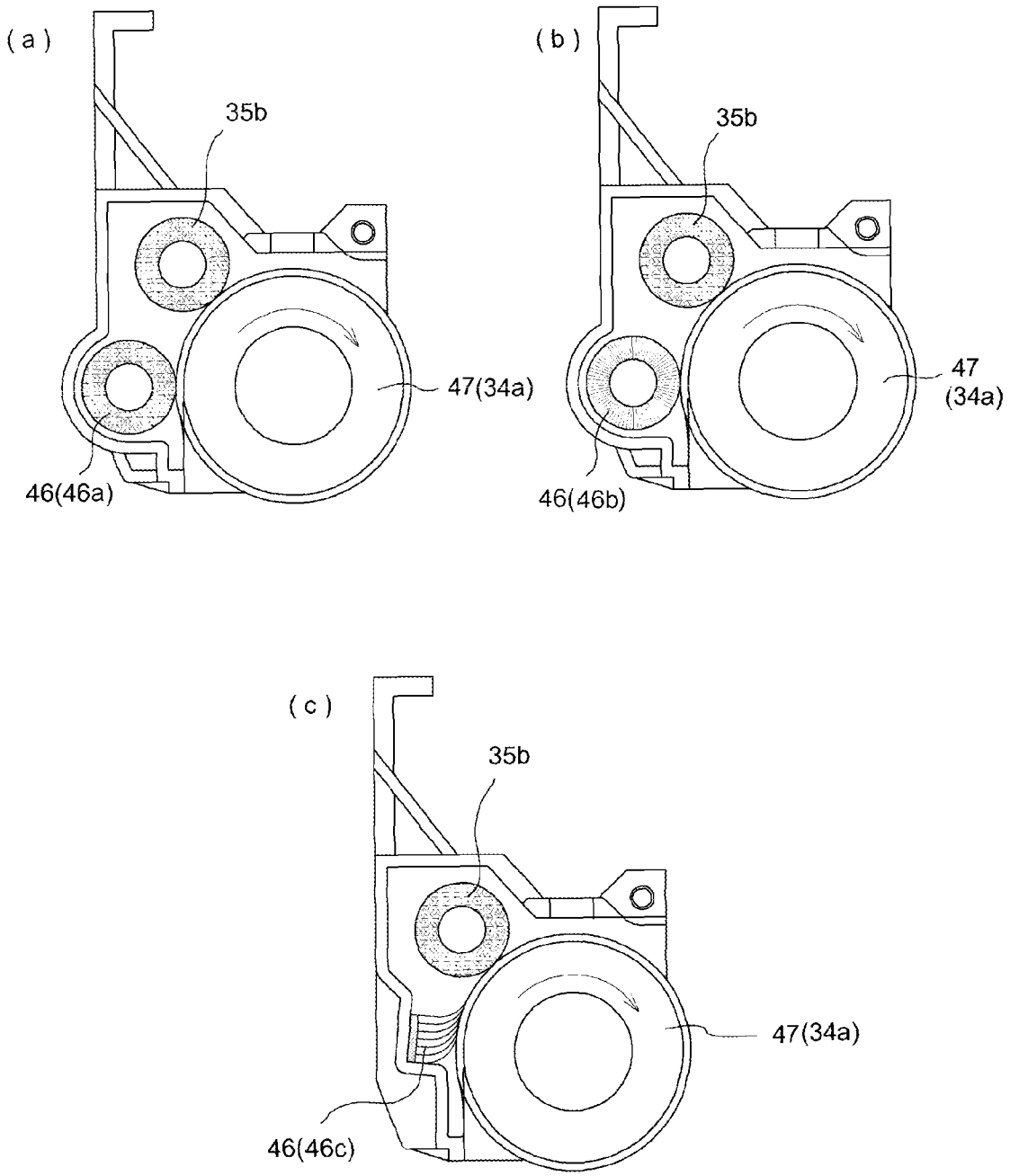
FIG. 23 Schematic side view showing example of use of dispersal apparatus in situation where there is no cleaning apparatus.
Figure 32:
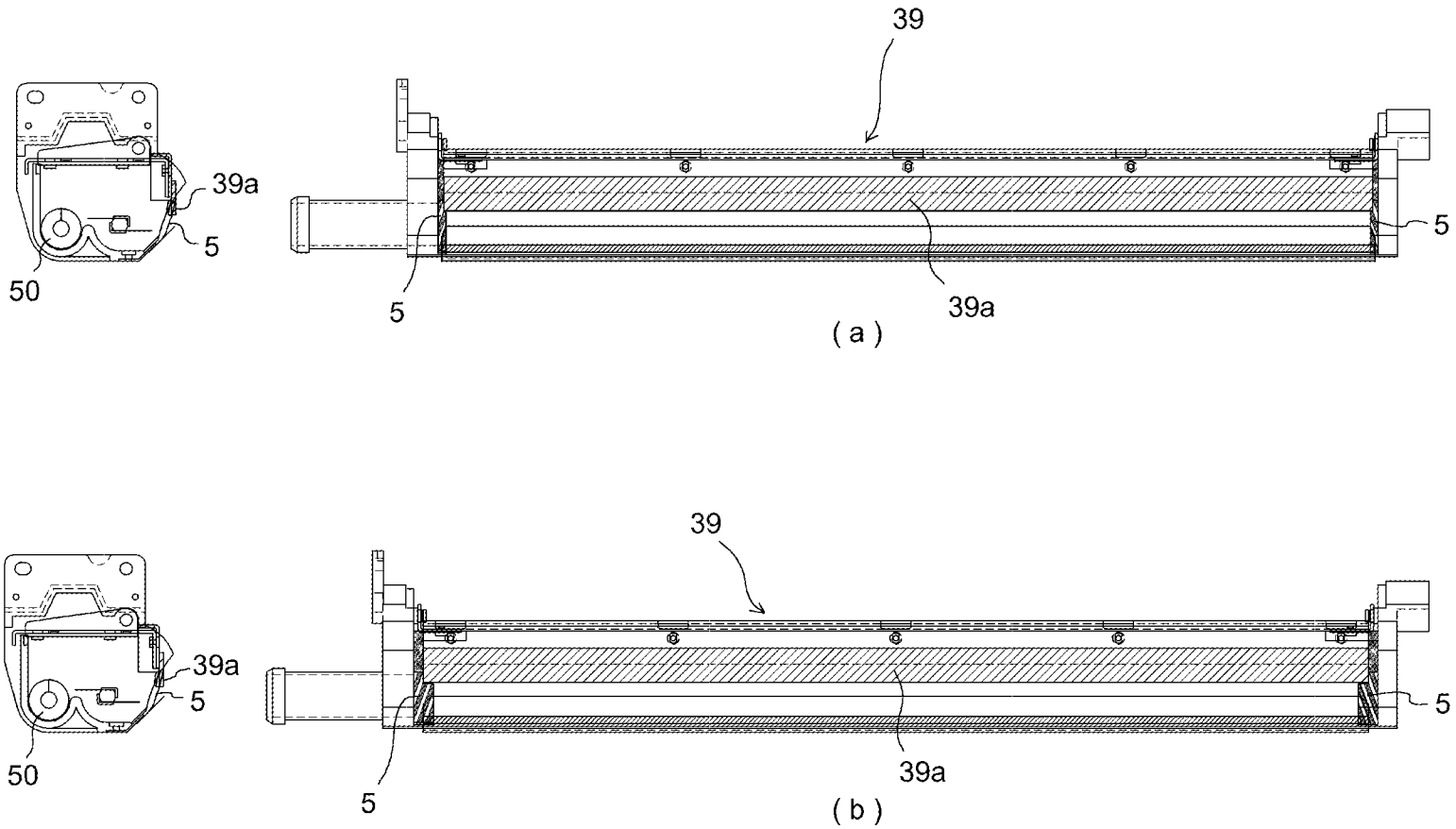
FIG. 32 Drawing showing a modular cleaning apparatus.

An electrophotographic monochromatic image-forming device 1*a* employing toner 18 will next be described. FIG. 21 is an exemplary diagram of a continuous-feed machine 33 constituting monochromatic image-forming device 1*a* employing electrophotography. Monochromatic image-forming device 1*a* shown in FIG. 21 such that the various functional components are constituted in modular fashion so as to be removably installed therein. As can be seen at FIG. 22, the primary components thereof are removably installed in a main body, photosensitive body 34 constituting image carrier 47 being constituted in modular fashion at a circumferential surface of drum-shaped photosensitive drum 34*a*. Arranged at the periphery of photosensitive drum 34*a* is charging device 35*a* serving as charging apparatus 35 to charge photosensitive body 34 at the circumferential surface of photosensitive drum 34*a*. This charging apparatus 35 is removably installed in monochromatic image-forming device 1*a*, there being a module in which there is only charging device 35*a*. Photosensitive body 34 may be belt-like instead of being drum-like. As photosensitive body 34 rotates, the surface of photosensitive body 34 is uniformly charged by charging device 35*a*, following which a latent electrostatic image is formed at photosensitive body 34 by laser or LED head 37 which is installed at the main body. Developer carrier 36 constituting a develop unit which has develop roller 2*a* constituting toner carrier 2 and which is removably installed at monochromatic image-forming device 1*a* uses toner 18 to develop photosensitive body 34 of photosensitive drum 34*a* and make visible the latent electrostatic image formed thereon. That is, a toner image which has been made visible by toner 18 is formed on photosensitive body 34 of photosensitive drum 34*a*. The toner image formed on photosensitive body 34 of photosensitive drum 34*a* is transferred to paper 49 or other such recording medium 38 by corona transfer, roller transfer, or other such transfer means, following which this is fused on paper 49 constituting recording medium 38 by hot-roller fusing, hot-belt fusing, or other such fusing means. Furthermore, following transfer, toner 18 at the surface of photosensitive drum 34*a* is subjected to cleaning, which is carried out with respect to toner 18 remaining on photosensitive body 34, by cleaning means in the form of removably installed cleaning apparatus 39. As shown in FIG. 32, the cleaning means of this cleaning apparatus 39 is formed from a cleaning blade 39*a* or from a rotating brush or the like, cleaning being carried out by such means. As shown in FIG. 23, at the surface of photosensitive body 34 to which toner 18 adheres electrostatically, sponge roller 46*a* constituting a rotating roller, brush roller 46*b*, stationary brush 46*c*, or other such dispersal means 46 which disperse toner may be used to disperse toner 18 so as to eliminate effect of electrostatic potential at photosensitive body 34. Note that such member(s) may be electrically conductive member(s), application of voltage(s) thereto making it possible to obtain dispersing effect to greater degree. This apparatus of FIG. 23 might, for example, be an apparatus that does not have a cleaning blade. Note that reference numeral 39*b* applies to a situation where charging roller 35*b* is employed as charging means, and photosensitive drum 34*a* constitutes image carrier 47. Such an apparatus might ordinarily be used where spherical toner is employed and transfer characteristics are good. In this way, the respective functional parts which have been made into apparatuses that are removably installed and separable from photosensitive drum 34*a*; i.e., component-type modules which include the photosensitive body unit constituting photosensitive body 34, the charging unit constituting charging apparatus 35, the develop unit constituting developer carrier 36, and so forth, are constituted so as to permit easy maintenance and replacement, and cleaning apparatus 39 and dispersal apparatus 46 have also been made modular, the foregoing respective cleaning unit, dispersal unit, and other such component-type modules. For this reason, such apparatuses require that there be dimensional latitude relative to photosensitive body 34, i.e., the photosensitive body of the photosensitive unit, and require that end seal member 5 have large latitude in seal characteristics.

Furthermore, in a device in which photosensitive drum 34*a* having such a photosensitive body 34 has been made modular and is removably installed therein, because printing, which is to say imaging, takes place at high speeds, and because develop takes place at high speeds even where developer carrier 36 comprises develop roller 2*a* of toner carrier 2 or the like, heat of friction produced between such equipment and rubbing members at sealing members 8 or the like can be a problem. In particular, resin is a primary component of toner 18, and because the glass transition temperature and melting point of the resin have been made low so as to maintain fusing characteristics, problems can arise if toner 18 constituting this resin is affected by heat of friction due to rubbing. Accordingly, at such a device employing high speeds, it is required that the end seal member 5 which rubs against develop roller 2*a* constituting toner carrier 2 employ material(s) of low coefficient of friction, and that sealing member 8 be capable of providing seal functionality at low load in terms of the contact pressure necessary for seal functionality. Sealing member(s) 8 in accordance with the present invention are employed at end seal member(s) 5 of develop roller 2*a* which serve as develop means and end seal member(s) 5 of cleaning apparatus 39 at such image-forming device 1. Where sliding characteristics are required at end seal member 5 which comes in contact with toner carrier 2, yarn having good sliding characteristics may be employed at least at warp yarn 15 at satin weave 9 making up projecting region 7 as has been described above. As an example of employment of such yarn having good sliding characteristics, employment of yarn comprising fluorinated fibers should be sufficient. Furthermore, to improve yarn sliding characteristics, lubricant in the form of a higher fatty acid salt or wax may be employed by applying this to the yarn or by kneading this into the resin from which fibers are formed.

Figure 24:
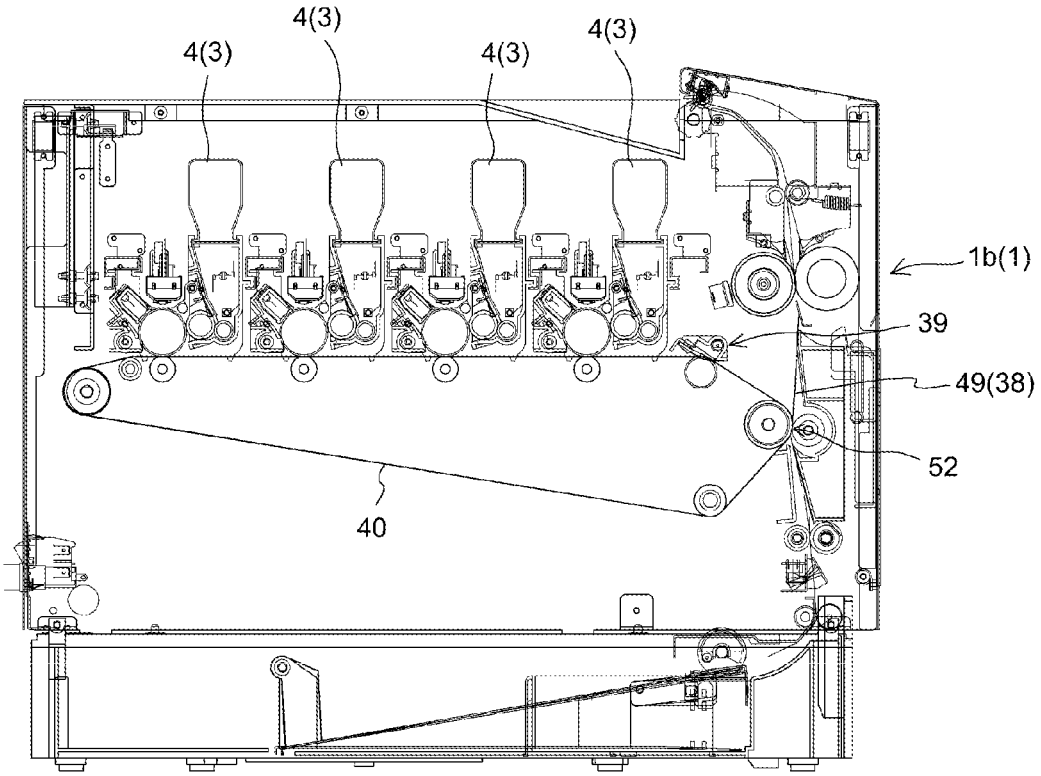
FIG. 24 Schematic side view of a color image-forming device at an image-forming device.

FIG. 24 shows an exemplary electrophotographic color image-forming device 1*b*. Image-forming device 1 shown in FIG. 24 is a multi-stage tandem-transfer image-forming device 1 having tandem-type processing units 4 employing intermediate transfer belt 40. At this device, four processing units 4 constituting imaging units 3 are arranged in parallel, color images being formed from toners 18 of four different colors. Toner 18 comprises four colors, these being Y (yellow), M (magenta), C (cyan), and K (black), with the yellow processing unit 4, the magenta processing unit 4, the cyan processing unit 4, the black processing unit 4 being present in order from right to left as seen in FIG. 24. Images divided into color components are formed at processing units 4 constituting respective imaging units 3, these being combined in overlapping fashion at intermediate transfer belt 40 to form a color image. The color image formed on intermediate transfer belt 40 is transferred in a single operation, color toner 18 being transferred onto paper 49 or other such recording medium 38 at secondary transfer region 52. The color image which has been transferred onto recording medium 38 is thereafter fused, constitution of the device being such that color toner 18 is fused on recording medium 38 by a fusing apparatus to produce a color image. Furthermore, among devices employing intermediate transfer belt(s) 40, there are devices which have, in addition to processing units 4, dispersal apparatus(es) 46 which disperse toner 18 or cleaning apparatus(es) 39 which clean toner 18 from intermediate transfer belt(s) 40 following secondary transfer. At such color image-forming devices 1*b* as well, sealing member(s) 8 in accordance with the present invention are employed, being combined with reactive-force-providing elastic body or bodies 24 to constitute end seal member(s) 5, and being moreover employed as end seal member(s) 5 at cleaning apparatus(es) 39 and end seal member(s) 5 at processing unit(s) 4.

Furthermore, to achieve the energy conservation and resource conservation of recent years, and reduced size of installation space being necessary, reduction in size of the device is desirable. Moreover, because a tandem-type device has four processing units 4, the need to for reduction in size is especially great. One might therefore want to reduce the width of the image region of the device in an attempt to achieve reduction in the size of the device. However, the image region of the device is determined by the size of paper 49 or the like which constitutes recording medium 38. But because paper sizes are standardized, it would normally be difficult to reduce the image region by more than one was willing to reduce the paper size region. It therefore becomes necessary to look to regions of device members other than the image region if one wishes to reduce the width of the device. Among device members at locations other than the image region are end seal member(s) 5 for preventing leakage of toner 18. These include end seal member(s) 5 at cleaning apparatus 39 and end seal member(s) 5 at develop roller 2*a* which is a toner carrier 2. Width(s) of such end seal member(s) 5 are determined by sealing member 8 characteristics, life, and so forth. Width of sliding-contact-type sealing member 8 which comes in contact with toner carrier 2 is around 5 mm, disclosures at publicly known patent references including description of a width of 10.5 mm for a sealing member 8 at paragraph 0036 in Patent Reference No. 14, description of the width rubbed by an end seal member 5 at paragraph 0012 in Patent Reference No. 13 as being greater than or equal to 4 mm, and description of a width of 8 mm for an end seal member at paragraph 0064 in Patent Reference No. 17. Moreover, disclosures of widths of sealing members 8 employing magnetic bodies include 3 mm together with a thickness of 0.5 mm at a magnetic plate and a width of 2.5 mm at a magnet at paragraph 0032 in Patent Reference No. 16, and also a width of 4 mm at a magnet seal at paragraph 0045 in Patent Reference No. 15.

By way of explanation, conventional end seal members 5 have been such that width of an end seal member 5 for an imaging unit 3 for imaging 5000 printed sheets of A4 size or smaller would be around 5 mm, as use of a smaller size than this would create concern that there would be leakage of toner 18. The reason for this is that with a sealing member 8 which employs felt, which is nonwoven fabric, since fiber direction is irregular, because there is no action by which toner 18 that has entered thereinto might made to return, it has been necessary to employ a wide sealing member 8 in anticipation of the fact that there will be a certain degree of entry thereinto. Furthermore, in an image-forming device 1 which employs a pile-type end seal member 5, pile coming in contact with toner carrier 2 and groomed so as to be in a prescribed direction has been able to control the direction 28 of flow of toner 18 and prevent leakage of toner 18 to the exterior. However, because these employ single-point support of the base fabric by the force of rubbing, the pile has a tendency to become acclimated in the direction of rotation of toner carrier 2, and when the direction of grooming of the pile is oriented in the rotational direction, toner 18 moves parallel to this orientation and enters the interior of sealing member 8. To prevent this, the constitution must be such as will provide the pile with rigidity, for which purpose increase in pile diameter becomes necessary. But if pile diameter is made too large, the space between piles increases and pile density decreases, which can have the unintended effect of permitting toner 18 to more easily enter thereinto and actually increase the tendency for leakage to occur. Conversely, if pile diameter is made too small, this permits increase in pile density, but because the pile becomes too flexible, the pile becomes acclimated in the rotational direction as a result of being rubbed by toner carrier 2, as a result of which toner 18 enters thereinto to a certain degree. However, seal characteristics are much better than would be the case for a sealing member 8 comprising nonwoven fabric. For reasons such as these, circumstances being such that it is difficult to decrease the width of an end seal member 5 which seals by means of contact, the situation has been such that it would be only natural to conclude that reduction in the width of image-forming device 1 would be difficult.

Figure 27:
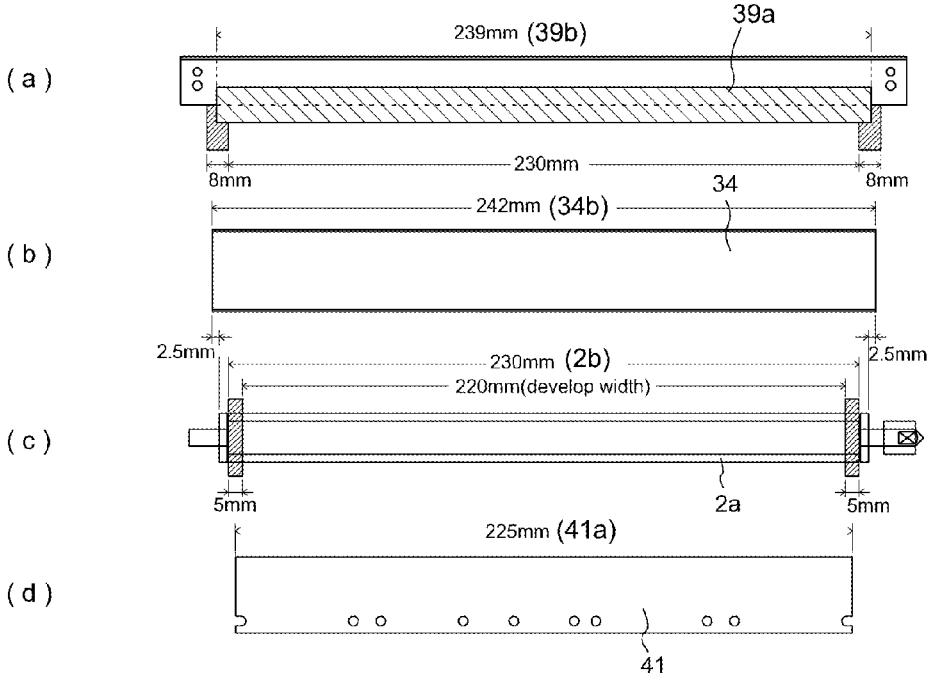
FIG. 27 Diagrams showing widths of various functional components in a conventional image-forming device.

Furthermore, to achieve reduction in the size of a device, it is disclosed at paragraph 0041 of Patent Reference No. 18 that a sealing member 8 might be compressed to 2 mm in the direction of the thickness of the end seal member 5. Moreover, at paragraph 0074 of Patent Reference No. 19, there is description of compression of thickness to 1.5 to 2.5 mm, for end seals of 2.5 to 4.5 mm. Furthermore, at paragraph 0004 of Patent Reference No. 20, there is a description to the effect that it is typical to ordinarily use a sealing member 8 which is 3 to 4 mm in thickness. Furthermore, as material for end seal member 5, there are sealing members 8 in which the material that comes in rubbing contact with the toner carrier 2 comprises synthetic leather, felt, sponge, resin sheet, an implanted-fiber product, napped pile, piled woven fabric 12*a*, or the like, and where these comprise the sealing member 8 that comes in rubbing contact by itself without presence of reactive-force-providing elastic body 24, a foamed body or the like having reactive-force-providing elasticity has been provided at the back surface to obtain reactive-force-providing elasticity. However, as noted at the foregoing patent references, a thickness which has been made to be around 1.5 mm when compressed during use is the current state of affairs, the situation being that, there being no satisfactory sealing member 8 capable of being used which would have a thickness less than this, reduction in size has been difficult to achieve. Note also that with sealing members 8 having nonwoven fabric, felt, or pile, loss of fiber and fluff is a constant concern, and where a developer carrier 36 is employed, there is occurrence of phenomena in which fiber or pile enters the interior of developer carrier 36, the fiber or pile accumulating at control blade 41 which is shown at (d) in FIG. 27 and which controls developer or toner 18. Where there is occurrence of such phenomena, occurrence of bands constituting image defects is a constant concern, and where toner 18 accumulates at the portion corresponding to cleaning apparatus 39, because there is a possibility that similar problems will occur, loss of fibers is a cause for concern.

Furthermore, with a sealing member 8 employing a magnetic body in which a magnetic brush not engaging in rubbing contact is formed so as to carry out sealing with respect to developer or toner 18, the toner which may be employed is limited to magnetic toner or two-component developer, i.e., magnetic body/bodies constituting carrier and toner 18. And not only that, where a developer carrier 36 has a develop roller 2*a* which is imbued with magnetic force, this is all that may be employed, employment of nonmagnetic toner thereat being impossible. This being the case, whereas with image-forming devices 1 which employ nonmagnetic toner there is a strong tendency toward use of common parts such that a single type of sealing member 8 is employed at the end seal member 5 of the cleaning apparatus 39 and the end seal member 5 of the toner carrier 2, with image-forming devices 1 which employ magnetic toner or two-component-type developer there are many devices in which there is differentiation with respect to use such that respectively different sealing members 8 are employed at the end seal member 5 of the developer carrier 36 which employs a develop roller 2*a* having a magnet at the interior thereof, i.e., a magnetic roller, which is a toner carrier 2, and at the end seal member 5 of cleaning apparatus 39.

Figure 25:
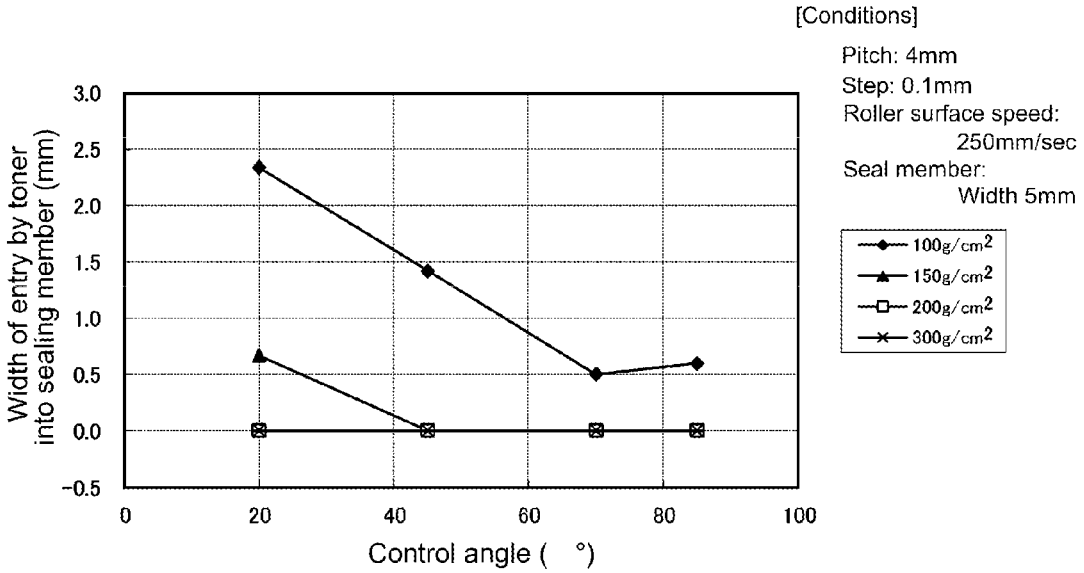
FIG. 25 Graph showing relationship between control angle of stripes at sealing member and width of entry by toner.

Image-forming device 1 in accordance with the present invention addresses such device-related problems, being a sealing member 8 which makes reduction in size possible, and being an image-forming device 1 employing same. Sealing member 8 used in image-forming device 1 in accordance with the present invention will now be described below. The graphs at FIG. 19, FIG. 25, and FIG. 26 will first be described. As indicated by the relationship between contact load of sealing member 8 and speed of movement of toner 18 at the graph in FIG. 19, sealing member 8 in accordance with the present invention is capable of adequately causing movement of toner 18 within a prescribed range; and as indicated at the graph in FIG. 25, when control angle 27 of the direction of stripes at sealing member 8 comprising stripes in the form of bands 14 having steps 13 is varied, it is possible to cause the width to which toner 18 enters sealing member 8 to be made zero to a degree that had not been possible conventionally. Moreover, the graph at FIG. 25 shows the relationship between the width to which toner 18 entered sealing member 8 and control angle 27 when contact load with respect to sealing member 8 was varied so as to be 100 g/cm$^2$, 150 g/cm$^2$, 200 g/cm$^2$, and 300 g/cm$^2$ at sealing member 8. Here, results indicated for width of entry by toner 18 were as measured on an actual test device, the contact load which was varied also being as measured. Moreover, here, width of entry was measured at the respective contact loads, contact load being such that reactive-force-providing elastic body 24 constituting a foamed body having prescribed reactive-force-providing elasticity was provided at the back surface of sealing member 8 comprising stripes. As conditions for sealing member 8 at FIG. 25, sealing member 8 comprised stripes in which width at recessed region 6 and projecting region 7 were each 2 mm, and step 13 at recessed region 6 and projecting region 7 was 0.1 mm. With respect to how such stripes fared relative to toner 18, results of confirmation of width to which toner 18 entered sealing member 8 are shown for when control angle 27 was varied in a situation where surface velocity of develop roller 2*a* was 250 mm/s and spherical toner of diameter 6 μm was used at a single-component developer carrier 36, as indicated at (b) in FIG. 10. As shown at the graph in FIG. 25, with a control angle 27 of 70° with respect to toner 18 at a sealing member 8 for which width of stripes in the form of bands 14 was 2 to 5 mm, it was possible using the foregoing contact loads to control the width of entry by toner 18 to a degree that had not been possible conventionally.

Figure 26:
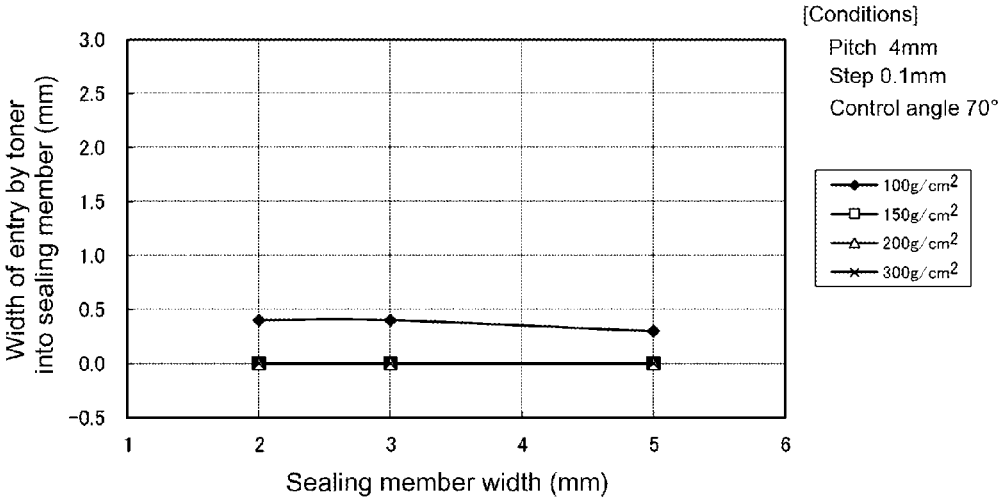
FIG. 26 Graph showing relationship between width of sealing member and width of entry by toner into sealing member.
Figure 28:
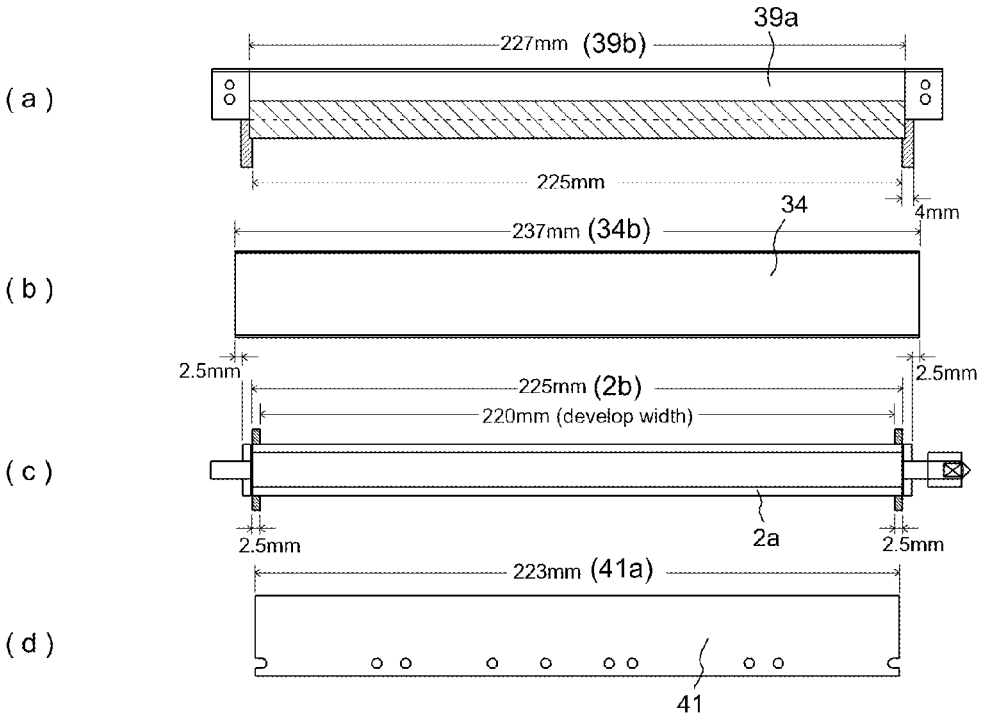
FIG. 28 Diagrams showing widths of various functional components in an image-forming device when employing end seals in accordance with the present invention.

Furthermore, the graph in FIG. 26 shows results of measuring the relationship between the width of the sealing member which served as end seal member 5 and the width to which toner 18 entered sealing member 8. As shown in FIG. 26, as a result of measurements carried out when sealing member width was varied between 2 mm and 5 mm, it was confirmed that adequate sealing was possible even for a sealing member width of 2 mm, with the width of entry by toner 18 exhibiting no dependency with respect to width of sealing member 8. Here, (a) cleaning blade width 39*b*, (b) photosensitive body width 34*b*, (c) develop roller width 2*b*, and (d) toner control blade width 41*a* are respectively shown at FIG. 27 for exemplary widths at an A4-size imaging component in a conventional image-forming device 1, and at FIG. 28 for exemplary widths at an imaging component employing sealing member 8 in accordance with the present invention employed in an image-forming device 1 in accordance with the present invention. As indicated by the examples for the conventional device at FIG. 27 and the device in accordance with the present invention at FIG. 28, comparison of the two indicates that a width of 5 mm for end seal width 5*a* at end seal member 5 at conventional develop roller 2*a* becomes a width of 2.5 mm for end seal width 5*a* at end seal members 5 used in the various functional components in accordance with the present invention, this being half the conventional width. Similarly, employment of sealing members 8 in accordance with the present invention as end seal members 5 at functional components constituting control blade 41, photosensitive body 34, and cleaning blade 39*a* makes it possible to decrease horizontal width at each such functional component in image-forming device 1. In addition, where it is possible to reduce end seal width 5*a* of end seal member 5 in image-forming device 1 from, for example, 5 mm to 2.5 mm, it will be possible to reduce width at both ends in image-forming device 1 by a total of 5 mm. It is thus possible by reducing component width at the interior of image-forming device 1 to reduce width of the overall device as well, permitting achievement of a reduction in size that had not been possible conventionally. By moreover employing nonmagnetic toner which is nonmagnetic and single-component at developer carrier 36 in accordance with the present invention, this will make it possible to permit achievement of further reduction in size.

Figure 29:
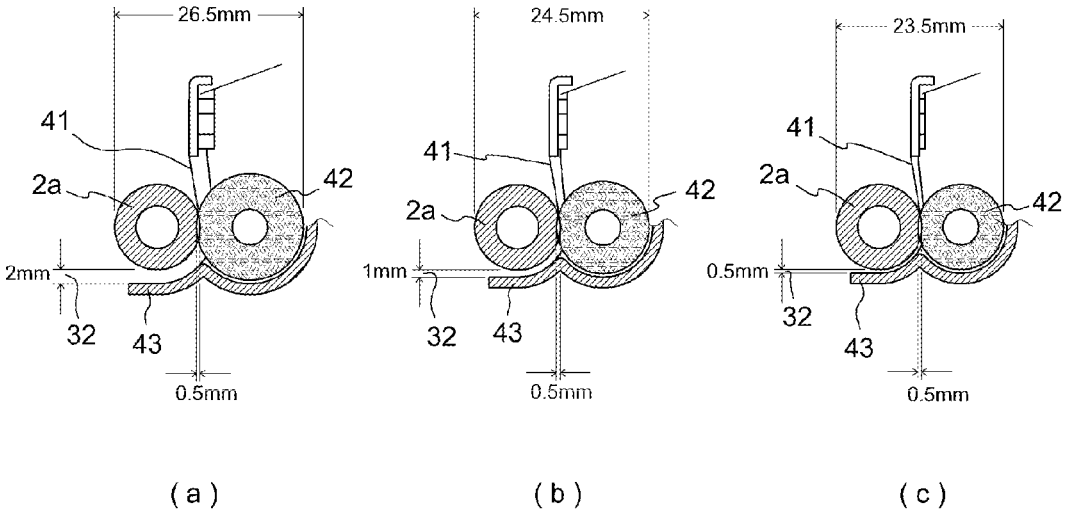
FIG. 29 Diagrams showing relationship between develop roller and end seal member installation seat.
Figure 31:
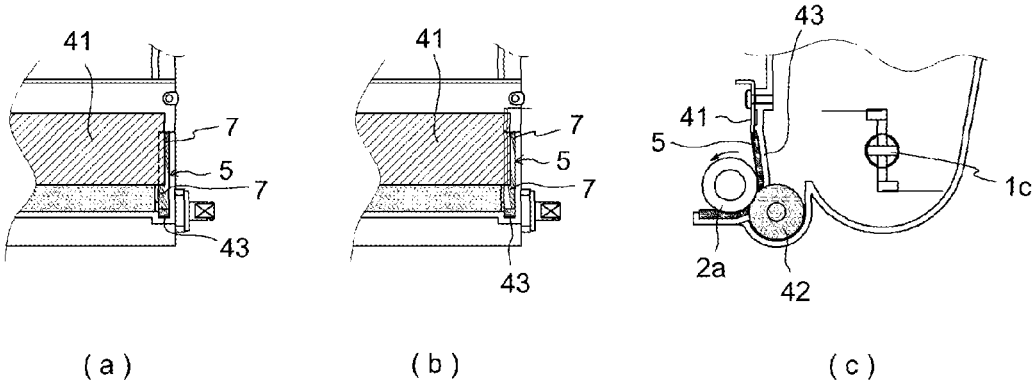
FIG. 31 Installation diagrams showing a situation in which entry by toner into an end seal member will tend not to occur and a situation in which entry thereinto will tend to occur.

Describing a situation in which the foregoing nonmagnetic toner which is nonmagnetic and single-component is employed at developer carrier 36, where distance between develop roller 2*a* and installation seat 43 shown in FIG. 29 has been made large to as a result of affixing of end seal member 5 thereto, with a nonmagnetic single-component developer carrier 36 it will be necessary to increase roller diameter at the supply roller 42 which comprises pile or reactive-force-providing elastic body 24 and which is for supply of nonmagnetic toner to develop roller 2*a*. FIG. 31 shows how toner enters end seal member 5. This installation seat 43 for end seal member 5 is shown at (c) in FIG. 31. The reason for increasing diameter of the roller at the foregoing supply roller 42 shown in FIG. 29 is described below. Because it is necessary to supply nonmagnetic toner to develop roller 2*a*, supply roller 42 shown in FIG. 29 is constituted such that it contacts develop roller 2*a*. To obtain a prescribed degree of contact at this supply roller 42, the distance between the axis of develop roller 2*a* and the axis of supply roller 42 must be set to a prescribed distance between axes. In addition, at the end of develop roller 2*a*, to prevent leakage of nonmagnetic toner from the end, it is necessary that there be an installation seat 43 for installation of end seal member 5 as shown in FIG. 31. This being the case, as shown in FIG. 29, when the gap 32 between this installation seat 43 and develop roller 2*a* is large, to obtain a prescribed nip interference, i.e., squeeze, at supply roller 42, it becomes necessary as shown at (a) in FIG. 29 to increase diameter of supply roller 42 to 15 mm. In other words, decreasing gap 32 between develop roller 2*a* and installation seat 43 from 2 mm at (a) in FIG. 29 to 1 mm at (b) in FIG. 29, or to 0.5 mm at (c) in FIG. 29, permits a decrease in the diameter of supply roller 42 from 15 mm at (a) in FIG. 29 to 13 mm at (b) in FIG. 29, or to 12 mm at (c) in FIG. 29. Accordingly, the setting of this gap 32 between the develop roller 2*a* and the installation seat 43 for end seal member 5 is one factor which determines the size of develop apparatus unit 48. This being the case, if it is possible to reduce gap 32 between installation seat 43 and develop roller 2*a*, then it will be possible to reduce the diameter of supply roller 42 and to achieve size reduction. However, because diameter of supply roller 42 is a function of gap 32, which in a conventional device is around 1.5 mm at smallest and which is more typically around 2 mm as described above, this is large as compared with the situation in accordance with the present invention.

The reason for this is that since no end seal member 5 has existed which would be capable of functioning as a seal under low load and which employed a sealing member 8 that would allow gap 32 to be made smaller than 1.5 mm, the situation has been such that reduction of gap 32 has been impossible with a conventional sealing member 8. Furthermore, where a conventional sealing member 8 has been overambitiously installed in a narrow gap 32 despite such concerns, this has increased the force of rubbing contact with sealing member 8, resulting in an increase in device torque, and thus increasing cost, which is opposite the intended effect. Furthermore, the increased force of rubbing contact has caused occurrence of problems in which end seal member 5 becomes detached. Moreover, where the force of rubbing contact is too high, this can increase the tendency for occurrence of scratches on the surface of develop roller 2*a*, which can actually cause leakage of toner, which is opposite the intended effect. Such reasons have brought us to the current situation in which reduction of this gap 32 is desired. Describing a sealing member 8 employed in image-forming device 1 in accordance with the present invention, a sealing member 8 which is a sealing member 8 comprising woven fabric 12*a* comprises satin weave 9 and plain weave 10 or satin weave 9 and twill weave 11, the structure being such that that it does not possess pile or the like. Alternatively, by means of the thickness of the yarn used for satin weave 9 or by means of the mutual closeness of the yarns at a region made in satin weave 9 which forms projecting region 7, a step 13 is provided between this and the plain weave 10 or twill weave 11 which forms recessed region 6. For this reason, as shown at the graph in FIG. 12, a constitution in which the step is 0.05 mm will permit seal characteristics to be adequately maintained, making it possible to reduce the thickness of sealing member 8 to around 0.15 mm. Moreover, with respect to the reactive-force-providing elastic body 24 constituting a foamed body having reactive-force-providing elasticity which should be employed, results of a study performed in this regard are shown in TABLE 1.

TABLE 1

Comparison of Properties of Reactive-Force-Providing Elastic Bodies

| | | Reactive-force-providing elastic body (foamed body) type | | | | | | | | |
|---|---|---|---|---|---|---|---|---|---|---|
| | | A | B | C | D | E | F | G | H | I |
| Seal characteristics (acceleration ≥ 50 m/s$^2$) | | | | | | | | | | |
| ○ = sealed at compression < 30%<br>Δ = sealed at 30% ≤ compression ≥ 60%<br>x = sealed at compression > 60% | | ○ | Δ | Δ | ○ | Δ | ○ | ○ | ○ | Δ |
| Reactive-force-providing load | | | | | | | | | | |
| ○ = compressible ≥ 70%<br>Δ = 40% ≤ compressible < 70%<br>x = compressible ≤ 40% | | ○ | ○ | ○ | Δ | ○ | ○ | ○ | ○ | ○ |
| Percent recovery (after 30 seconds) | | | | | | | | | | |
| ○ = recovery ≥ 80%<br>Δ = 50% ≤ recovery < 80%<br>x = recovery < 50% | | ○ | ○ | ○ | ○ | ○ | Δ | Δ | ○ | Δ |
| Adhesion characteristics | | | | | | | | | | |
| ○ = good<br>x = bad | | x | ○ | ○ | ○ | ○ | ○ | ○ | ○ | ○ |
| Study of foamed body by itself | Minimum gap | 0.3 mm; okay | 0.3 mm; okay | 0.35 mm; okay | 0.4 mm; okay | 0.3 mm; okay | 0.3 mm; okay | 0.3 mm; okay | 0.2 mm; okay | 0.2 mm; okay |
| | Usable range when foamed body thickness was 1 mm | 0.3 mm-0.84 mm | 0.3 mm-0.55 mm | 0.35 mm-0.75 mm | 0.4 mm-0.95 mm | 0.3 mm-0.67 mm | 0.3 mm-0.83 mm | 0.3 mm-0.75 mm | 0.2 mm-0.75 mm | 0.2 mm-0.7 mm |
| | Usable range when foamed body thickness was 2 mm | 0.6 mm-1.68 mm | 0.6 mm-1.1 mm | 0.7 mm-1.5 mm | 0.8 mm-1.9 mm | 0.6 mm-1.34 mm | 0.6 mm-1.66 mm | 0.6 mm-1.5 mm | 0.4 mm-1.5 mm | 0.4 mm-1.4 mm |
| | Usable range when foamed body thickness was 3 mm | 0.9 mm-2.52 mm | 0.9 mm-1.62 mm | 1.05 mm-2.25 mm | 1.2 mm-2.85 mm | 0.9 mm-2.01 mm | 0.9 mm-2.49 mm | 0.9 mm-2.25 mm | 0.6 mm-2.25 mm | 0.6 mm-2.1 mm |

At this TABLE 1, seal characteristics were evaluated by using vibration source 44*a* of vibration testing apparatus 44 shown in FIG. 11 to carry out vibration testing at accelerations greater than or equal to 50 m/s$^2$ to evaluate seal characteristics, reactive-force-providing load, percent recovery after 30 seconds, and adhesion characteristics. Seal characteristics shown in TABLE 1 were considered good as indicated by O when there was no leakage with a compression of less than 30%, were considered fair as indicated by A when there was no leakage with a compression greater than or equal to 30% but less than 60%, and were considered bad as indicated by x when there was no leakage with a compression greater than or equal to 60%. As result of this study, there was no item which was x, i.e., bad. Reactive-force-providing load was considered good as indicated by O when compression was possible to 70% under a load of not more than 300 g/cm$^2$, was considered fair as indicated by A when compression was possible to greater than or equal to 40% but less than 70% under a load of not more than 300 g/cm$^2$, and was considered bad as indicated by x when compression was possible to less than 40% under a load of not more than 300 g/cm$^2$. As result of this study, there was no item which was x, i.e., bad. Percent recovery was considered good as indicated by O when greater than or equal to 80% at 30 seconds following removal of compression, was considered fair as indicated by Δ when greater than or equal to 50% but less than 80% at 30 seconds following removal of compression, and was considered bad as indicated by x when less than 50% at 30 seconds following removal of compression. As result of this study, there was no item which was ×, i.e., bad. For adhesion characteristics, a peel strength test was carried out using two-sided adhesive tape 25, adhesion characteristics being considered good as indicated by O when sufficient to cause failure of the material, and adhesion characteristics being considered bad as indicated by x when there was delamination but this did not result in failure of the material. As a result, as indicated at TABLE 1, it was possible to find a reactive-force-providing elastic body 24 which was capable of recovering to a compression greater than or equal to 80%, and which was capable of being used at a reactive-force-providing load that was less than or equal to 300 g/cm$^2$.

Figure 30:
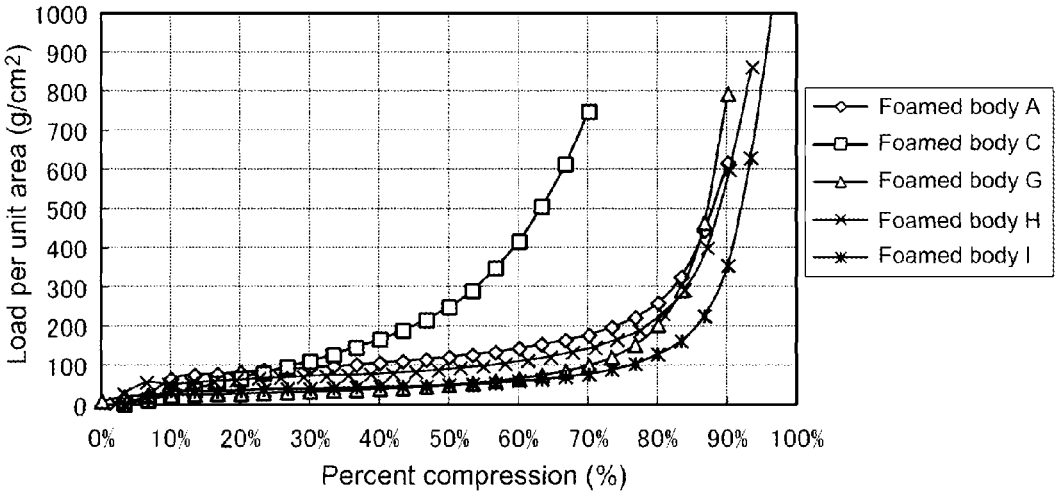
FIG. 30 Graph showing relationship between percent compression of reactive-force-providing elastic body and reactive-force-providing load.

Furthermore, regarding the foamed body constituting reactive-force-providing elastic body 24, results of measuring the relationship between percent compression and reactive-force-providing load per unit area, i.e., load per unit area, is shown at the graph in FIG. 30. Calculating in simple fashion based on these results, the thickness of sealing member 8 having stripes constituting bands 14 might be such that, for the thickness of the plain weave 10 or twill weave 11 forming recessed region 6, using monofilament of around 40 μm for weft yarn 17, and using warp yarn 15 comprising, e.g., 45 denier/15 F yarn which has been made to be soft-twist and is made from continuous fibers of diameter around 20 μm so that the fibers will spread out in parallel fashion over the lines of weft yarn 17 for warp yarn 15, the constitution obtained is such that thickness is less than or equal to 80 μm (i.e., (20 μm×2)+40 μm). For the satin weave 9 at projecting region 7, by using yarn which has been made to be soft-twist from eight continuous fibers of diameter around 20 μm (e.g., yarn of 24 denier (3D×8F)), and causing yarn diameter to be around 55 μm, a thickness of 150 μm ((55 μm×2)+40 μm), i.e., 0.15 mm, might be obtained, producing a step 13 which is 0.07 mm in height. As a result, it will be possible to achieve a thickness of 0.15 mm at sealing member 8. In addition, with a foamed body capable of 80% compression at less than or equal to 300 g/cm$^2$, the part used might have thickness 1 mm, this becoming 0.2 mm at 80% compression, as a result of which the sum of the thickness of the sealing member 8 and the thickness of the foamed body constituting reactive-force-providing elastic body 24 might be 0.15 mm+0.2 mm=0.35 mm, and when the thickness of the adhesive layer (0.05 mm×2=0.1 mm) of two-sided adhesive tape 25 is added to this value, this becomes 0.45 mm, which can be adequately accommodated by a gap 32 of 0.5 mm between the develop roller 2*a* and the installation seat 43 for end seal member 5. It is clear that this will make it possible to reduce the diameter of supply roller 42 and will make it possible to achieve further reductions in size.

Furthermore, as described above with respect to the width of entry by toner 18, while width of entry by toner 18 may be held to 1 mm or less, there are attachment scenarios that, depending on the manner in which the device is used, may tend to increase entry by toner 18, and so description in this regard will be carried out. FIG. 31 at (a) shows a diagram of an installation scenario in which toner 18 will tend not to enter sealing member 8, and at (b) shows a diagram of an installation scenario in which it will tend to enter thereinto, FIG. 31(*a*) being a situation in which contact between projecting region 7 and develop roller 2*a* is such that while only one projecting region 7 contacts develop roller 2*a* it does so in such fashion that the projecting region 7 is inside the region to be sealed, and FIG. 31(*b*) being a situation in which contact between projecting region 7 and develop roller 2*a* is such that only one projecting region 7 contacts develop roller 2*a* and it does so in such fashion that the projecting region is outside the region to be sealed. That is, where there is only a single projecting region 7 of end seal member 5 in the zone where projecting region 7 at the region made in satin weave 9 which controls toner flow direction 28 as shown in FIG. 10 contacts toner carrier 2, i.e., the zone to be sealed, when the downstream-most portion of projecting region 7 of end seal member 5 which contacts toner carrier 2 is located outside the member to be sealed, a width corresponding to the distance by which projecting region 7 is displaced to the outside as shown in FIG. 31 will be the width of entry by toner 18; but when the downstream-most portion of projecting region 7 is located inside the member to be sealed, a situation is achieved such that entry into sealing member 8 by toner 18 tends not to occur. Based on this point, it is preferred that the constitution be such as to cause a plurality of projecting regions 7 comprising satin weave 9 to contact toner carrier 2, so that it will be possible to prevent toner 18 from entering the member to be sealed without the need to limit the location of projecting region 7.

Next, shown in FIG. 32 is an exemplary diagram in which a cleaning apparatus 39 has been constituted in modular fashion as a cleaning unit for use in an image-forming device 1 in accordance with the present invention. End seal member 5 is of narrow width at FIG. 32(*a*) and is of wide width at FIG. 32(*b*). Even in the context of a device in which cleaning apparatus 39 has thus been constituted in modular fashion as a cleaning unit, this may still be used as image-forming device 1.

Figure 33:
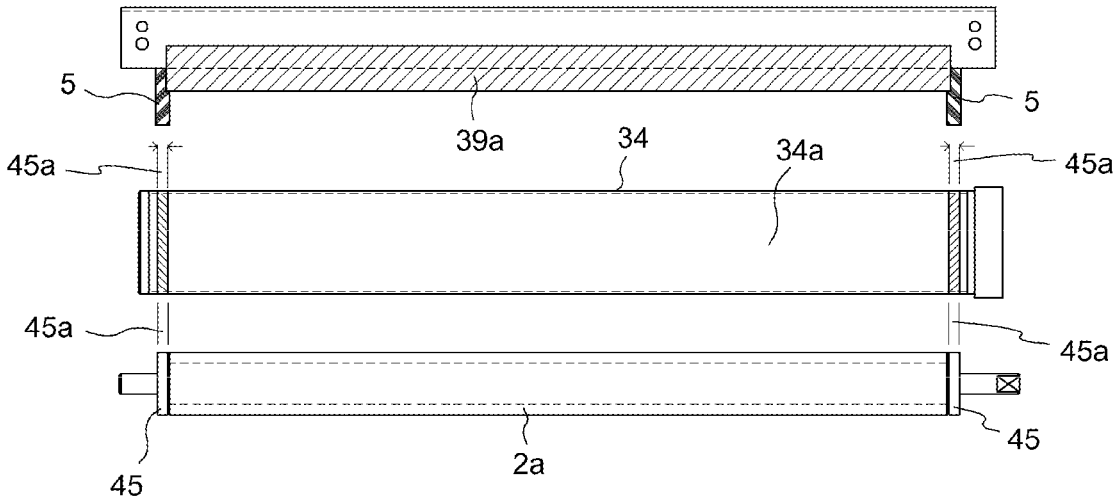
FIG. 33 Drawing showing combination of cleaning blade, photosensitive drum, and develop roller at which spacer pulleys are present.

Furthermore, at the device shown in FIG. 33, so as to maintain constant distance between photosensitive drum 34*a* and develop roller 2*a* at the end of develop roller 2*a*, a spacer pulley 45 capable of being rotated freely is provided at the end of develop roller 2*a*. At such an end, end seal member 5 and spacer pulley 45 come in contact within a region of width 45*a*. In such a device, there are situations in which rotation of develop roller 2*a* carrying develop roller or toner 18 may cause slight scattering of toner 18 in smoke-like fashion. At such times, because spacer pulley 45 contacts photosensitive body 34 in such fashion that it can rotate freely, the scattered toner 18 may be squashed onto the surface of photosensitive drum 34*a* as spacer pulley 45 comes in contact with photosensitive drum 34*a*. For this reason, with passage of time, scattered toner 18 may become compacted by spacer pulley 45 and build up in thickness. As a result, this may cause a change in the situation by which a constant distance had been maintained between photosensitive body 34 and develop roller 2*a* by spacer pulley 45, such that toner 18 adhering to photosensitive body 34 and/or toner 18 adhering to spacer pulley 45 causes increase in the distance between photosensitive body 34 and develop roller 2*a* at the location where it adheres. When this happens, it can cause occurrence of transverse band-like image voids at photosensitive body 34 or occurrence of density nonuniformity. One method for addressing this is to increase the extent in the horizontal width direction of the cleaning blade 39*a* or other such cleaning apparatus 39 so that the region contacted by the spacer pulley 45 is also cleaned by the cleaning blade 39*a* or other such cleaning apparatus 39. However, because increasing the extent in the horizontal width direction of the cleaning blade 39*a* or other such cleaning apparatus 39 in this manner will also cause the width of the device to increase, it can hardly be said to be good from the standpoint of reduction in size of the device.

Because image-forming device 1 in accordance with the present invention employs a sealing member 8 having projections and recesses at end seal member 5 in cleaning apparatus 39, which is to say that sealing member 8 is provided as end seal member 5 in a region contacted by spacer pulley 45, scraping action produced by end seal member 5 makes it possible for toner 18 scattered on the surface of photosensitive drum 34*a* to be constantly scraped off therefrom. As a result, transverse voids and band-like nonuniformities which constitute image defects are eliminated, and reduction in size is at the same time made possible. It is preferred that the width of end seal member 5 at this cleaning apparatus 39 be slightly larger than the width of the region at which spacer pulley 45 comes in contact with photosensitive body 34. To further prevent toner 18 scattered toward photosensitive body 34 from adhering thereto, paraffin or other such wax or metallic soap or other such fatty acid salt having good sliding characteristics may be applied to sealing member 8.

Figure 34:
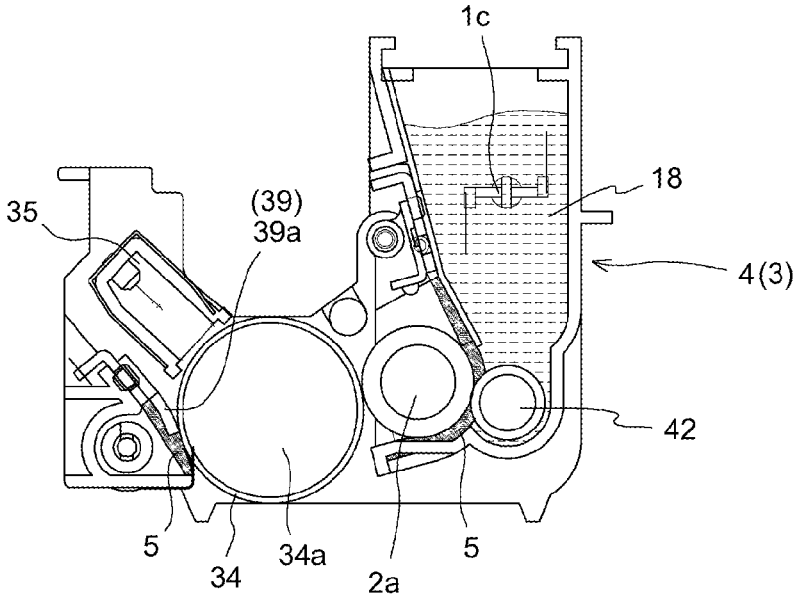
FIG. 34 Side view of example of use of processing unit.
Figure 35:
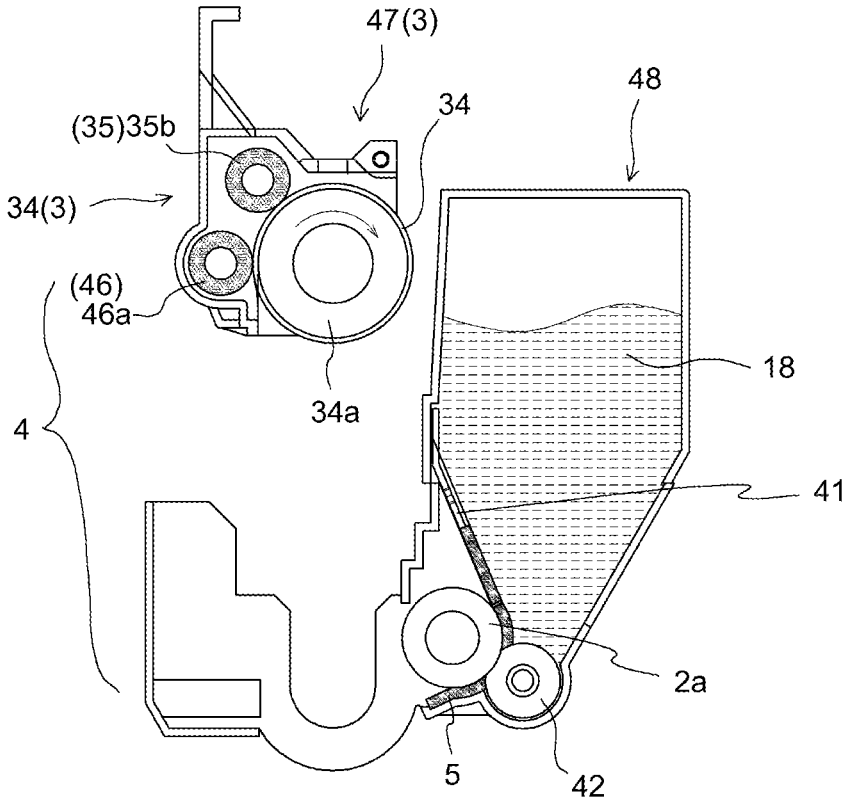
FIG. 35 Side view of example of separable unit.
Figure 36:
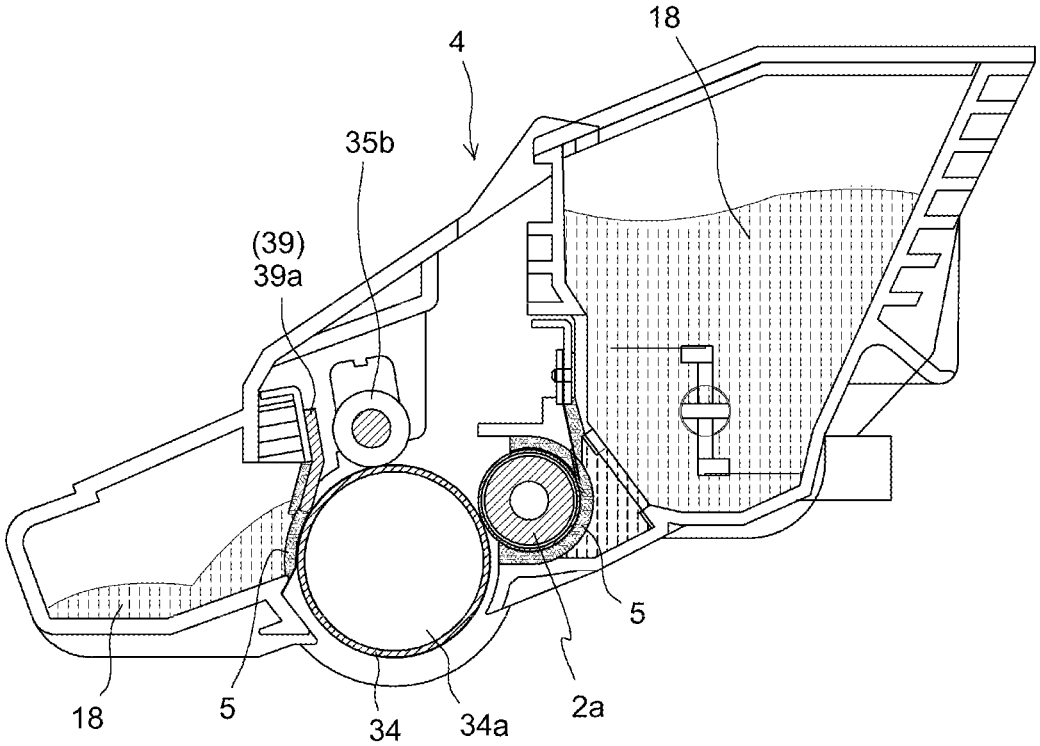
FIG. 36 Side view of integral processing unit (processing cartridge).

FIG. 34, FIG. 35, and FIG. 36 show diagrams of processing units 4 which are processing cartridges which may be employed in image-forming device 1 in accordance with the present invention. First, FIG. 34 shows a processing unit 4 which is formed in integral fashion as a unit 3 and which allows refill of toner. FIG. 35 shows a processing unit 4 in which develop apparatus unit 48 and photosensitive body unit 47 comprising photosensitive drum 34*a* having photosensitive body 34 in unit 3 are separable, no cleaning apparatus 39 being present at photosensitive body unit 47, but dispersal means comprising sponge roller 46*a* constituting a dispersal roller for dispersing toner 18, i.e., an electrically conductive elastic roller, being present. As dispersal means, it is also possible to employ electrically conductive stationary brush 46*c*. Moreover, processing unit 4 in FIG. 36 is an integral processing cartridge, develop roller 2*a* and photosensitive drum 34*a* being present in integral fashion as a module.

TABLE 2 presents results of testing of seal characteristics in an actual machine when the woven fabric 12*a* of FIG. 1 having the steps 13 shown in FIG. 2 was employed as sealing member 8. This woven fabric 12*a* was a sealing member 8 constituting stripes in the form of bands 14 shown in FIG. 1 having steps 13 woven from warp yarn 16 of thickness as indicated in the table for the region in satin weave 9, warp yarn 15 of thickness of 78T/17F for the region in plain weave 10, and weft yarn 17 constituting polyamide (trade name Nylon) monofilament of thickness 56T/1F at a weft yarn pitch of 0.4 mm. Here, surface velocity of toner carrier 2 was 250 mm/s. At TABLE 2, Working Example 1 through Working Example 7 were such that a foamed body having reactive-force-providing elastic body 24 was provided at the back surface of sealing member 8 comprising this woven fabric 12*a*, and as shown in FIG. 3, two-sided adhesive tape 25 was affixed to the back surface of this foamed body, following which control angle 27 constituting the orientation of the stripes was set so as to be 70° to fabricate end seal member 5. Conditions at the test apparatus were such that respective tests were carried out with a surface velocity at toner carrier 2 which was 250 mm/s for Working Examples 1 through 7, with spherical toner for which average particle diameter was 6 μm and toner angle θ of repose was 27° being employed at Working Examples 1 through 6, and with pulverized toner for which average particle diameter was 8 μm and toner angle θ of repose was 38° being employed at Working Example 7. As indicated at TABLE 2, results of using various sealing members 8 employed in image-forming device 1 in accordance with the present invention to carry out evaluation of seal characteristics were such that even for a step 13 of 0.2 mm there was no leakage of toner 18 to the exterior during rotation, results indicating that seal characteristics were good as indicated by O (OK).

TABLE 2

| | Control angle (°) | Recess width (mm) | Recess thickness (mm); ( ) indicates weft yarn diameter | Warp yarn 16 forming scraping angle: Yarn thickness | Warp yarn 16 forming scraping angle: Fiber diameter (μm) | Step (mm) | Contact load (g) | Scraping angle α (°) | Evaluated toner angle of repose (°) | Seal characteristics |
|---|---|---|---|---|---|---|---|---|---|---|
| Working Example 1 | 70 | 2 | 0.17 (0.08) | 78T/24F | 19 | 0.1 | 150 | 58.6 | 27 | ○ (OK) |
| Working Example 2 | 70 | 1 | 0.17 (0.08) | 78T/24F | 19 | 0.1 | 150 | 58.6 | 27 | ○ (OK) |
| Working Example 3 | 70 | 0.5 | 0.17 (0.08) | 78T/24F | 19 | 0.1 | 150 | 58.6 | 27 | ○ (OK) |
| Working Example 4 | 70 | 2 | 0.17 (0.08) | 56T/17F | 19 | 0.05 | 150 | 58.6 | 27 | ○ (OK) |
| Working Example 5 | 70 | 2 | 0.17 (0.08) | 122T/30F | 21 | 0.15 | 150 | 56.2 | 27 | ○ (OK) |
| Working Example 6 | 70 | 2 | 0.17 (0.08) | 244T/60F | 21 | 0.2 | 150 | 56.2 | 27 | ○ (OK) |
| Working Example 7 | 70 | 2 | 0.17 (0.08) | 78T/24F | 19 | 0.1 | 150 | 58.6 | 38 | ○ (OK) |

Moreover, TABLE 3 presents results of testing of seal characteristics in an actual machine when a resin sheet having steps 13 was employed at end seal member 5. Here, surface velocity of toner carrier 2 at the test apparatus was 250 mm/s. That is, at TABLE 3, a foamed body constituting reactive-force-providing elastic body 24 was affixed to the back surface of sealing member 8 formed from woven fabric 12*a* in the form of stripes having steps 13 comprising recessed regions 6 and projecting regions 7, and two-sided adhesive tape 25 was affixed to the back surface of the foamed body, following which the control angle 27 of the stripes was set so as to be 70° to fabricate end seal member 5, and testing carried out on a test apparatus, results being as indicated. As indicated at TABLE 3, conditions for Comparative Example 1, Comparative Example 2, and Working Example 1 were such that radius R of radiused region 7*a* at toner scraping angle α was large, and toner scraping angle α was smaller than toner angle θ of repose, under which conditions scraping action was bad, such that, for example, seal characteristics during rotation of develop roller 2*a* were inadequate; seal characteristics being bad, or NG, as indicated by x at Comparative Example 1 and Comparative Example 2; and being fair as indicated by Δ, despite some entry thereinto, at Working Example 1. At Working Example 2, toner scraping angle α was larger than toner angle θ of repose, under which conditions seal characteristics were (OK), or excellent, as indicated by O, this being a level at which there was no problem. Based on these results, it is clear that it is desired that conditions be made such that toner scraping angle α, which is determined based on the size of radius R of toner scraping angle α, diameter of develop roller 2*a*, and particle diameter of toner 18, is larger than toner angle θ of repose.

TABLE 3

| | Control angle (°) | Recess width (mm) | Recess thickness (mm) | Scraping angle radius R (μm) | Step (mm) | Contact load (g) | Toner scraping angle α (°) | Toner angle θ of repose (°) | Seal characteristics |
|---|---|---|---|---|---|---|---|---|---|
| Comparative Example 1 | 70 | 2 | 0.2 | 156 | 0.05 | 391 | 16 | 27 | x (bad) |
| Comparative Example 2 | 70 | 2 | 0.15 | 94 | 0.1 | 385 | 20 | 27 | x (bad) |
| Working Example 1 | 70 | 2 | 0.10 | 62 | 0.15 | 414 | 25 | 27 | Δ (fair) |
| Working Example 2 | 70 | 2 | 0.05 | 48 | 0.2 | 378 | 28 | 27 | ○ (good) |

Based on the foregoing results, it was confirmed that the location at which toner scraping angle α is formed is capable of producing a cleaning effect at toner carrier 2. Accordingly, it will be meaningful to employ yarn comprising filament(s), i.e., fiber(s), of stable diameter at members which form toner scraping angle α. From the standpoint of manufacture of sealing member 8 as well, use of yarn comprising such fiber(s) of stable diameter will make it possible to manufacture sealing member 8 in stable fashion. Furthermore, with respect to the method of manufacturing this corner of projecting region 7, it is possible to fabricate this through use of methods in which this is molded from resin sheet and/or methods involving lamination in the form of sheet(s). However, based upon current considerations of cost, stability, facilities, and other such manufacturing aspects and so forth, it is desired that sealing member 8 be formed from woven fabric 12*a*. Moreover, with respect to leakage during vibration, leakage can be prevented through appropriate setting of contact load and step(s) 13 as described above.

TABLE 4 presents results of comparative examples and working examples carried out with employment of different system speeds at image-forming device 1. Particulars of what was carried out were such that testing was carried out by varying width of sealing member 8 from 3 mm to 9 mm, and by using such sealing members 8 as end seal members 5 at a cleaning blade 39*a* of a cleaning apparatus 39 and as end seal members 5 at a develop roller 2*a* constituting a developer carrier 36 which was a toner carrier 2, the items which were evaluated being width of entry by toner 18, seal characteristics, and image defects.

TABLE 4

| | | | | | Sealing member sample | | | | | | | | Evaluation item | | |
|---|---|---|---|---|---|---|---|---|---|---|---|---|---|---|---|
| | | | | | | | | | Warp yarn 16 at projecting region | | | | | | |
| | | Toner type | System speed | End seal installation location | Seal member width | Projection width | Recess width | Step | Warp yarn 16 | Fiber diameter | Toner control angle | Test sheets | Toner entry | Seal charac-teristics | Image defects |
| Working Examples | Color | Nonmagnetic single-component spherical toner; angle of repose = 27° | 50 (mm/sec) | Develop roller end | 5.0 mm | 2 mm | 2 mm | 0.05 mm | 56T/17F | 19 μm | θ = 70° | 3,000 | 0.8 mm | ○ (OK) | ○ (OK) |
| | | | | | 5.0 mm | 2 mm | 2 mm | 0.1 mm | 78T/24F | 19 μm | θ = 45° | 3,000 | — | ○ (OK) | ○ (OK) |
| | | | | | 5.0 mm | 2 mm | 2 mm | 0.1 mm | 78T/24F | 19 μm | θ = 70° | 3,000 | 0.9 mm | ○ (OK) | ○ (OK) |
| | | | | Cleaning blade end | 7.0 mm | 0.5 mm | 0.5 mm | 0.1 mm | 78T/24F | 19 μm | θ = 70° | 3,000 | 0 | ○ (OK) | ○ (OK) |
| | | | 100 (mm/sec) | Develop roller end | 5.0 mm | 2 mm | 2 mm | 0.1 mm | 78T/24F | 19 μm | θ = 70° | 20,000 | 0.5 mm | ○ (OK) | ○ (OK) |
| | | Nonmagnetic single-component pulverized toner; angle of repose = 38° | 125 (mm/sec) | Develop roller end | 8.0 mm | 2 mm | 2 mm | 0.1 mm | 78T/24F | 19 μm | θ = 60° | 10,000 | 0.3 mm | ○ (OK) | ○ (OK) |
| | | | | | 3.0 mm | 1 mm | 1 mm | 0.1 mm | 78T/24F | 19 μm | θ = 80° | 4,000 | 0.3 mm | ○ (OK) | ○ (OK) |
| | | | | Cleaning blade end (photosensitive body end seal) | 8.0 mm | 2 mm | 2 mm | 0.1 mm | 78T/24F | 19 μm | θ = 45° | 4,000 | 0 | ○ (OK) | ○ (OK) |
| | | | | Cleaning blade end (photosensitive body end seal) | 8.0 mm | 2 mm | 2 mm | 0.1 mm | 78T/24F | 19 μm | θ = 45° | 4,000 | 0 | ○ (OK) | ○ (OK) |
| | Monochromatic | Magnetic single-component pulverized toner; angle of repose = 40° | 150 (mm/sec) | Develop roller end | 3.5 mm | 2 mm | 2 mm | 0.1 mm | 78T/24F | 19 μm | θ = 70° | 7,000 | 0.4 mm | ○ (OK) | ○ (OK) |
| | | | | | 3.5 mm | 2 mm | 2 mm | 0.05 mm | 56T/17F | 19 μm | θ = 70° | 7,000 | 0.3 mm | ○ (OK) | ○ (OK) |
| | | | | | 3.5 mm | 0.5 mm | 0.5 mm | 0.1 mm | 78T/24F | 19 μm | θ = 70° | 14,000 | 0.6 mm | ○ (OK) | ○ (OK) |
| | | | | | 3.5 mm | 1.0 mm | 1.0 mm | 0.1 mm | 78T/24F | 19 μm | θ = 70° | 14,000 | 0.6 mm | ○ (OK) | ○ (OK) |
| | | | | | 3.5 mm | 2 mm | 2 mm | 0.05 mm | 56T/17F | 19 μm | θ = 70° | 14,000 | 0.4 mm | ○ (OK) | ○ (OK) |
| | | | | | 3.5 mm | 2 mm | 2 mm | 0.15 mm | 122T/30F | 21 μm | θ = 70° | 14,000 | 0.8 mm | ○ (OK) | ○ (OK) |
| | | | | Cleaning blade end (photosensitive body end seal) | 9.0 mm | 0.5 mm | 0.5 mm | 0.1 mm | 78T/24F | 19 μm | θ = 70° | 7,000 | 0 | ○ (OK) | ○ (OK) |
| | | | | | 9.0 mm | 1.0 mm | 1.0 mm | 0.1 mm | 78T/24F | 19 μm | θ = 70° | 7,000 | 0 | ○ (OK) | ○ (OK) |
| | | | | | 9.0 mm | 2 mm | 2 mm | 0.1 mm | 78T/24F | 19 μm | θ = 70° | 7,000 | 0 | ○ (OK) | ○ (OK) |
| Comparative Reference | Color | Nonmagnetic single-component | 125 (mm/sec) | Develop roller end | 8.0 mm | Piled woven fabric seal member | | | | | θ = 45° | 4,000 | 2.5 mm | ○ (OK) | ○ (OK) |

TABLE 4-continued

| | | | | | Sealing member sample | | | | | | | | Evaluation item | | |
|---|---|---|---|---|---|---|---|---|---|---|---|---|---|---|---|
| | | | | End seal | Seal | | | | Warp yarn 16 at projecting region | | Toner | | | Seal | |
| | | Toner type | System speed | installation location | member width | Projection width | Recess width | Step | Warp yarn 16 | Fiber diameter | control angle | Test sheets | Toner entry | charac-teristics | Image defects |
| Example 1 | | pulverized toner | | | | | | | | | | | | | |
| Comparative Reference Example 2 | Color | Nonmagnetic single-component pulverized toner | 125 (mm/sec) | OPC end; cleaning blade end | 5.0 mm | | Piled woven fabric seal member (genuine product) | | | | θ = 45° | 4,000 | 1.0 mm | ○ (OK) | x (matter adhering to photosensitive body) |
| Comparative Reference Example 3 | Color | Nonmagnetic single-component conglobated toner | 50 (mm/sec) | Develop roller end | 5.0 mm | | Piled woven fabric seal member (genuine product) | | | | — | 1,500 | 2.0 mm | ○ (OK) | ○ (OK) |

As a result, with respect to the evaluation item "seal characteristics," for the working examples, as a result of print tests in which the number of test sheets of paper 49 printed at image-forming device 1 was varied, all were good (OK) as indicated by O. Furthermore, with respect to amount of entry, i.e., width of entry, by toner 18 at end seal member 5 of develop roller 2*a*, for all system speeds at the working examples, this was less than or equal to 1 mm. Moreover, no image defects whatsoever were observed following printing, all being good (OK) as indicated by O. Moreover, with respect to employment of end seal member 5 at cleaning blade 39*a*, while these results are not presented in the table, width of entry by toner 18 was approximately 0 mm, results being good, with no entry being observed. Moreover, at the end of a shaft at a monochromatic develop roller 2*a*, good results were observed even where seal width at end seal member 5 was 3 mm.

In contradistinction hereto, at Comparative Reference Examples 1 through 3, results of comparison with a genuine product in the form of image-forming device 1 were such that, at the conventional devices, for end seal member 5 at develop roller 2*a* in Comparative Reference Example 1, width of entry by toner 18 was 2.5 mm, while for end seal member 5 at the end of the cleaning blade in Comparative Reference Example 2, width of entry by toner 18 was 1.0 mm. Width of entry by toner 18 at end seal member 5 of develop roller 2*a* in Comparative Reference Example 3 was 2.0 mm. As also clear from these comparative reference examples, the image-forming device 1 in accordance with the present invention is an image-forming device 1 having an end seal member 5 which makes it possible to reduce width of entry by toner 18, and which accordingly makes it possible to adequately reduce the width of image-forming device 1.

As indicated at the working examples in TABLE 4, employment of sealing member 8 having steps 13 comprising woven fabric 12*a* at end seal member 5 used in image-forming device 1 in accordance with the present invention makes it possible, even where, for example, there is not more than a prescribed gap 32 between toner carrier 2 and end seal member 5, and even where there is a gap at the edge of projecting region 7, to form an end seal member 5 which is capable of adequate sealing with respect to toner, use of this sealing member 8 making it possible to provide an image-forming device 1 of narrow width that was not available conventionally, and making it possible to achieve a device that is economical, has low cost, and is highly reliable.

EXPLANATION OF REFERENCE NUMERALS

1 Image-forming device
1*a* Monochromatic image-forming device
1*b* Color image-forming device
1*c* Agitator
1*d* Device outer shell
2 Toner carrier
2*a* Develop roller
2*b* Develop roller width
3 Unit
4 Processing unit
5 End seal member
5*a* End seal member width
6 Recessed region
7 Projecting region
7*a* Radiused region
7*b* Chamfered region
8 Sealing member
9 Satin weave
10 Plain weave
11 Twill weave
12*a* Woven fabric
12*b* Yarn (fiber)
12*c* Molded part
13 Step
14 Band
15 Warp yarn (multifilament)
16 Warp yarn (multifilament)
17 Weft yarn (monofilament)
18 Toner
23 Adhesive
24 Reactive-force-providing elastic body
25 Two-sided adhesive tape
26 Mold release paper
27 Control angle
28 Toner flow direction
29 Toner scraping direction
31 Funnel
32 Gap
33 Continuous-feed machine
34 Photosensitive body (photosensitive body unit)
34*a* Photosensitive drum
34*b* Photosensitive body width
35 Charging apparatus (charging unit; i.e., charging means)
35*a* Charging device
35*b* Charging roller
36 Developer carrier (develop unit; i.e., develop means)
37 LED head
38 Recording medium
39 Cleaning apparatus (cleaning unit; i.e., cleaning means)
39*a* Cleaning blade
39*b* Cleaning blade width
40 Intermediate transfer belt
41 Control blade
41*a* Control blade width
42 Supply roller
43 Installation seat
44 Vibration testing apparatus
44*a* Vibration source
45 Spacer pulley
45*a* Width (width of end seal member that contacts spacer pulley)
46 Dispersal apparatus (dispersal unit; i.e., dispersal means)
46*a* Sponge roller
46*b* Brush roller
46*c* Stationary brush
47 Image carrier (photosensitive body unit)
48 Develop apparatus unit (develop unit)
49 Paper
50 Discharge screw
51 Weight
52 Secondary transfer region
α Toner scraping angle
R Radius
θ Toner angle of repose

The invention claimed is:

1. In the context of an electrophotographic image-forming device which employs toner, an electrophotographic image-forming device having an end seal member characterized in that it has a toner carrier having toner, and an end seal member for preventing leakage of toner from an end of a toner carrier comprising a rectangular sealing member having a step comprising a projecting region and a recessed region forming a stripe in the form of a band of linear configuration, said sealing member having a toner scraping angle and a contact surface which contacts a surface of a toner carrier and a projecting region and a recessed region, the foregoing recessed region being made to bend in a direction of a toner carrier due to bending load from contact pressure between an end seal member and a toner carrier, and having action whereby entry of toner into a sealing member is controlled and action whereby toner is scraped and action whereby toner is transferred, a control angle being formed in a linear direction from a projecting region and a recessed region at a stripe in the form of a band at a surface of a sealing member for return of toner to a toner storage container or a temporary toner storage container and for prevention of leakage of toner to an exterior from a toner carrier due to surface velocity of a toner carrier, an end seal member being provided with a recessed region and an edge of a projecting region for preventing leakage of toner from a toner carrier, said sealing member being employed at an end seal member of a toner carrier in an image-forming device, wherein the contact surface of the toner carrier contacts directly with the contact surface of the sealing member.

2. An electrophotographic image-forming device having an end seal member according to claim 1 characterized in that a rectangular sealing member having a step comprising a projecting region and a recessed region forming a stripe in the form of a band of linear configuration is woven fabric having a step comprising a projecting region and a recessed region at a stripe in the form of a band comprising combination of weaving patterns made in satin weave and plain weave or combination of weaving patterns made in satin weave and twill weave, and a control angle in a linear direction at a stripe in the form of a band comprising a projecting region and a recessed region provided at a surface of a sealing member for return of toner to a toner carrier and for prevention of leakage of toner to an exterior from a toner carrier due to surface velocity of a toner carrier or rotation of a toner carrier is an angle in a direction causing return of toner to a storage container that temporarily stores or a container that stores toner, and a region on a surface of a sealing member at a step between a projecting region and a recessed region of a stripe is formed from a warp yarn, a recessed region having a structure which allows it to bend easily.

3. An electrophotographic image-forming device having an end seal member according to claim 2 characterized in that a sealing member comprising woven fabric having a step comprising a projecting region and a recessed region at a stripe in the form of a band comprising combination of weaving patterns made in satin weave and plain weave or combination of weaving patterns made in satin weave and twill weave has at a back surface thereof an elastic body providing reactive force upon compression, wherein formed at a corner produced by a step comprising a projecting region and a recessed region and a toner carrier formed by contact between a recessed region and a toner carrier there is a gap which at a desired vibration does not cause leakage of, or between a recessed region and a toner carrier there is a gap which at a desired vibration does not cause leakage of, toner scraped by toner scraping action, due to reactive-force-providing elasticity of a reactive-force-providing elastic body, reduction in width of an electrophotographic image-forming device being achieved as a result of causing said sealing member to be an end seal member which is of small width and which is of small thickness when compressed in a thickness direction.

4. An electrophotographic image-forming device having an end seal member according to claim 1 characterized in that a toner carrier is a developer carrier that carries toner and carries out development or is an image carrier that carries a toner image which has been made visible, wherein a sealing member is arranged as an end seal member for preventing leakage of toner from at least one of an image carrier and a developer carrier.

5. An electrophotographic image-forming device having an end seal member according to claim 4 characterized in that an image carrier that carries a toner image has at least one of a dispersal apparatus that disperses toner and a cleaning apparatus that cleans a surface thereof, and in that there is a develop unit having a developer carrier that carries toner, wherein a sealing member is arranged as an end seal member for preventing leakage of toner at at least one of these apparatuses.

6. In the context of a device having a toner carrier at an electrophotographic image-forming device which employs toner, a unit having a toner carrier removably installed in an electrophotographic image-forming device main body having an end seal member characterized in that a toner carrier present at this device has a contact surface that contacts an end seal member arranged at an end of a toner carrier comprising a rectangular sealing member having a step comprising a projecting region and a recessed region at a stripe in the form of a band of linear configuration for preventing leakage of toner from an end of a toner carrier, contact being made with an end seal member at this contact surface, contact pressure produced by contact between this toner carrier and end seal member causing a recessed region at said sealing member to bend and deform in a direction of a toner carrier, and deformation due to bending of a recessed region at said sealing member having action whereby entry of toner into a sealing member is controlled and action whereby toner is scraped and action whereby toner is transferred, wherein provided therein are a recessed region and an edge of a projecting region, and a control angle in a linear direction from a projecting region and a recessed region at a stripe in the form of a band at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device, wherein the contact surface of the toner carrier contacts directly with the contact surface of the sealing member.

7. A unit having a toner carrier removably installed in an electrophotographic image-forming device main body having an end seal member according to claim 6 characterized in that an end seal member arranged at an end of a toner carrier comprising a rectangular sealing member is a sealing member comprising woven fabric comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member having a step between a projecting region and a recessed region in this banded pattern being used to form an end seal member having a projecting region and a recessed region in a linear configuration at a surface, and having action whereby entry of toner into a sealing member is controlled by reduction of a gap produced when a recessed region is bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and bending and deformation of a recessed region toward a toner carrier due to contact load between a sealing member and a toner carrier or a gap due to a step comprising a projecting region and a recessed region and surface velocity at a toner carrier, prevention of leakage of toner and cleaning of a surface at an end of a toner carrier being provided by an angle of orientation of a projecting region and a recessed region of linear configuration at a sealing member surface, a projecting region at an edge comprising warp yarn in a woven fabric, and a recessed region having an easily deformable structure.

8. A unit having a toner carrier removably installed in an electrophotographic image-forming device main body having an end seal member according to claim 7 characterized in that action whereby entry of toner into a sealing member is controlled, action whereby toner is scraped at a recessed region, and action whereby toner is transferred as a result of a toner transfer gap and rubbing contact with a toner carrier and bending and deformation of a recessed region toward a toner carrier due to contact load between a sealing member and a toner carrier or a gap due to a step comprising a projecting region and a recessed region and surface velocity at a toner carrier, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, action whereby toner is scraped, and action whereby toner is transferred making it possible to reduce width of an end seal member and reduce thickness of an end seal member when compressed, and to reduce width of a unit having a toner carrier.

9. In the context of an electrophotographic image-forming device which employs toner, a develop unit constituting a developer carrier that uses toner to carry out development at a toner carrier removably installed in an electrophotographic image-forming device main body or a photosensitive body unit constituting an image carrier that carries a toner image removably installed in an electrophotographic image-forming device main body having an end seal member characterized in that there is a unit which is constituted in integral fashion such that a toner carrier constituting a developer carrier which carries toner and which carries out development or an image carrier carrying a toner image which has been made visible is removably installed in an image-forming device main body, wherein a toner carrier constituting this unit has a contact surface that contacts an end seal member arranged at an end of a toner carrier comprising a rectangular sealing member having a step comprising a projecting region and a recessed region at a stripe in the form of a band of linear configuration for preventing leakage of toner from an end of a toner carrier, contact being made with an end seal member at this contact surface, contact pressure produced by contact between this toner carrier and end seal member causing a recessed region at said sealing member to bend and deform in a direction of a toner carrier, and deformation due to bending of a recessed region at said sealing member having action whereby entry of toner into a sealing member is controlled and action whereby toner is scraped and action whereby toner is transferred, wherein provided therein are a recessed region and an edge of a projecting region, and a control angle in a linear direction from a projecting region and a recessed region at a stripe in the form of a band at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device, wherein the contact surface of the toner carrier contacts directly with the contact surface of the sealing member.

10. A develop unit constituting a developer carrier that uses toner to carry out development at a toner carrier removably installed in an electrophotographic image-forming device main body or a photosensitive body unit constituting an image carrier that carries a toner image removably installed in an electrophotographic image-forming device main body having an end seal member according to claim 9 characterized in that a unit which is constituted in integral fashion such that a toner carrier constituting a developer carrier which carries toner and which carries out development or an image carrier carrying a toner image which has been made visible is removably installed in a device main body has at least one of a dispersal means that disperses toner and a cleaning means that cleans a surface of an image carrier carrying a toner image, or has a developer carrier having a toner carrier, wherein a sealing member is employed as an end seal member for preventing leakage of toner at at least these means.

11. In the context of a processing unit which is constituted in integral fashion such that a develop unit and a unit having an image carrier removably installed and employed in an electrophotographic image-forming device, a processing unit which is constituted in integral fashion so as to be removably installed in an electrophotographic image-forming device main body having an end seal member characterized in that a toner carrier having toner is constituted so as to contact an end seal member that prevents leakage of toner from an end of a toner carrier, an end seal member is present at an end of a toner carrier, an end seal member comprises a rectangular sealing member having a step comprising a projecting region and a recessed region at a stripe in the form of a band of linear configuration, a contact surface being present at which contact is made between a surface at a toner carrier and an end seal member, constitution being such that contact pressure between an end seal member and a toner carrier causes the foregoing recessed region to bend and deform toward a toner carrier, and having action whereby entry of toner into a sealing member making up an end seal member is controlled and action whereby toner is scraped and action whereby toner is transferred, wherein an end seal member for preventing leakage of toner from a toner carrier is constituted so as to be provided with a recessed region and an edge of a projecting region, and an angle of orientation of a projecting region and a recessed region in linear configuration at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device, wherein the contact surface of the toner carrier contacts directly with the contact surface of the sealing member.

12. A processing unit which is constituted in integral fashion so as to be removably installed in an electrophotographic image-forming device main body having an end seal member according to claim 11 characterized in that an end seal member present at an end of a toner carrier comprises a sealing member comprising woven fabric having a step comprising a projecting region and a recessed region at a stripe in the form of a band comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member comprising woven fabric having a step comprising a projecting region and a recessed region at a stripe in the form of a band being used to form an end seal member having a projecting region and a recessed region in a linear configuration at a surface, and having action whereby entry of toner into a sealing member is controlled by reduction of a gap due to the fact that a recessed region is bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and deformation of a recessed region toward a toner carrier due to contact load between a sealing member and a toner carrier or a gap due to a step comprising a projecting region and a recessed region and surface velocity at a toner carrier, prevention of leakage of toner and cleaning of a toner carrier being provided by an angle of orientation of a projecting region and a recessed region of linear configuration at a sealing member surface, a projecting region at an edge comprising warp yarn in a woven fabric, and a recessed region having an easily deformable structure.

13. A processing unit which is constituted in integral fashion so as to be removably installed in an electrophotographic image-forming device main body having an end seal member according to claim 12 characterized in that action whereby entry of toner into a sealing member is controlled, action whereby toner is scraped at a recessed region, and action whereby toner is transferred, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, scraping action, and transfer action making it possible to reduce width of an end seal member, reduce thickness of an end seal member when compressed, and constitute a cartridge-type unit in integral fashion which is of reduced width.

14. A processing unit which is constituted in integral fashion so as to be removably installed in an electrophotographic image-forming device main body having an end seal member according to claim 13 characterized in that a toner carrier is a developer carrier that carries toner and carries out development or is an image carrier that carries a toner image which has been made visible, a unit having a toner carrier having been made integral therewith so as to be present in the form of a processing unit which is constituted in integral fashion so as to be removably installed in an image-forming device main body, wherein a sealing member is employed as an end seal member for preventing leakage of toner from a toner carrier at at least one of the foregoing image carrier that carries a toner image and developer carrier.

15. A processing unit which is constituted in integral fashion so as to be removably installed in an electrophotographic image-forming device main body having an end seal member according to claim 14 characterized in that a processing unit which is constituted in integral fashion such that a toner carrier is removably installed in an image-forming device main body has at least one of a dispersal means that disperses toner and a cleaning means that cleans a surface of an image carrier that carries a toner image, and has a develop means having a developer carrier constituting a toner carrier, wherein a sealing member is employed as an end seal member for preventing leakage of toner at at least one of the means.

16. In the context of a processing cartridge which is constituted in integral fashion so as to have develop means having a developer carrier and at least one of dispersal means, cleaning means, an image carrier, and a charging apparatus, and which is a processing cartridge that is removably installed and employed in an electrophotographic image-forming device, an integral processing cartridge removably installed in an electrophotographic image-forming device main body having an end seal member characterized in that a toner carrier which is present at this processing cartridge is constituted so as to come in contact with an end seal member that prevents leakage of toner from an end of a toner carrier, an end seal member is present at an end of a toner carrier, an end seal member comprises a rectangular sealing member having a step comprising a projecting region and a recessed region at a stripe in the form of a band of linear configuration, a contact surface being present at which contact is made between a surface at a toner carrier and said end seal member, constitution being such that contact pressure between an end seal member and a toner carrier causes said recessed region to bend and deform toward a toner carrier, and having action whereby entry of toner into a sealing member making up an end seal member is controlled and action whereby toner is scraped and action whereby toner is transferred, wherein an end seal member for preventing leakage of toner from a toner carrier is constituted so as to be provided with a recessed region and an edge of a projecting region, and an angle of orientation of a projecting region and a recessed region in linear configuration at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device, wherein the contact surface of the toner carrier contacts directly with the contact surface of the sealing member.

17. An integral processing cartridge removably installed in an electrophotographic image-forming device main body having an end seal member according to claim 16 characterized in that an end seal member present at an end of a toner carrier comprises a sealing member comprising woven fabric having a step comprising a projecting region and a recessed region at a stripe in the form of a band comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member comprising woven fabric having a step comprising a projecting region and a recessed region at a stripe in the form of this band being used to form an end seal member having a projecting region and a recessed region in a linear configuration at a surface, and having action whereby entry of toner into a sealing member is controlled by reduction of a gap due to the fact that a recessed region is bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and deformation of a recessed region toward a toner carrier due to contact load between a sealing member and a toner carrier or a gap due to a step comprising a projecting region and a recessed region and surface velocity at a toner carrier, prevention of leakage of toner and cleaning of a toner carrier being provided by an angle of orientation of a projecting region and a recessed region of linear configuration at a sealing member surface, a projecting region at an edge comprising warp yarn in a woven fabric, and a recessed region having an easily deformable structure.

18. An integral processing cartridge removably installed in an electrophotographic image-forming device main body having an end seal member according to claim 17 characterized in that action whereby entry of toner into a sealing member is controlled, action whereby toner is scraped at a recessed region, and action whereby toner is transferred, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, scraping action, and transfer action making it possible to reduce width of an end seal member, reduce thickness of an end seal member when compressed, and constitute a cartridge-type unit in integral fashion which is of reduced width.

19. An integral processing cartridge removably installed in an electrophotographic image-forming device main body having an end seal member according to claim 18 characterized in that a toner carrier is present in the form of a processing cartridge which is constituted in integral fashion such that a toner carrier comprising a developer carrier that carries toner and carries out development or an image carrier that carries a toner image which has been made visible is removably installed in a device main body, wherein a sealing member is employed as an end seal member for preventing leakage of toner from a toner carrier having toner at at least one of a developer carrier and an image carrier that carries a toner image.

20. In the context of an image-forming device having at least one of a dispersal apparatus and a cleaning apparatus removably installed in an electrophotographic image-forming device, a unit having a dispersal apparatus or a cleaning apparatus removably installed in an electrophotographic image-forming device main body having an end seal member characterized in that an end seal member that prevents leakage of toner from an end of a dispersal apparatus or a cleaning apparatus and a toner carrier is present which contacts a toner carrier at an end of a toner carrier, this end seal member comprises a rectangular sealing member having a step comprising a projecting region and a recessed region at a stripe in the form of a band of linear configuration, a contact surface being present at which contact is made at a surface between a toner carrier and this end seal member, constitution being such that contact pressure between an end seal member and a toner carrier causes said recessed region to bend and deform toward a toner carrier, and having action whereby entry of toner into a sealing member making up an end seal member is controlled and action whereby toner is scraped and action whereby toner is transferred, wherein an end seal member for preventing leakage of toner from a toner carrier is constituted so as to be provided with a recessed region and an edge of a projecting region, and an angle of orientation of a projecting region and a recessed region in linear configuration at a surface of a sealing member for return of toner to a toner storage container or a temporary toner storage container and for prevention of leakage of toner to an exterior from a toner carrier due to surface velocity of a toner carrier, said sealing member being employed as an end seal member of a toner carrier in an image-forming device, wherein the contact surface of the toner carrier contacts directly with the contact surface of the sealing member.

21. A unit having a dispersal apparatus or a cleaning apparatus removably installed in an electrophotographic image-forming device main body having an end seal member according to claim 20 characterized in that an end seal member present at an end of a toner carrier comprises a sealing member constituting woven fabric comprising combination of weaving patterns made in satin weave and plain weave or combination of weaving patterns made in satin weave and twill weave, this woven fabric having a step comprising a projecting region and a recessed region at a stripe in the form of a band, a recessed region of this step being made in plain weave or twill weave, a projecting region of a step being made in satin weave, a sealing member having a step between a projecting region and a recessed region in this banded pattern being used to form an end seal member having a projecting region and a recessed region in a linear configuration at a surface, and having action whereby entry of toner into a sealing member is controlled by reduction of a gap caused by a recessed region being bent and deformed toward a toner carrier due to contact pressure between a toner carrier and an end seal member or a gap due to a step comprising a projecting region and a recessed region at this end seal member, and action whereby there is scraping of toner at a recessed region due to toner and an edge of a projecting region and contact pressure therebetween, and action whereby toner is transferred as a result of a toner transfer gap and rubbing contact with a toner carrier and deformation of a recessed region toward a toner carrier due to contact load between a sealing member and a toner carrier or a gap due to a step comprising a projecting region and a recessed region and surface velocity at a toner carrier, prevention of leakage of toner and cleaning of a toner carrier being provided by an angle of orientation of a projecting region and a recessed region of linear configuration at a sealing member surface, a projecting region at an edge comprising warp yarn in a woven fabric, and a recessed region having an easily deformable structure.

22. A unit having a dispersal apparatus or a cleaning apparatus removably installed in an electrophotographic image-forming device main body having an end seal member according to claim 21 characterized in that action whereby entry of toner into a sealing member is controlled, action whereby toner is scraped at a recessed region, and action whereby toner is transferred as a result of a toner transfer gap and rubbing contact with a toner carrier and deformation of a recessed region toward a toner carrier, are imparted by reactive-force-providing elasticity due to compression of a reactive-force-providing elastic body provided at a back surface of a sealing member and contact between a toner carrier and a sealing member, wherein a gap is provided between a toner carrier and a recessed region which at a desired vibration does not cause leakage of toner or wherein a toner carrier and a recessed region are made to come in contact and a gap which at a desired vibration does not cause leakage of toner is provided at a corner formed by a step comprising a projecting region and a recessed region and a toner carrier, toner scraped by scraping action being within this gap made capable of movement as a result of surface velocity of a toner carrier, action whereby entry of toner into a sealing member is controlled, scraping action, and transfer action making it possible to reduce width of an end seal member, reduce thickness of an end seal member when compressed, and constitute a unit having a dispersal apparatus or a cleaning apparatus so as to be of reduced width.

23. A unit having a dispersal apparatus or a cleaning apparatus removably installed in an electrophotographic image-forming device main body having an end seal member according to claim 22 characterized in that a toner carrier is a transfer belt or a transfer body onto which a toner image is transferred or an image carrier that carries a toner image which has been made visible, wherein a sealing member is employed as an end seal member for preventing leakage of toner from a toner carrier at at least one of a transfer belt or a transfer body onto which a toner image is transferred and an image carrier that carries a toner image.

* * * * *